US010782063B2

(12) United States Patent
Lee et al.

(10) Patent No.: US 10,782,063 B2
(45) **Date of Patent: *Sep. 22, 2020**

(54) REFRIGERATOR

(71) Applicant: SAMSUNG ELECTRONICS CO., LTD., Suwon-si, Gyeonggi-do (KR)

(72) Inventors: Hyung Bum Lee, Hwaseong (KR); Beom Gon Kim, Yongin (KR); Su Hyeong Son, Incheon (KR); Woo Yeol Yoo, Gwangju (KR); Wan Hyeong Lee, Gwangju (KR); Youn Tae Shin, Gwangju (KR); Ji Sick Hwang, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/047,517

(22) Filed: Jul. 27, 2018

(65) Prior Publication Data

US 2018/0335245 A1 Nov. 22, 2018

Related U.S. Application Data

(63) Continuation of application No. 15/852,524, filed on Dec. 22, 2017, now Pat. No. 10,066,866, which is a (Continued)

(30) Foreign Application Priority Data

Mar. 11, 2014 (KR) ..... 10-2014-0028617
Jul. 29, 2014 (KR) ..... 10-2014-0096638

(51) Int. Cl.
*F25D 23/02* (2006.01)
*F25D 23/04* (2006.01)
(Continued)

(52) U.S. Cl.
CPC ..... *F25D 23/02* (2013.01); *E05B 15/0205* (2013.01); *E05B 17/0033* (2013.01);
(Continued)

(58) Field of Classification Search
CPC ..... F25D 23/02; F25D 23/025; F25D 23/028; F25D 23/04; F25D 2323/02;
(Continued)

(56) References Cited

U.S. PATENT DOCUMENTS 1,059,952 A 4/1913 Spooner
1,453,282 A 5/1923 Peters
(Continued)

FOREIGN PATENT DOCUMENTS

CN 1210916 3/1999
CN 102235790 11/2011
(Continued)

OTHER PUBLICATIONS

International Search Report dated Jun. 16, 2015 in corresponding International Patent Application No. PCT/KR2015/002357.
(Continued)

*Primary Examiner* — Andrew M Roersma
(74) *Attorney, Agent, or Firm* — Staas & Halsey LLP

(57) ABSTRACT

Provided is a refrigerator having only a second door opened/closed or having both of a first door and a second door opened/closed using one handing by allowing a latch device to fix the second door to the first door or release the second door from being fixed to the first door. The refrigerator includes a main body having a storage compartment, a first door that is rotatably disposed in front of the main body and has an opening formed therein, a second door that is rotatably disposed in front of the first door to open/close the opening, a handle coupled to a front side of the second door to open/close the first door and the second door, and a latch
(Continued)

device allowing the second door to be fixed and released to/from the first door.

11 Claims, 76 Drawing Sheets

Related U.S. Application Data continuation of application No. 15/348,378, filed on Nov. 10, 2016, now Pat. No. 10,203,148, which is a continuation of application No. 14/643,612, filed on Mar. 10, 2015, now Pat. No. 9,605,891.

(51) Int. Cl.

| | |
|---|---|
| ***E05B 65/00*** | (2006.01) |
| ***E05C 1/16*** | (2006.01) |
| ***E05C 3/14*** | (2006.01) |
| ***E05C 3/16*** | (2006.01) |
| ***E05B 15/02*** | (2006.01) |
| ***E05B 17/00*** | (2006.01) |
| ***E05D 3/04*** | (2006.01) |
| ***E05D 7/08*** | (2006.01) |
| ***E05C 1/12*** | (2006.01) |
| ***E05C 7/02*** | (2006.01) |
| ***E05D 7/081*** | (2006.01) |

(52) U.S. Cl.

CPC ..... *E05B 65/0042* (2013.01); *E05C 1/12* (2013.01); *E05C 1/16* (2013.01); *E05C 3/14* (2013.01); *E05C 3/145* (2013.01); *E05C 3/16* (2013.01); *E05C 7/02* (2013.01); *E05D 3/04* (2013.01); *E05D 7/081* (2013.01); *F25D 23/025* (2013.01); *F25D 23/028* (2013.01); *E05Y 2900/31* (2013.01); *F25D 23/04* (2013.01); *F25D 2323/023* (2013.01)

(58) Field of Classification Search

CPC ..... F25D 2323/021; F25D 2323/023; Y10S 292/71; Y10S 292/21

USPC ... 292/95, 96, 219, 220, 126, 100, 194, 195, 292/226, 200; 49/460, 61, 62, 63, 67

See application file for complete search history.

(56) References Cited

U.S. PATENT DOCUMENTS

| | | | | |
|---|---|---|---|---|
| 1,487,478 | A | 3/1924 | Rubin | |
| 2,131,522 | A * | 9/1938 | Peterson | F25D 23/04 312/300 |
| 2,293,700 | A | 8/1942 | Curtiss | |
| 2,309,049 | A | 1/1943 | Curtiss, Jr. et al. | |
| 2,469,113 | A | 5/1949 | Hooker | |
| 2,639,182 | A | 5/1953 | Jacobson | |
| 2,652,277 | A | 9/1953 | Anderson | |
| 2,741,505 | A | 4/1956 | Courney | |
| 2,942,438 | A * | 6/1960 | Schmeling | F25D 23/025 62/377 |
| 2,945,733 | A | 7/1960 | Malia | |
| 3,086,830 | A | 4/1963 | Malia | |
| 3,156,019 | A | 11/1964 | Dawley | |
| 5,700,044 | A | 12/1997 | Wartian | |
| 5,908,228 | A | 6/1999 | Lee | |
| 5,915,805 | A | 6/1999 | Lee | |
| 5,988,709 | A | 11/1999 | Lee et al. | |
| 6,209,265 | B1 | 4/2001 | Banicevic et al. | |
| 7,765,645 | B2 | 8/2010 | Kim | |
| 8,025,349 | B2 | 9/2011 | Lim et al. | |
| 8,398,185 | B2 | 3/2013 | Seo | |
| 8,523,302 | B2 | 9/2013 | Shin et al. | |
| 9,127,879 | B2 | 9/2015 | Hwang et al. | |
| 9,605,891 | B2 | 3/2017 | Lee | |
| 10,066,866 | B2 * | 9/2018 | Lee | F25D 23/02 |
| 2005/0200253 | A1 | 9/2005 | Wissinger et al. | |
| 2008/0000052 | A1 | 1/2008 | Hong et al. | |
| 2008/0282505 | A1 | 11/2008 | Kim | |
| 2009/0007608 | A1 | 1/2009 | Lorek | |
| 2010/0101267 | A1 | 4/2010 | Jung et al. | |
| 2010/0219730 | A1 | 9/2010 | Watts et al. | |
| 2011/0132024 | A1 | 6/2011 | Lim et al. | |
| 2011/0273070 | A1 | 11/2011 | Shin et al. | |
| 2012/0062093 | A1 | 3/2012 | Lee et al. | |
| 2012/0262045 | A1 | 10/2012 | Cheng et al. | |
| 2013/0026900 | A1 | 1/2013 | Oh et al. | |
| 2013/0033163 | A1 | 2/2013 | Kang | |
| 2014/0232251 | A1 | 8/2014 | Kim et al. | |
| 2015/0069900 | A1 | 3/2015 | Lim | |
| 2015/0176886 | A1 | 6/2015 | Lee et al. | |
| 2015/0241116 | A1 | 8/2015 | Choi et al. | |

FOREIGN PATENT DOCUMENTS

| | | | | |
|---|---|---|---|---|
| DE | 34 48 057 | A1 | 6/1986 | |
| DE | 10 2012 015 412 | A1 | 1/2014 | |
| EP | 3004761 | B1 | 2/2017 | |
| JP | 56-164495 | | 12/1981 | |
| JP | 57-85184 | | 5/1982 | |
| JP | 57-157983 | | 9/1982 | |
| JP | S57157983 | A * | 9/1982 | F25D 23/02 |
| JP | 08303943 | A | 11/1996 | |
| JP | 2000-249462 | | 9/2000 | |
| JP | 2003-262454 | | 9/2003 | |
| KR | 1997-0011756 | | 3/1997 | |
| KR | 1999-011033 | | 3/1999 | |
| KR | 10-0582459 | | 5/2006 | |
| KR | 10-2008-0050672 | | 6/2008 | |
| KR | 10-2008-0100553 | | 11/2008 | |
| KR | 10-2012-0063307 | | 6/2012 | |
| KR | 10-2012-0063316 | | 6/2012 | |
| KR | 10-2013-0053318 | | 5/2013 | |
| KR | 10-2014-0110477 | | 9/2014 | |
| WO | 2013/094872 | | 6/2013 | |

OTHER PUBLICATIONS

Office Action dated Dec. 3, 2015 in U.S. Appl. No. 14/643,612.
Office Action dated Mar. 28, 2016 in U.S. Appl. No. 14/643,612.
Advisory Action dated Jun. 8, 2016 in U.S. Appl. No. 14/643,612.
Office Action dated Jul. 19, 2016 in U.S. Appl. No. 14/643,612.
U.S. Notice of Allowance dated Nov. 14, 2016, in U.S. Appl. No. 14/643,612.
Australian Office Action dated Mar. 14, 2017, in corresponding Australian Patent Application No. 2015230612.
Office Action dated Jul. 7, 2017, in U.S. Appl. No. 15/348,378.
Extended European Search Report dated Aug. 16, 2017, in corresponding European Patent Application No. 15761163.3.
Australian Notice of Acceptance of Patent application dated Jun. 14, 2017, in corresponding Australian Patent Application No. 2015230612.
Office Action dated Oct. 30, 2017 in U.S. Appl. No. 15/348,378.
English Translation of claim 1 of Japanese Reference No. 57-157983, listed as Reference CD.
Canadian Office Action dated Oct. 23, 2017, in corresponding Canadian Patent Application No. 2,941,235.
First Action Interview Pilot Program Pre-Interview Communication dated Feb. 9, 2018, in U.S. Appl. No. 15/852,524.
Office Action dated Mar. 27, 2018, in U.S. Appl. No. 15/348,378.
Notice of Allowance dated May 1, 2018, in U.S. Appl. No. 15/852,524.
Corrected Notice of Allowability dated May 10, 2018, in U.S. Appl. No. 15/852,524.
Office Action dated Jul. 18, 2018, in U.S. Appl. No. 15/348,378.
Canadian Notice of Allowance dated Jun. 14, 2018, in corresponding Canadian Patent Application No. 2,941,235.
Corrected Notice of Allowability dated Jul. 27, 2018, in U.S. Appl. No. 15/852,524.
Response to Rule 312 dated Aug. 3, 2018, in U.S. Appl. No. 15/852,524.

(56) References Cited

OTHER PUBLICATIONS

Corrected Notice of Allowability dated Aug. 6, 2018, in U.S. Appl. No. 15/852,524.
Response to Rule 312 dated Nov. 23, 2016, in U.S. Appl. No. 14/643,612.
Advisory Action dated Feb. 13, 2018, in U.S. Appl. No. 15/348,378.
Response to Rule 312 dated Jun. 25, 2018, in U.S. Appl. No. 15/852,524.
U.S. Appl. No. 15/852,524, filed Dec. 22, 2017, Hyung Bum Lee et al., Samsung Electronics Co., Ltd.
U.S. Appl. No. 15/348,378, filed Nov. 10, 2016, Hyung Bum Lee et al., Samsung Electronics Co., Ltd.
U.S. Appl. No. 14/643,612, filed Mar. 10, 2015, Hyung Bum Lee et al., Samsung Electronics Co., Ltd.
Notice of Allowance dated Oct. 1, 2018, in U.S. Appl. No. 15/348,378.
Corrected Notice of Allowability dated Oct. 11, 2018, in U.S. Appl. No. 15/348,378.
Chinese Office Action dated Aug. 3, 2018, in corresponding Chinese Patent Application No. 201580026958.0.
Office Action issued in Chinese Patent Application No. 201580026958.0 dated Apr. 2, 2019.
European Patent Office issued Communication pursuant to Article 94(3) EPC in European Patent Application No. 15 761 163.3—1009 dated Oct. 15, 2019.
Communication pursuant to Article 94(3) EPC dated Apr. 9, 2020, in corresponding European Patent Application No. 15761163.3.
Chinese Office Action dated Apr. 29, 2020, in corresponding Chinese Patent Application No. 201811582231.2.

* cited by examiner

REFRIGERATOR

CROSS-REFERENCE TO RELATED APPLICATION

This application is a continuation of U.S. Ser. No. 15/852,524, filed Dec. 22, 2017, which is a continuation of U.S. Ser. No. 15/348,378, filed Nov. 10, 2016, which is a continuation of U.S. Ser. No. 14/643,612, filed Mar. 10, 2015, and claims the benefit of Korean Patent Applications No. 10-2014-0028617, filed on Mar. 11, 2014, and No. 10-2014-0096638, filed on Jul. 29, 2014, in the Korean Intellectual Property Office, the disclosures of which are incorporated herein by reference.

BACKGROUND

1. Field

Embodiments of the present invention relate to a refrigerator having a double door.

2. Description of the Related Art

In general, a refrigerator is an apparatus that keeps food fresh by including a main body including an inner case and an outer case, a storage compartment formed by the inner case, and a cold air supplying unit for supplying cold air to the storage compartment.

The temperature of the storage compartment is maintained to be in a predetermined range required to keep food fresh.

A front side of the storage compartment of the refrigerator is disposed to be opened, and the opened front side is closed by a door so that the temperature of the storage compartment can be maintained at normal times.

The storage compartment is partitioned off by a barrier wall into upper and lower portions. The refrigerator door that opens/closes a refrigerator compartment disposed on the upper portion of the storage compartment is configured of a side by side type door that is rotatably coupled to the main body, and the refrigerator door that opens/closes a freezer compartment disposed on the lower portion of the storage compartment is a drawer type door that slides in a forward/backward direction.

For convenience's sake of a consumer, one of refrigerator compartment doors composed of a pair of doors has a structure of a double door.

The double door includes a first door rotatably coupled to the main body and a second door rotatably coupled to the first door. The first door and the second door are respectively provided with handles to open and close the first door and the second door.

Since the first door and the second door have the respective handles, a user, if desired to open/close the first door, needs to grip the handle provided on the first door and open/close the first door, and if desired to open/close the second door, needs to grip the handle provided on the second door and open/close the second door, which causes inconvenience of use.

SUMMARY

Therefore, it is an aspect of the present invention to provide a refrigerator capable of opening/closing only a second door or opening/closing both of a first door and a second door using one handle, by allowing the second door to be fixed or released to/from the first door using a latch device.

In accordance with one aspect of the present disclosure, a refrigerator includes a main body, a first door, a second door, a handle and a latch device. The main body may have a storage compartment. The first door may be rotatably disposed in front of the main body and have an opening formed therein. The second door may be rotatably disposed in front of the first door to open/close the opening. The handle may be coupled to a front side of the second door to open/close the first door and the second door. The latch device may allow the second door to be fixed and released to/from the first door. The latch device may include a fixing unit, a support and a handle lever. The fixing unit may be provided on a front side of the first door. The support may be coupled to a rear side of the handle while accommodated in the rear side of the handle. The handle lever may be rotatably coupled to the support by a rotation shaft, and include a first handle lever rotating about the rotation shaft forward and backward and a second handle lever rotating upward and downward in linkage with forward and backward rotation of the first handle lever so as to be hung with and released from the fixing unit. The fixing unit may include a hanging portion in which the second handle lever is hung and hanging of which is released, a flow prevention portion configured to fix the hanging portion to prevent the hanging portion from being moved at an inside of the first door, and a cover coupled to a rear side of the flow prevention portion to prevent heat insulating material filled at an inside of the first door from penetrating into a space formed between the cover and the flow prevention portion.

The hanging portion may include a fixing hole fixed to the flow prevention portion, and a hanging hook provided at a lower portion of the fixing hole and in which the second handle lever is hung and hanging of which is released.

The flow prevention portion may include a front side portion exposed to an outside of a front side of the first door, a fixing protrusion protruding from a rear side of the front side portion and around which the fixing hole is inserted, and an accommodation portion protruding from the rear side of the front side portion to form an accommodation space in the rear side of the front side portion.

The fixing protrusion may be provided at an upper portion of the accommodation portion and the accommodation portion may be provided at a front side and an upper side thereof open, so that when the hanging portion is fixed to the flow prevention portion as the fixing hole is inserted around the fixing protrusion, the hanging hook is accommodated in the accommodation portion through the open upper side of the accommodation portion, and the hanging hook accommodated in the accommodation portion is exposed to the outside through the open front side of the accommodation portion.

The handle may be provided at a rear side thereof with a support accommodation portion in which the support is accommodated. The support may include: a housing coupled to the support accommodation portion while accommodated in the support accommodation portion, and having a rear side thereof open; and a rear cover coupled to the open rear side of the housing.

The support accommodation portion may be provided with a first coupling hole to which the housing is coupled, and the housing may be provided with a second coupling hole at a position corresponding to the first coupling hole, so that the housing is coupled to the support accommodation portion by a fastening member.

The housing may include: a rotation hole to which the rotation shaft is rotatably coupled; a first support portion that supports one side of a spring elastically supporting the first handle lever; and a third coupling hole to which the rear cover is coupled.

The first handle lever may be provided in a shape extending downward of the rotation shaft and configured to rotate about the rotation shaft forward and backward, and the second handle lever may be provided in a shape extending backward of the rotation shaft and configured to rotate about the rotation shaft upward and downward.

The rear cover may include an opening opened so that a rear side of the first handle lever is exposed to the outside, a guide portion that guides the second handle lever not to be exposed to the outside, and a fourth coupling hole disposed in a position corresponding to the third coupling hole.

A second support portion elastically supported by the spring and supporting the other side of the spring supported against the housing may be provided at a lower portion of the first handle lever.

The second handle lever may be provided with a hanging protrusion that is hung with and released from the hanging hook when the second handle lever rotates about the rotation shaft upward and downward, and the hanging protrusion may be accommodated through the open front side of the accommodation portion and moved upward and downward at an inside of the accommodation portion.

The second door may be provided with a guide configured to guide the second handle lever to be hung with and released from the hanging portion by passing through the second door, the guide communicating with the guide portion of the rear cover.

The first handle lever may be rotated about the rotation shaft forward when a lower portion of the first handle lever is pressurized, so that the second handle lever is rotated about the rotation shaft downward, and the downward rotation of the second handle lever causes the hanging protrusion hung with the hanging hook to be released, thereby releasing the second door from being fixed to the first door.

When a force pressurizing the lower portion of the first handle lever disappears, the first handle lever may be rotated backward about the rotation shaft by an elastic force of the spring, so that the second handle lever is rotated about the rotation shaft upward, and the upward rotation of the second handle lever causes the hanging protrusion to be hung with the hanging hook, thereby fixing the second door to be fixed to the first door.

In accordance with another aspect of the present disclosure, a refrigerator includes a main body, a first door, a second door, a handle and a latch device. The main body may have a storage compartment. The first door may be rotatably disposed in front of the main body and has an opening formed therein. The second door may be rotatably disposed in front of the first door to open/close the opening. The handle may be coupled to a front side of the second door to open/close the first door and the second door. The latch device may include a fixing unit provided on a front side of the first door, and a handle lever coupled to the handle and configured to be hung with and released from the fixing unit by passing through the second door.

In accordance with another aspect of the present disclosure, a refrigerator includes a main body, a first door, a second door, a handle and a latch device. The main body may have a storage compartment. The first door may be rotatably disposed in front of the main body and has an opening formed therein. The second door may be rotatably disposed in front of the first door to open/close the opening. The handle may be coupled to a front side of the second door to open/close the first door and the second door. The latch device may allow the second door to be fixed to the first door and released from being fixed to the first door. The latch device may include a fixing unit, a connection member, a handle lever and a rotation unit. The fixing unit may be provided on a front side of the first door. The connection member may be provided to be movable forward and backward at an inside of the handle. The handle lever may be disposed on a rear side of the handle and allow the connection member to move forward. The rotation unit may be hung with and released from the fixing unit by being rotated leftward and rightward by the connection member.

The latch device may include a support accommodated in the handle and to which the connection member and the rotation unit are coupled, and a guide provided at an inside of the second door and guiding the rotation unit to pass through the second door and then to be hung with and released from the fixing unit.

The support may include a connection member coupling portion to which the connection member is coupled so as to be movable forward and backward, and a rotation unit coupling portion to which the rotation unit is rotatably coupled.

The connection member may include a coupling protrusion coupled to the connection member coupling portion, and a rotation unit coupling hole to which the rotation unit is coupled.

The handle lever may be provided with a fixing protrusion fixed to a fixing hole provided on the coupling protrusion and configured to push the connection member, and a spring may be provided on outer circumferential surfaces of the coupling protrusion and the fixing protrusion while disposed between the handle lever and the connection member coupling portion.

The rotation unit may include a shaft rotatably coupled to the rotation unit coupling portion, an extension portion bent at a lower portion of the shaft and coupled to the rotation unit coupling hole by vertically downwardly extending, and a locking portion extending from an upper portion of the shaft in perpendicular to an extension direction of the shaft and configured to be rotated about the shaft leftward and rightward according to a rotation direction of the shaft so as to be hung with and released from the fixing unit.

A lower portion of the handle lever may be pressurized such that the fixing protrusion pushes the connection member to be moved forward, and thus the rotation unit may be rotated about the shaft counterclockwise, and the counterclockwise rotation of the rotation unit may cause the hanging of the locking portion to be released from the fixing unit, thereby releasing the second door from being fixed to the first door.

When a force pressuring the lower portion of the handle lever disappears, the handle lever may be rotated backward by an elastic force of the spring, so that the connection member is moved backward, and the backward movement of the connection member may cause the rotation unit to be rotated about the shaft clockwise, so that the locking portion is hung with the fixing unit, thereby fixing the second door to the first door.

In accordance with another aspect of the present disclosure, a refrigerator includes a main body, a first door, a second door, a handle and a latch device. The main body may have a storage compartment. The first door may be rotatably disposed in front of the main body and has an opening formed therein. The second door may be rotatably disposed in front of the first door to open/close the opening. The handle may be coupled to a front side of the second door to open/close the first door and the second door. The latch device mat allow the second door to be fixed to the first door and released from being fixed to the first door. The latch device include a fixing unit provided on a front side of the first door, a support provided at an inside of the second door, a rack coupled to the support so as to move forward and backward, and having a front end portion thereof exposed forward of the second door, a pinion gear rotatably coupled to a rotation shaft of the support, and engaged with the rack so as to be rotated when the rack moves forward and backward, and a locking portion engaged with the pinion gear so as to be hung with and released from the fixing unit by being moved upward and downward when the pinion gear is rotated.

The rack may include a coupling hole coupled to a rack coupling portion provided on the support so as to be movable forward and backward, a first rack gear engaged with the pinion gear, and a press portion exposed forward of the second door.

The locking portion may include a guide groove allowing the locking portion to move upward and downward along a guide rail provided on the support, a second rack gear engaged with the pinion gear, and a hanging hole hung with and released from the fixing unit.

The fixing unit may be provided with a hanging protrusion and an elastic member. The hanging protrusion may be hung with and released from the hanging hole. The elastic member may be configured to push the locking portion forward when the locking portion is moved upward and released from the hanging protrusion. A spring may be provided on an outer circumferential surface of the rack coupling portion while disposed between the support and the rack.

When the press portion is pressurized, the rack mat move backward while compressing the spring such that the pinion gear is rotated counterclockwise, and the counterclockwise rotation of the pinion gear causes the locking portion to be moved upward, to be released from the hanging protrusion, and then to be moved forward by the elastic member, thereby opening the second door.

In accordance with another aspect of the present disclosure, a refrigerator includes a main body, a first door, a second door, a first gasket, a second gasket, a handle and a latch device. The main body may have a storage compartment, and formed of metal. The first door may be rotatably disposed in front of the main body and have an opening formed therein, and the first door may have a front side thereof formed of metal. The second door may be rotatably disposed in front of the first door to open/close the opening. The first gasket may be provided on the first door and accommodate a first magnet having a magnetic force, thereby allowing the first door to come into close contact with the main body. The second gasket may be provided on the second door and accommodate a second magnet having a magnetic force greater than the magnetic force of the first magnet, thereby allowing the second door to come into close contact with the first door. The handle may be coupled to a front side of the second door to open/close the first door and the second door. The latch device may allow close contact of the second door to be released from the first door. When the second door is opened by gripping the handle in a non-operation of the latch device, the first door and the second door may be opened and an access to the storage compartment may be allowed. When the second door is opened by gripping the handle in an operation of the latch device, only the second door may be opened and an access to the opening may be allowed.

The latch device may include a handle lever provided on a rear side of the handle so as to be movable forward and backward, a pinion gear engaged with the handle lever so as to be rotated when the handle lever is moved, and a slider having a rear end portion making contact with a front side of the first door by passing through the second door, the slider engaged with the pinion gear so as to release close contact of the second door from the first door by moving in a direction opposite to a direction of the handle lever during rotation of the pinion gear.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
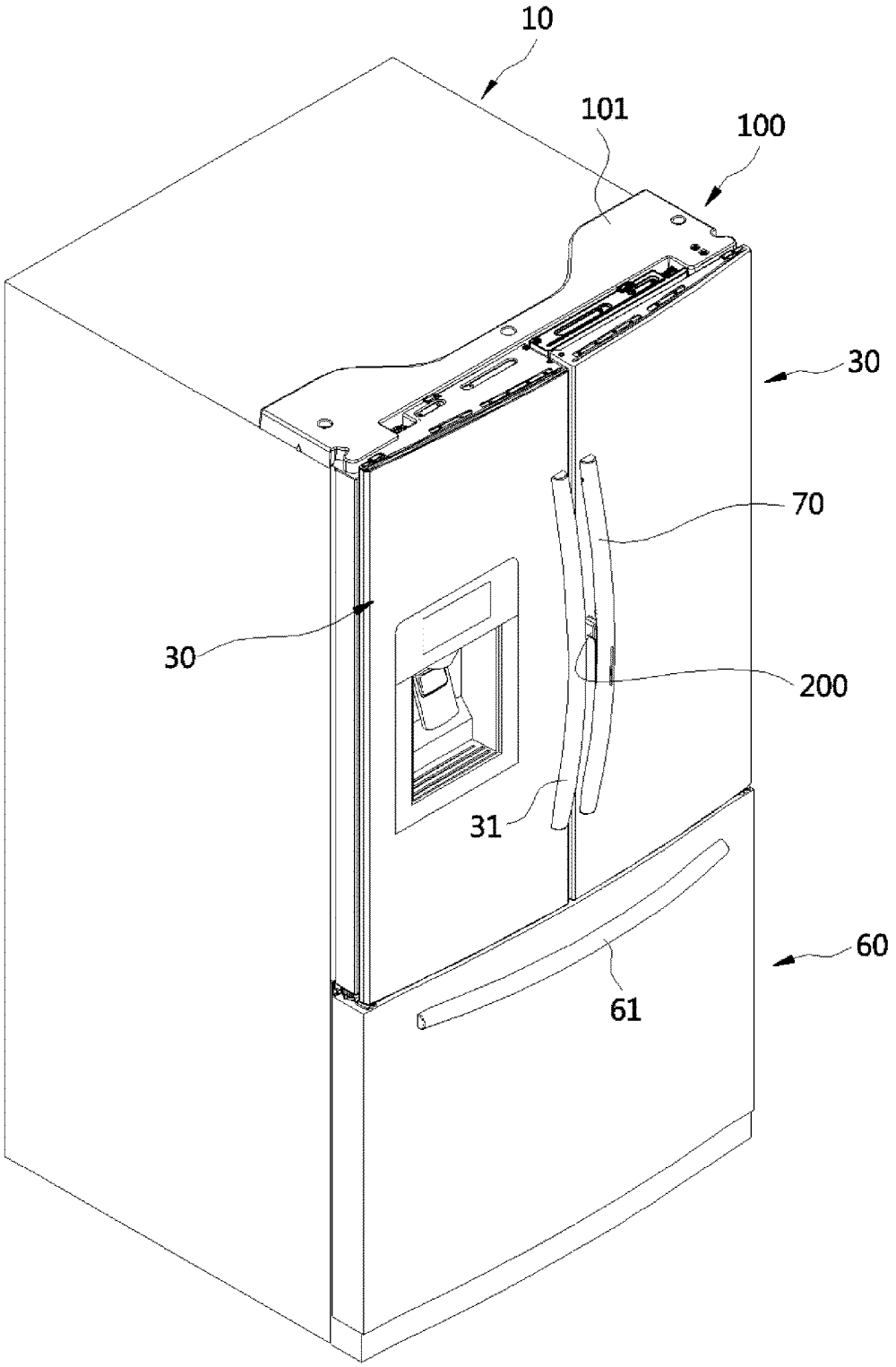
FIG. 1 is a perspective view of a refrigerator in accordance with an embodiment of the present invention.

Reference will now be made in detail to the embodiments of the present invention, examples of which are illustrated in the accompanying drawings, wherein like reference numerals refer to like elements throughout.

With respect to a front side and a rear side that will be described below, a front side of a main body 10 of a refrigerator is referred to as the front side, and a rear side of the main body 10 of the refrigerator is referred to as the rear side.

Figure 2:
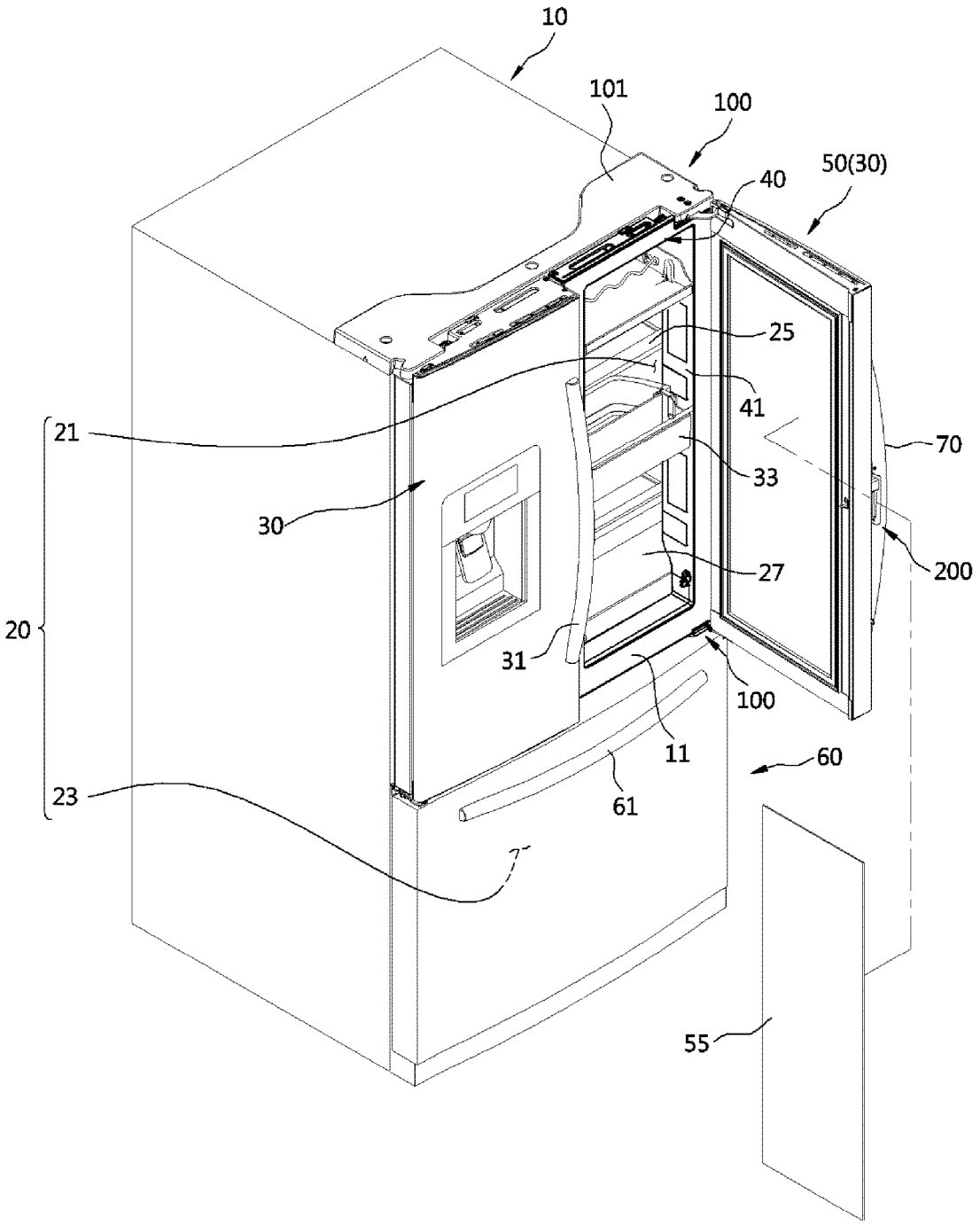
FIG. 2 is a perspective view of a state in which only a second door of FIG. 1 is opened.
Figure 3:
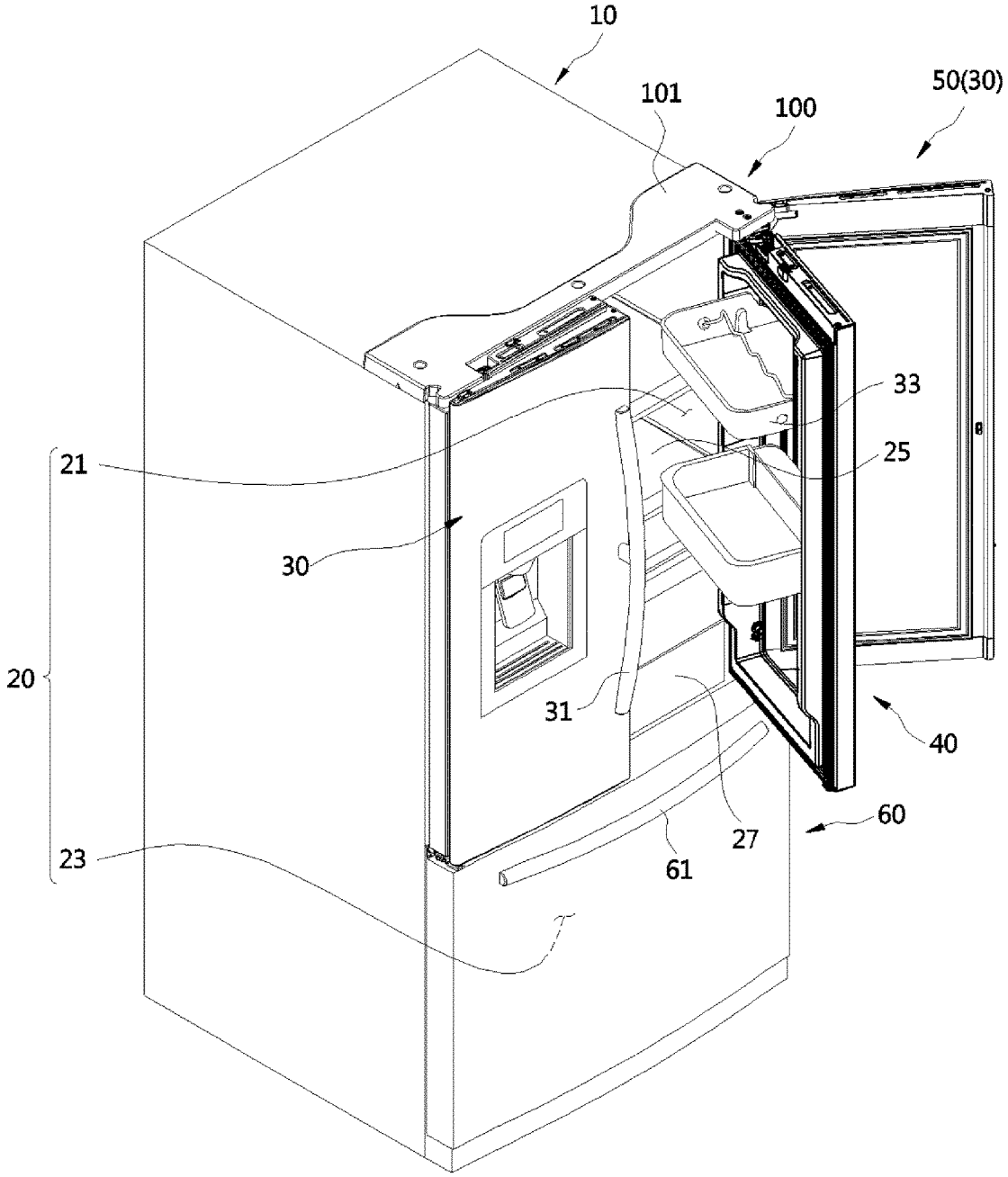
FIG. 3 is a perspective view of a state in which a first door and the second door of FIG. 1 are opened.

As illustrated in FIGS. 1 through 3, the refrigerator includes the main body 10 that constitutes an exterior of the refrigerator, a storage compartment 20 disposed in the main body 10 in such a way that a front side of the storage compartment 20 is opened, and doors 30 and 60 that open/close the storage compartment 20.

The main body 10 includes an inner case (not shown) that constitutes the storage compartment 20, an outer case (not shown) that constitutes an exterior of the main body 10, and a cold air supplying unit (not shown) that supplies cold air to the storage compartment 20.

The cold air supplying unit may include a compressor, a condenser, an expansion valve, an evaporator, a blower fan, and a cold air duct. An insulating material (not shown) is foamed between the inner case and the outer case of the main body 10 so as to prevent cold air of the storage compartment 20 from being discharged to the outside.

A machine compartment (not shown) in which the compressor that compresses a refrigerant and the condenser that condenses the compressed refrigerant are installed, is provided in a lower side of the rear of the main body 10.

The storage compartment 20 is partitioned off by a barrier wall 11 into upper and lower portions. A refrigerator compartment 21 is disposed in an upper portion of the main body 10, and a freezer compartment 23 is disposed in a lower portion of the main body 10.

A plurality of shelves 25 may be disposed in the refrigerator compartment 21 and may partition off the refrigerator compartment 21 into a plurality of portions. A plurality of storage containers 27 in which food is stored, may be disposed.

The refrigerator compartment 21 is opened/closed by a pair of refrigerator compartment doors 30 rotatably coupled to the main body 10. The freezer compartment 23 is opened/closed by a freezer compartment door 60 that slides in a forward/backward direction.

Handles 31 and 61 are disposed on the refrigerator compartment door 30 and the freezer compartment door 60 so that a user may open/close the refrigerator compartment door 30 and the freezer compartment door 60 by grasping the handles 31 and 61.

The refrigerator compartment door 30 disposed on the right of the drawing of the pair of refrigerator compartment doors 30 may have a structure of a double door.

The right refrigerator compartment door 30 having the structure of the double door includes a first door 40 that is rotatably disposed in front of the main body 10 and opens/closes the refrigerator compartment 21, and a second door 50 that is rotatably disposed in front of the first door 40 and rotated in the same direction as the first door 40.

An opening 41 is disposed in the first door 40, and a plurality of door guards 33 are disposed in the opening 41.

The opening 41 disposed in the first door 40 is opened/closed by the second door 50 disposed in front of the first door 40.

A cooling plate 55 may be disposed on a rear side of the second door 50 and may be formed of an aluminum (Al) material.

Since the cooling plate 55 is formed of the Al material, when the second door 50 is closed, the cooling plate 55 may be uniformly cooled by thermal conduction caused by cold air inside the refrigerator compartment 21 so that the temperature of the entire refrigerator compartment 21 may be uniform.

The material used to form the cooling plate 55 is not limited to the Al material but may be formed of a different metal material having good thermal conduction efficiency.

Since one side of the refrigerator compartment door 30 has the structure of the double door, when the plurality of door guards 33 disposed in the opening 41 of the first door 40 are used, only the second door 50 is opened without the need of opening the whole of the refrigerator compartment door 30 so that cold air discharge caused by opening/closing of the refrigerator compartment door 30 may be minimized and the energy reduction effect may be achieved.

A handle 70 to which a latch device 200 that causes the first door 40 and the second door 50 to be selectively opened/closed, is coupled, is disposed on the second door 50. This will be described later.

The first door 40 and the second door 50 are rotatably coupled to the main body 10 and the first door 40, respectively, using a hinge unit 100.

As illustrated in FIGS. 4 and 5 and FIGS. 13 and 14, the hinge unit 100 may include a first upper hinge 110 that is coupled to the upper portion of the main body 10 so that the first door 40 may be rotatably coupled to the main body 10, a second upper hinge 120 that is coupled to an upper portion of the first door 40 so that the second door 50 may be rotatably coupled to the first door 40, a first lower hinge 130 that is coupled to the lower portion of the main body 10 corresponding to a lower portion of the first door 40 so that the first door 40 may be rotatably coupled to the main body 10, and a second lower hinge 140 that is coupled to the lower portion of the first door 40 so that the second door 50 may be rotatably coupled to the first door 40.

Figure 4:
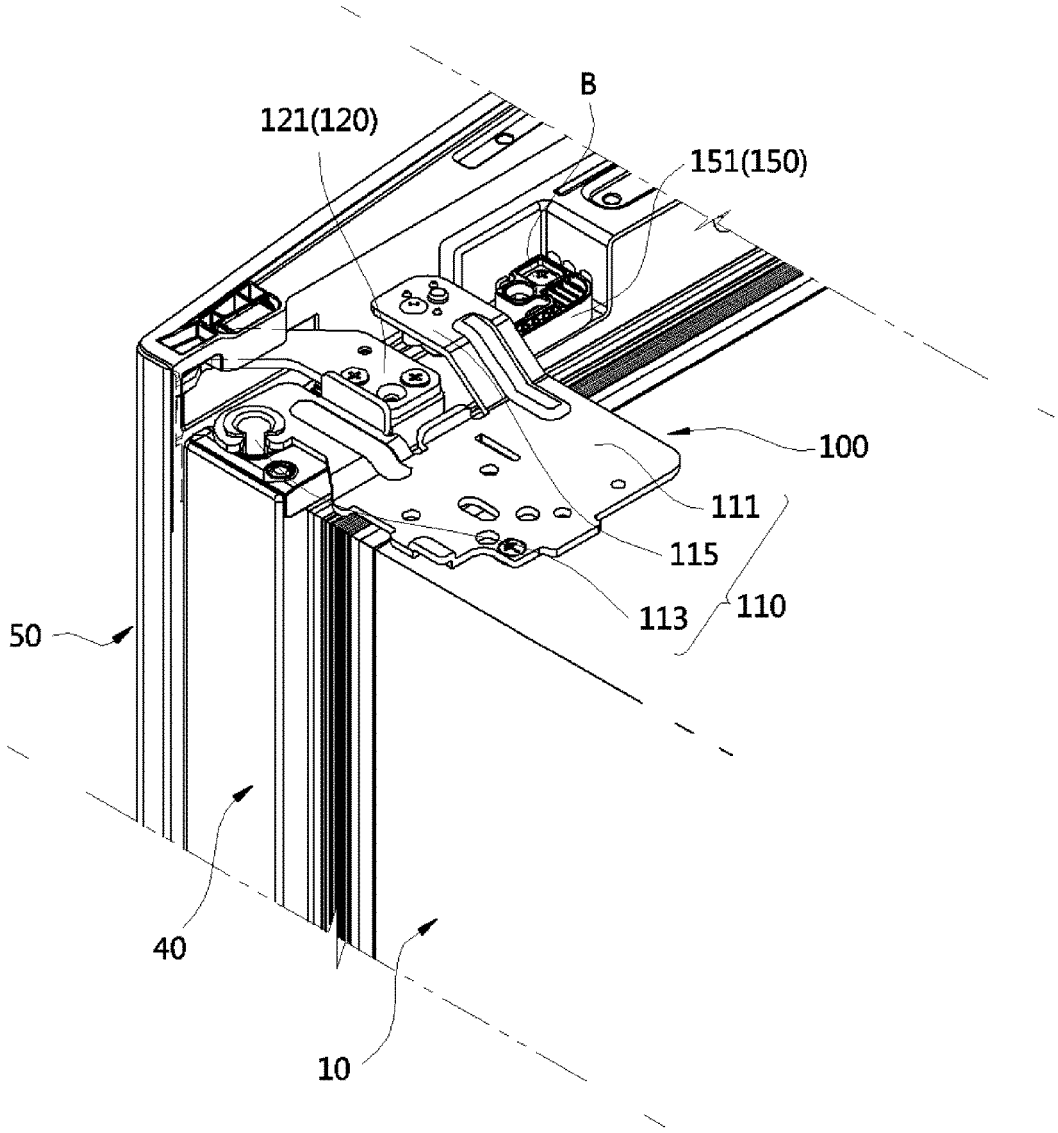
FIG. 4 is a view of a state in which a hinge unit and a first elastic lever are coupled to an upper portion of the refrigerator in accordance with the embodiment of the present invention.
Figure 5:
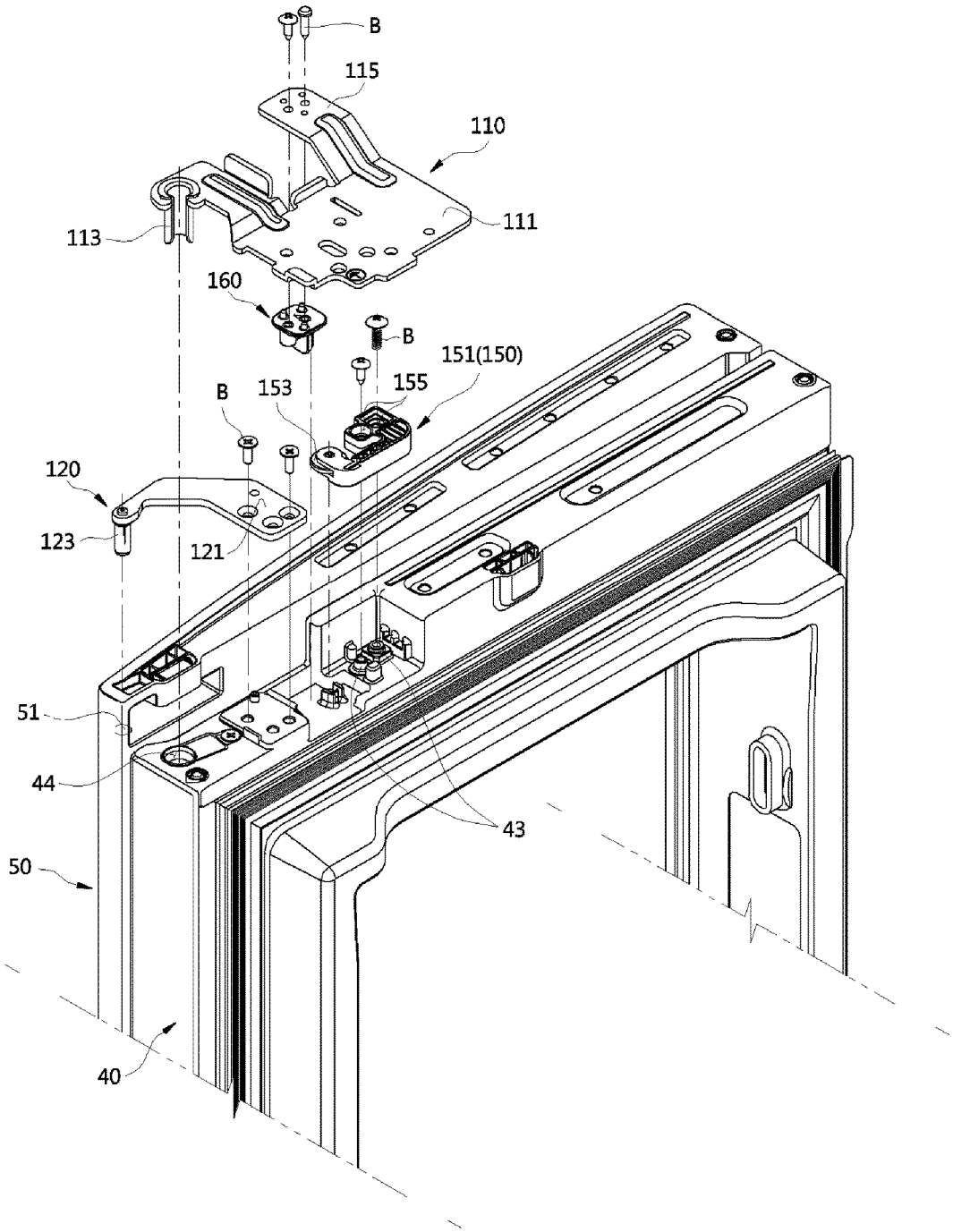
FIG. 5 is a view of a state in which the hinge unit, the first elastic lever, and a cam member of FIG. 4 are disassembled.
Figure 6:
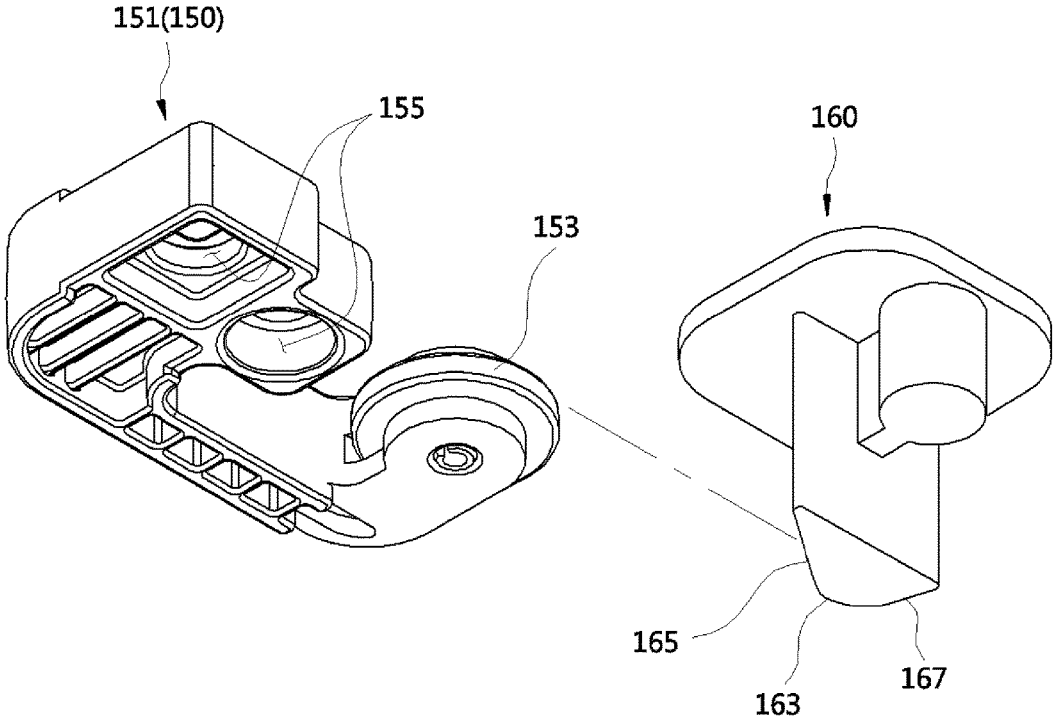
FIG. 6 is a perspective view of the first elastic lever and the cam member in accordance with the embodiment of the present invention.

As illustrated in FIGS. 4 through 6, the first upper hinge 110 includes a first coupling portion 111 coupled to the main body 10, a first hinge shaft 113 that causes the first door 40 to be rotatably coupled to the main body 10, and a cam member coupling portion 115 which extends from the first coupling portion 111 toward the first door 40 and to which a cam member 160 that will be described below is coupled.

The first coupling portion 111 is coupled to the upper portion of the main body 10 by using a fastening member B. The first hinge shaft 113 is disposed in a portion that extends from the first coupling portion 111 toward the first door 40 and is rotatably inserted into a first hinge hole 44 disposed in the upper portion of the first door 40.

Thus, the first door 40 is rotated about the first hinge shaft 113 to open/close the refrigerator compartment 21.

The second upper hinge 120 includes a second coupling portion 121 coupled to the upper portion of the first door 40 and a second hinge shaft 123 that causes the second door 50 to be rotatably coupled to the first door 40.

The second coupling portion 121 is coupled to the upper portion of the first door 40 by using the fastening member B. The second hinge shaft 123 is disposed in a portion that extends from the second coupling portion 121 toward the second door 50 and is rotatably inserted into a second hinge hole 51 disposed in an upper portion of the second door 50.

The second hinge hole 51 disposed in the upper portion of the second door 50 and the second hinge shaft 123 inserted into the second hinge hole 51 are disposed not to be exposed to the outside in view of sides or the upper portion of the main body 10, have esthetic appealing, and may prevent foreign substances, such as dust, from penetrating into the second hinge hole 51 through the sides or the upper portion of the main body 10.

Thus, the second door 50 is rotated about the second hinge shaft 123 so as to open/close the opening 41 disposed in the first door 40.

An elastic lever 150 is disposed in the first door 40 so as to transfer an elastic force in a direction in which the first door 40 is closed, so that the first door 40 may be in close contact with the main body 10 when it is closed.

The elastic lever 150 includes a first elastic lever 151 that is disposed in the upper portion of the first door 40 and transfers an elastic force in the direction in which the first door 40 is closed, so that the first door 40 may be in close contact with the main body 10 when it is closed and thus leakage of cold air may be prevented, and a second elastic lever 157 that is disposed in the lower portion of the first door 40 and transfers the elastic force in the direction in which the first door 40 is closed, so that the first door 40 may be in close contact with the main body 10 when it is closed and thus leakage of cold air may be prevented.

Since the elastic levers 151 and 157 are disposed in the upper and lower portions of the first door 40 and are in close contact with the main body 10 when the first door 40 is closed, leakage of cold air may be prevented in both the upper and lower portions of the first door 40.

The first elastic lever 151 is disposed to be bent in a 'c' shape to have elasticity. A second fastening hole 155 fastened into a first coupling hole 43 disposed in the upper portion of the first door 40 is disposed at one side of the first elastic lever 151 by using the fastening member B. A roller 153 is disposed at the other side of the first elastic lever 151 so as to be in contact with a cam surface 161 of the cam member 160 and to move along a shape of the cam surface 161 when the first door 40 is closed.

The roller 153 is maintained to be not in contact with the cam surface 161 of the cam member 160 in a state in which the first door 40 is fully opened, and when the roller 153 is in contact with the cam surface 161 while the first door 40 is closed, the first elastic lever 151 is compressed and accumulates an elastic force.

When the first door 40 is closed in a state in which the roller 153 is in contact with the cam surface 161, the roller 153 moves along the shape of the cam surface 161 and transfers the accumulated elastic force in a direction in which the first door 40 is closed, so that the first door 40 may be in close contact with the main body 10.

A description of the second elastic lever 157 will be provided below.

The cam member 160 is coupled to the cam member coupling portion 115 that extends from the first coupling portion 111 of the first upper hinge 110 toward the first door 40. When the first door 40 is closed, the cam member 160 is in contact with the first elastic lever 151 and has the cam surface 161 on which the first elastic lever 151 accumulates the elastic force and then transfers the elastic force to the first door 40.

The cam surface 161 includes an inflexion point 163 that is a base point when the first door 40 is opened/closed, and a first contact surface 165 and a second contact surface 167 respectively disposed at lower and upper sides of the inflexion point 163 so as to have opposite inclined surfaces based on the inflexion point 163.

In a state in which the first door 40 is fully opened, the roller 153 of the first elastic lever 151 is not in contact with the cam surface 161 of the cam member 160, and while the first door 40 is closed, the roller 153 is in contact with the first contact surface 165 of the cam surface 161.

The roller 153 that contacts the first contact surface 165 is sequentially in contact with the first contact surface 165, the inflexion point 163, and the second contact surface 167 while the first door 40 is closed, and moves so that the first elastic lever 151 accumulates the elastic force and transfers the elastic force to the first door 40 in the direction in which the first door 40 is closed, so that the first door 40 may be in close contact with the main body 10.

Next, an operation in which the first door 40 is in close contact with the main body 10 by the first elastic lever 151 and the cam member 160 when the first door 40 is closed, will be described with reference to FIGS. 7 through 12.

Figure 7:
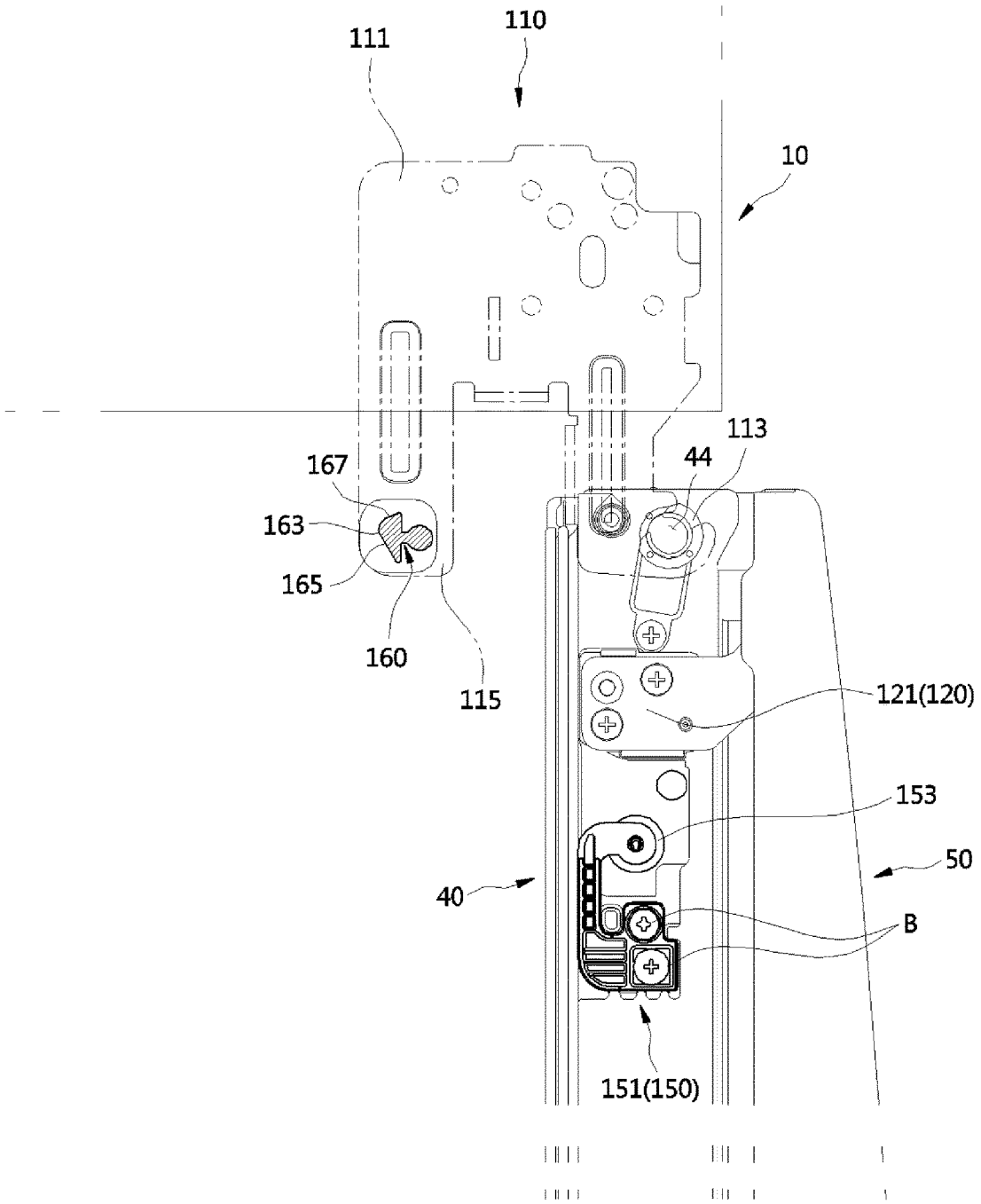
FIG. 7 is a view of a state in which the first door and the second door of the refrigerator in accordance with the embodiment of the present invention are opened together.

As illustrated in FIG. 7, in a state in which the first door 40 is fully opened, the first elastic lever 151 is maintained not to be in contact with the cam surface 161 of the cam member 160.

Figure 8:
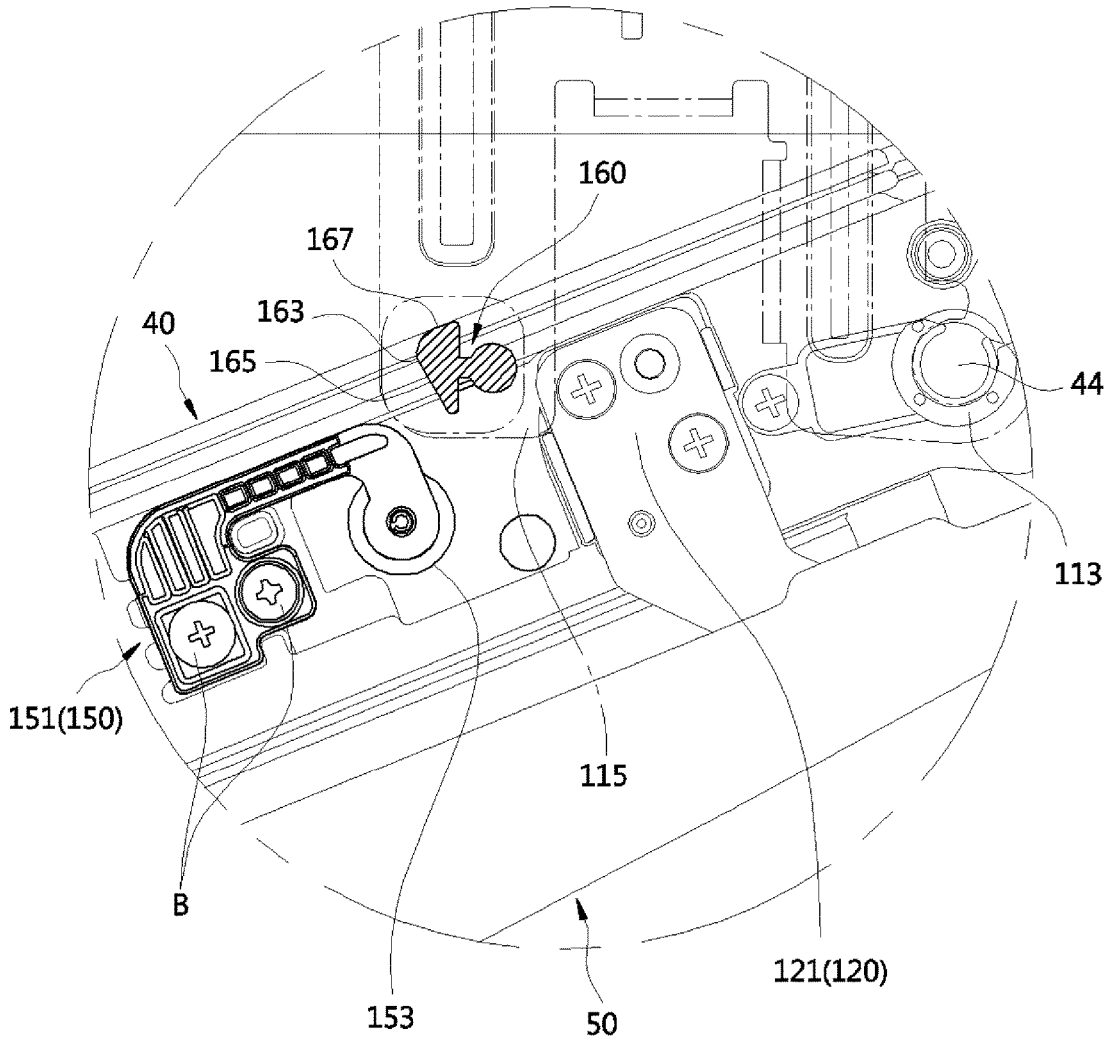
FIGS. 8 through 12 are views of an operation of closing the first door and the second door in the state of FIG. 7.
Figure 9:
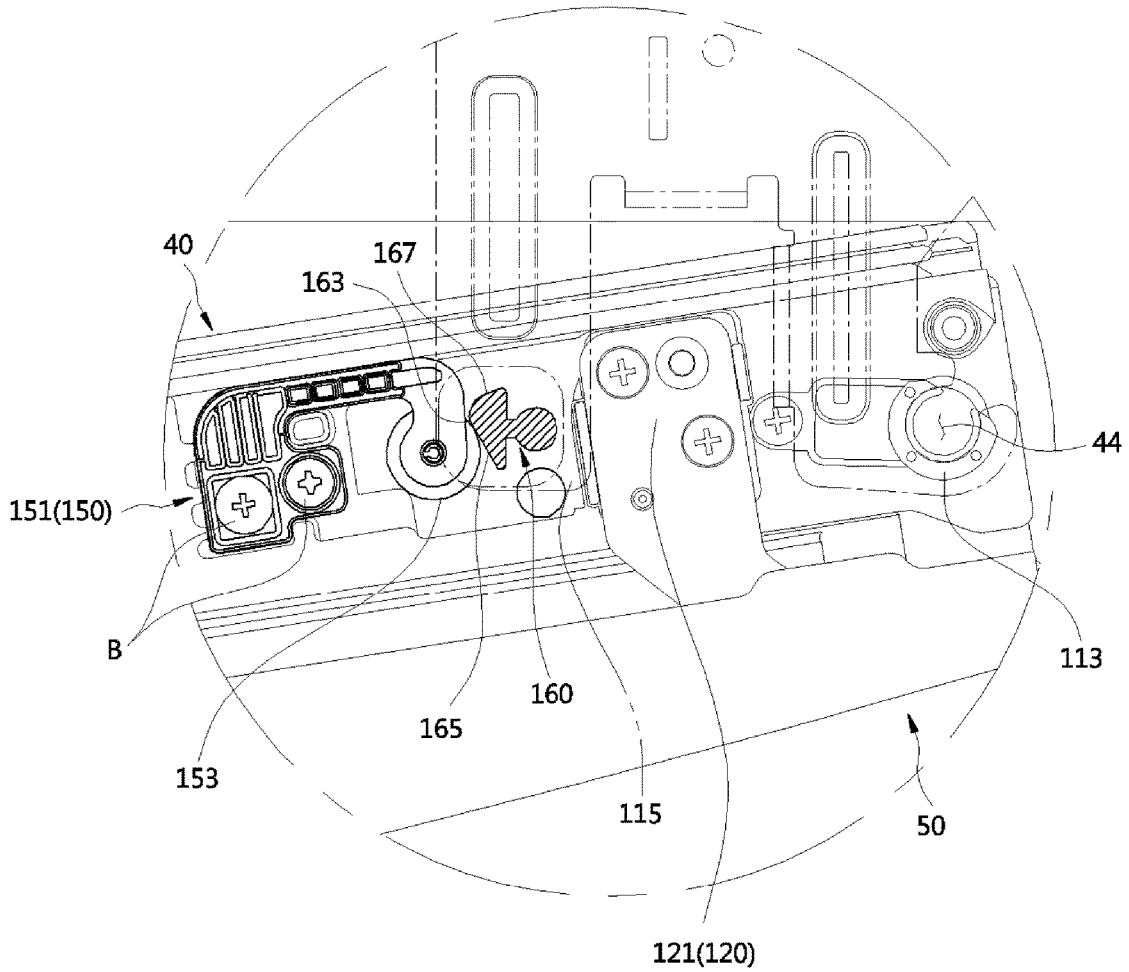

When, in the state in which the first door 40 is fully opened, as illustrated in FIGS. 8 and 9, the first door 40 is somewhat closed, the roller 153 of the first elastic lever 151 is in contact with the cam surface 161 of the cam member 160.

Figure 10:
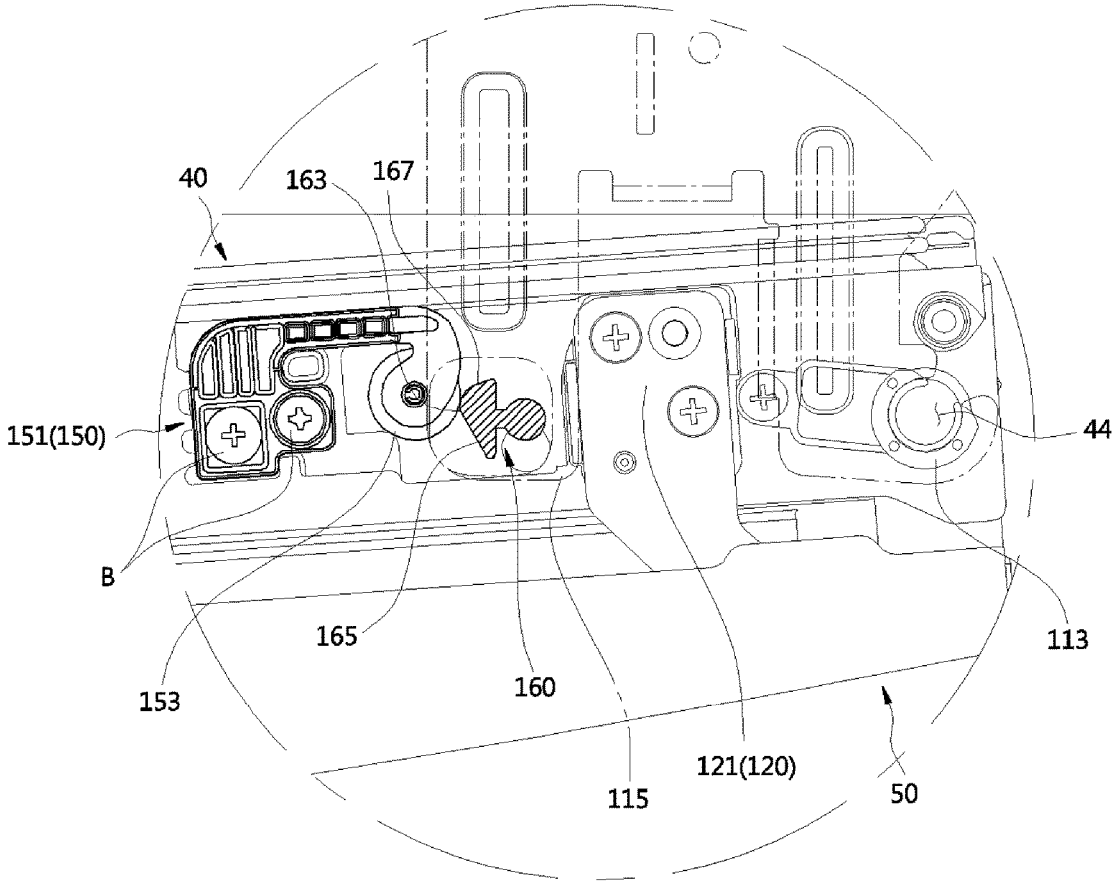

The roller 153 is primarily in contact with the first contact surface 165 of the cam surface 161. When, in a state in which the roller 153 is in contact with the first contact surface 165, the roller 153 is pushed in the direction in which the first door 40 is closed, as illustrated in FIG. 10, as the roller 153 moves toward the lower portion of the first contact surface 165, the first elastic lever 151 is compressed and accumulates the elastic force.

Figure 11:
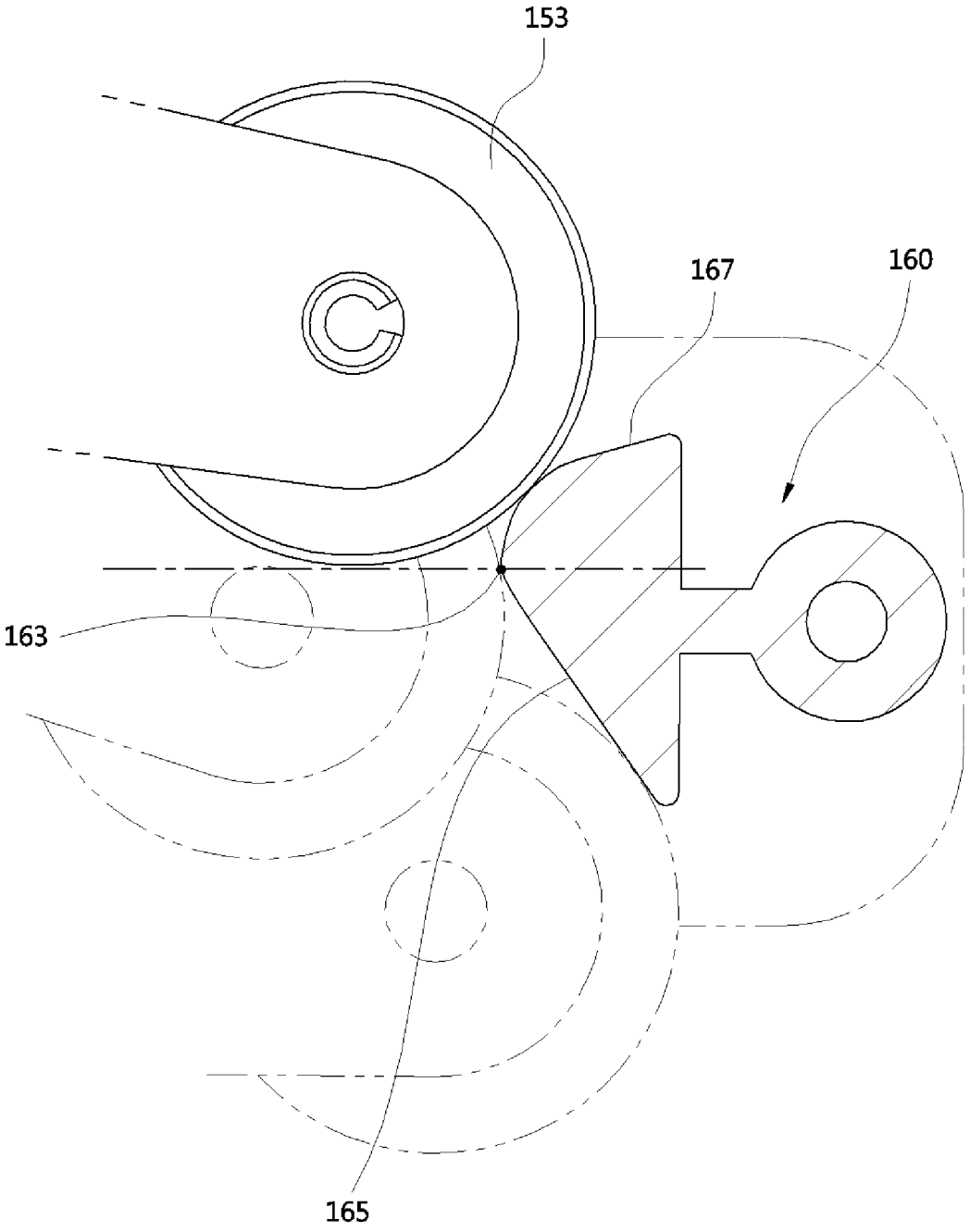

When, in a state in which the first elastic lever 151 accumulates the elastic force, the roller 153 is further pushed in the direction in which the first door 40 is closed, as illustrated in FIG. 11, the roller 153 moves upward along the first contact surface 165 of the cam surface 161, passes through the inflexion point 163, and moves toward the second contact surface 167.

Figure 12:
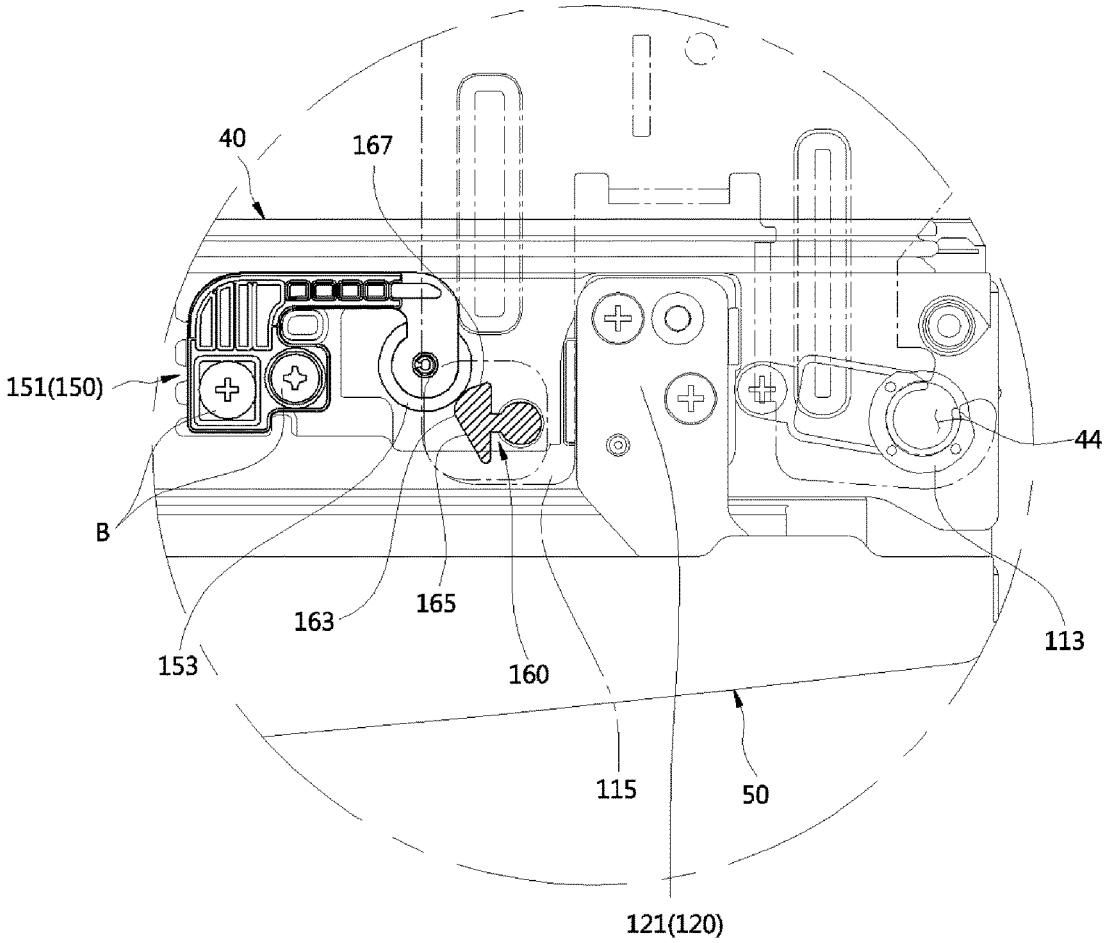

As the roller 153 moves toward the second contact surface 167 of the cam surface 161 and is supported on the second contact surface 167, the first elastic lever 151 transfers the accumulated elastic force to the first door 40, and the first door 40 is fully closed by the transferred elastic force, as illustrated in FIG. 12.

When the first door 40 is closed, the first door 40 receives an elastic force in the direction in which the first door 40 is closed, by the elastic force that remains in the first elastic lever 151 and is maintained to be fully in close contact with the main body 10.

Although not shown, when the first door 40 is opened, the roller 153 is sequentially in contact with the second contact surface 167 of the cam surface 161, the inflexion point 163, and the first contact surface 165 and moves. Before the roller 153 passes through the inflexion point 163, the first door 40 is maintained in a closed state. Thus, even when the other-side refrigerator compartment door 30 is rapidly closed, the first door 40 may be maintained in the closed state.

The above-described operations may be applied to both a case where the first door 40 is closed together with the second door 50 or only the first door 40 is closed.

Figure 13:
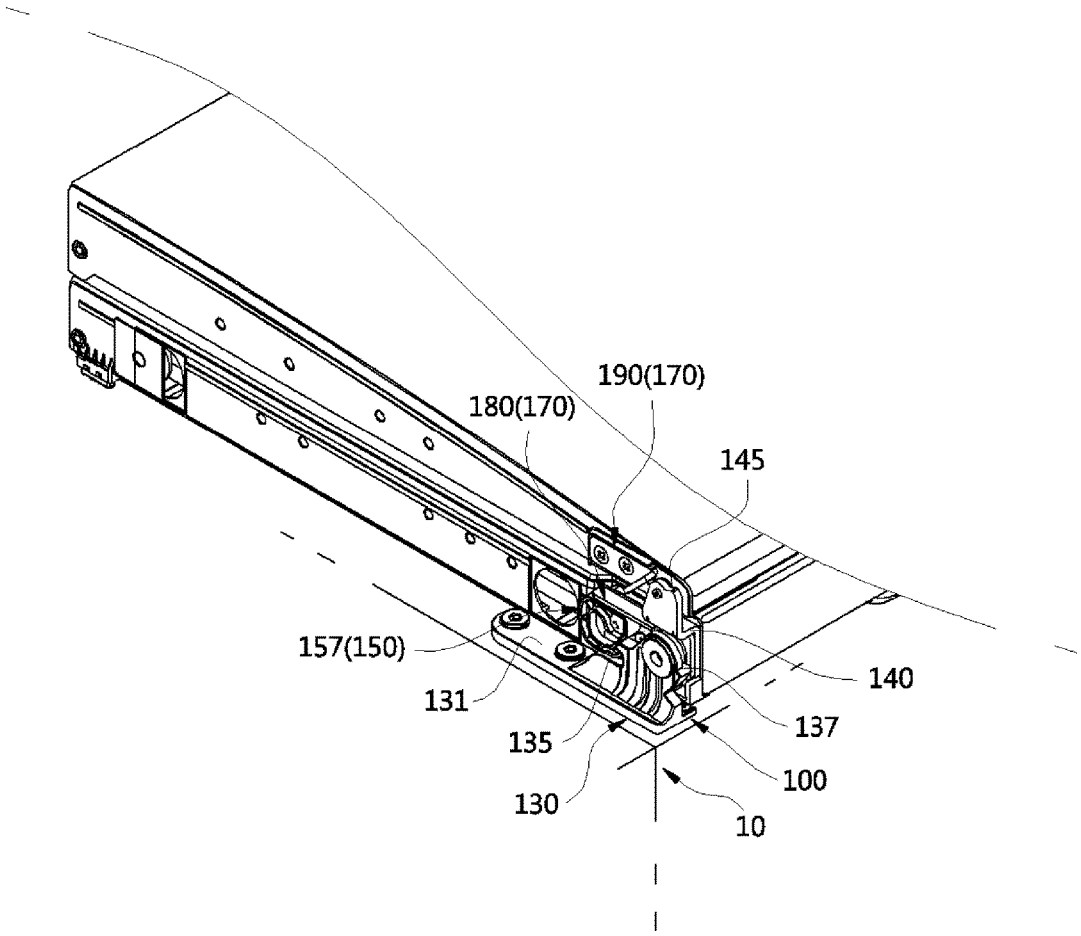
FIG. 13 is a view of a state in which the hinge unit, a second elastic lever, and a stopping member are coupled to a lower portion of the refrigerator in accordance with the embodiment of the present invention.
Figure 14:
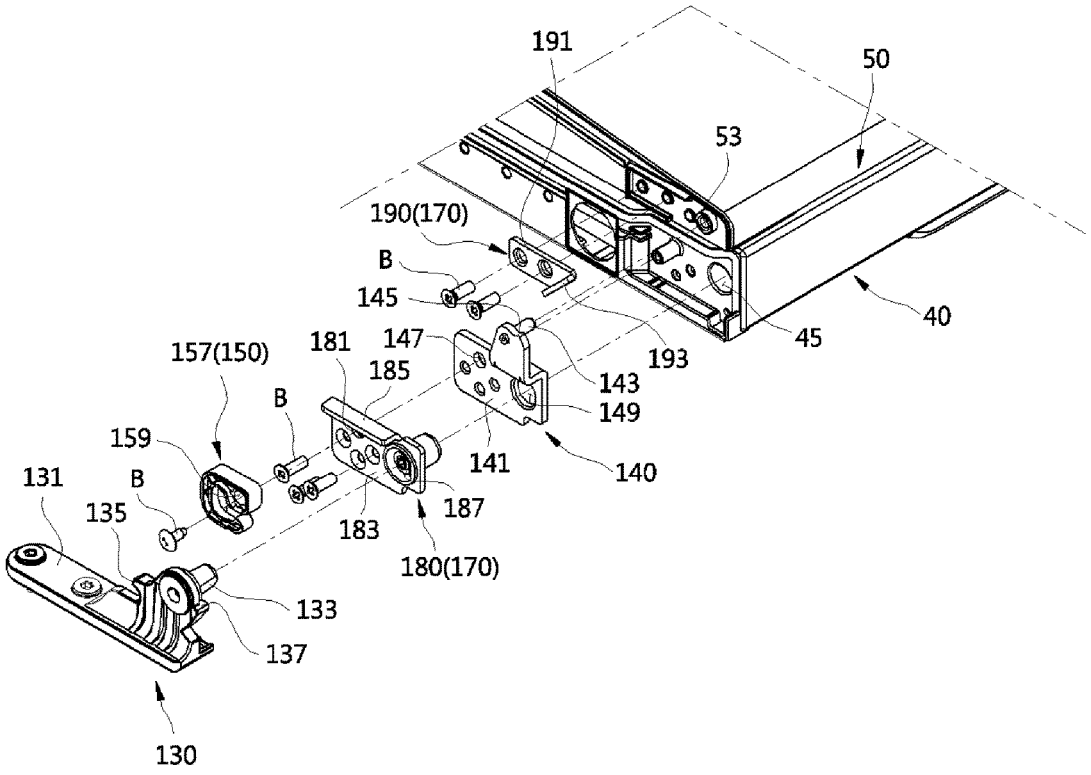
FIG. 14 is a view of a state in which the hinge unit, the second elastic lever, and the stopping member of FIG. 13 are disassembled.

As illustrated in FIGS. 13 and 14, the first lower hinge 130 includes a third coupling portion 131 coupled to the main body 10, a third hinge shaft 133 that causes the first door 40 to be rotatably coupled to the main body 10, an elastic lever contact portion 135 that is in contact with the second elastic lever 157 that will be described later when the first door 40 is closed and by which the second elastic lever 157 accumulates the elastic force and causes the elastic force accumulated on the first door 40 to be transferred, and a first contact portion 137 that is in contact with a first stopping member 180 that will be described later when the first door 40 is opened and that limits an angle at which the first door 40 is opened.

The third coupling portion 131 is coupled to the main body 10 by the fastening member B, and the third hinge shaft 133 is disposed in a portion that extends from the third coupling portion 131 to the first door 40 and is rotatably inserted into a third hinge hole 45 disposed in the lower portion of the first door 40.

Thus, the first door 40 is rotated about the third hinge shaft 133 to open/close the refrigerator compartment 21.

The second elastic lever 157 is disposed to be bent in the '⊏' shape to have elasticity. One side of the second elastic lever 157 is coupled to a hole 47 inside a protrusion 46 disposed in the lower portion of the first door 40 by the fastening member B, and the other side of the second elastic lever 157 is in contact with the elastic lever contact portion 135 of the first lower hinge 130 when the first door 40 is closed.

The other side of the second elastic lever 157 is maintained not to be in contact with the elastic lever contact portion 135 of the first lower hinge 130 in a state in which the first door 40 is fully opened, and while the first door 40 is closed, if the second elastic lever 157 is in contact with the elastic lever contact portion 135, the second elastic lever 157 is compressed and accumulates the elastic force.

When the first door 40 is closed in a state in which the other side of the second elastic lever 157 is in contact with the elastic lever contact portion 135, the other side of the second elastic lever 157 moves along the surface of the elastic lever contact portion 135 and transfers the accumulated elastic force in the direction in which the first door 40 is closed, so that the first door 40 may be in close contact with the main body 10.

Since the elastic levers 151 and 157 are disposed in the upper and lower portions of the first door 40 and are in close contact with the main body 10 when the first door 40 is closed, both the upper and lower portions of the first door 40 may be in close contact with the main body 10 so that leakage of cold air may be effectively prevented.

The second lower hinge 140 includes a fourth coupling portion 141 coupled to the first door 40, a fourth hinge shaft 143 that causes the second door 50 to be rotatably coupled to the first door 40, a second contact portion 145 that is in contact with a second stopping member 190 that will be described later when the second door 50 is opened and that limits an angle at which the second door 50 is opened, a first insertion hole 147 inserted into and fixed to the protrusion 46 that protrudes from the lower portion of the first door 40, and a first penetration hole 149 that is disposed so that the third hinge shaft 133 of the first lower hinge 130 penetrates into the fourth coupling portion 141.

The protrusion 46 that protrudes to fix the second lower hinge 140 is disposed in the lower portion of the first door 40, and the hole 47 is disposed in the protrusion 46 so that the second lower hinge 140 may be fastened into the hole 47 by using the fastening member B. A fourth hinge hole 53 into which the fourth hinge shaft 143 is rotatably inserted, is disposed in the lower portion of the second door 50.

The first insertion hole 147 of the second lower hinge 140 is disposed in the fourth coupling portion 141. When the first insertion hole 147 is inserted and fixed into the protrusion 46 of the first door 40, the second lower hinge 140 is coupled to the lower portion of the first door 40 by using the fastening member B.

A stopping member 170 is disposed in the lower portion of the first door 40 and the lower portion of the second door 50 so as to limit an angle at which the first door 40 is opened, and an angle at which the second door 50 is opened, and to prevent the first door 40 and the second door 50 from being excessively opened.

The stopping member 170 includes the first stopping member 180 that is coupled to the lower portion of the first door 40 and limits the angle at which the first door 40 is opened, and the second stopping member 190 that is coupled to the lower portion of the second door 50 and limits the angle at which the second door 50 is opened.

The first stopping member 180 includes a second insertion hole 181 inserted into and fixed to the protrusion 46 disposed in the lower portion of the first door 40, a first fixed portion 183 fixed to the lower portion of the first door 40 by using the fastening member B, a first stopper 185 that is in contact with the first contact portion 137 of the first lower hinge 130 when the first door 40 is opened and that stops the first door 40 not to be further opened, and a second penetration hole 187 disposed in the first fixed portion 183 so that the third hinge shaft 133 of the first lower hinge 130 penetrates into the second penetration hole 187.

The first penetration hole 149 disposed in the second lower hinge 140 and the second penetration hole 187 disposed in the first stopping member 180 are disposed in a position corresponding to the third hinge hole 45 disposed in the lower portion of the first door 40 so that the third hinge shaft 133 of the first lower hinge 130 may penetrate into the second penetration hole 187 and the first penetration hole 149 and may be rotatably coupled to the third hinge hole 45.

Since the third hinge shaft 133 of the first lower hinge 130 is configured to penetrate into the second lower hinge 140, the first lower hinge 130 and the second lower hinge 140 may be together fastened to the lower portion of the first door 40 having a small width.

Figure 15:
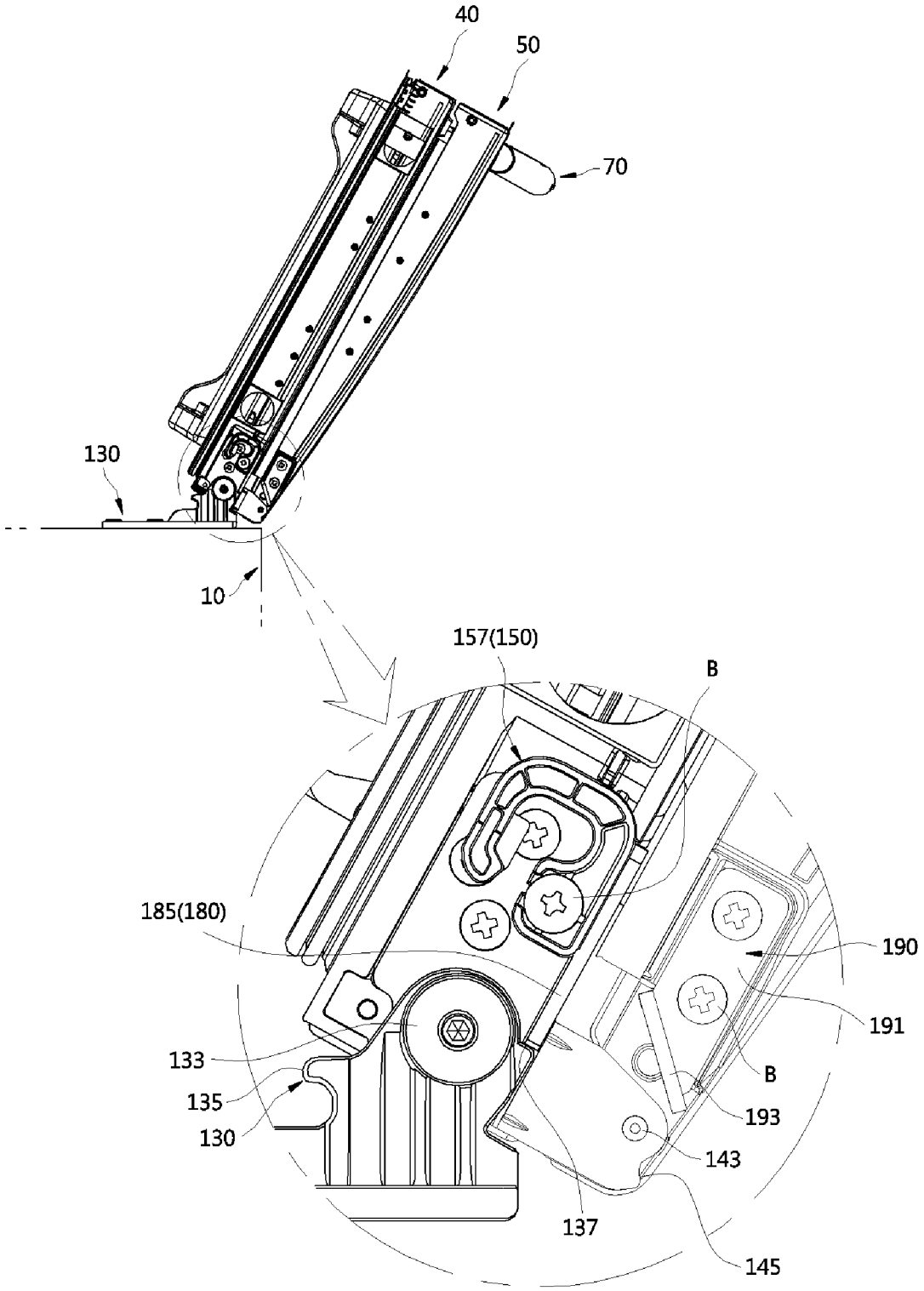
FIG. 15 is a view of a state in which an opened angle of the first door of the refrigerator in accordance with the embodiment of the present invention is limited.

As illustrated in FIG. 15, when the first door 40 is opened, the first stopping member 180 fixed to the lower portion of the first door 40 is rotated together with the first door 40, and when the first stopper 185 is in contact with the first contact portion 137, rotation of the first door 40 is stopped and thus the first door 40 is not opened any more.

The second stopping member 190 includes a second fixed portion 191 fixed to the lower portion of the second door 50 by using the fastening member B, and a second stopper 193 that, when the second door 50 is opened, is in contact with the second contact portion 145 of the second lower hinge 140 and stops the second door 50 not to be opened any more.

Figure 16:
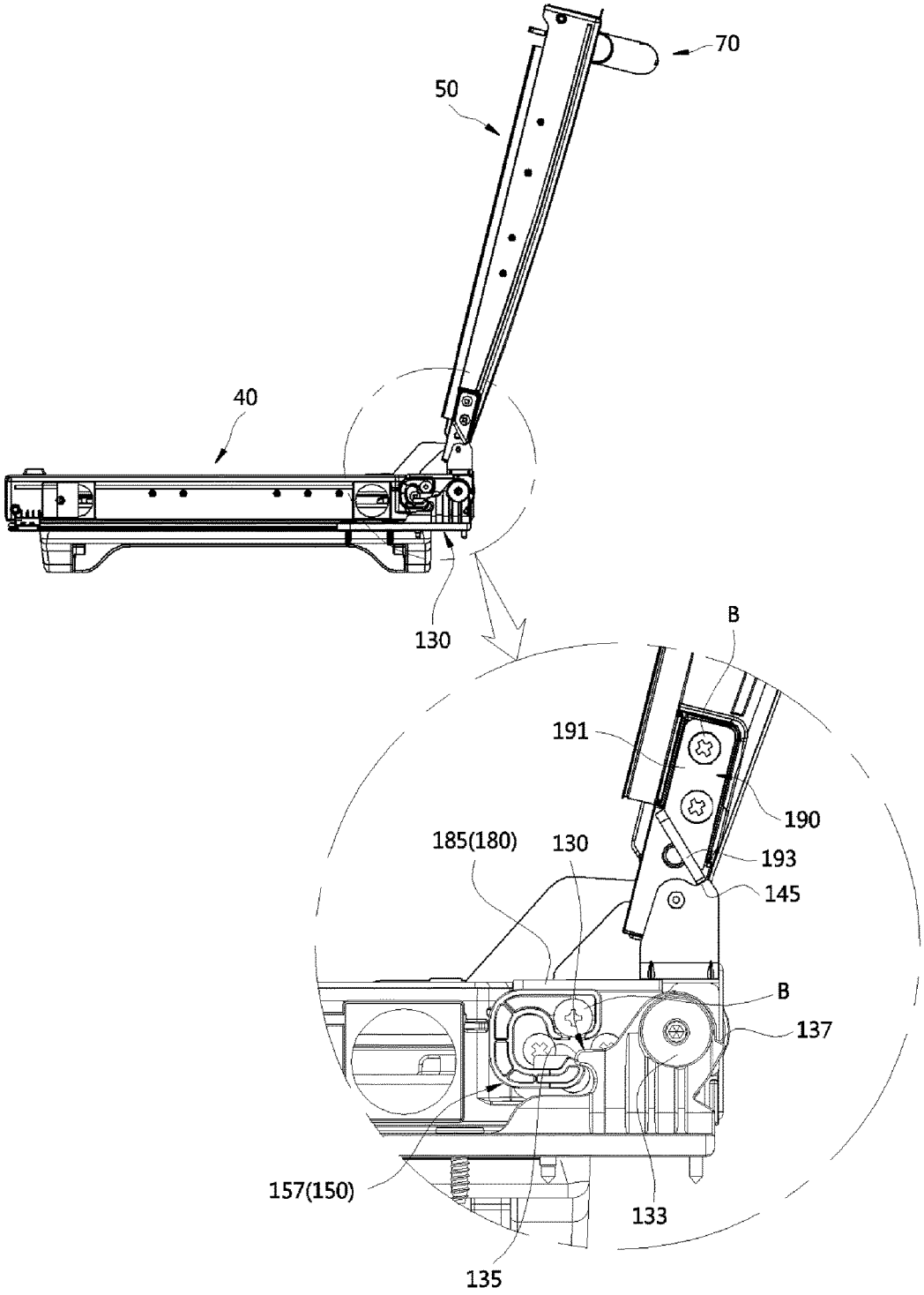
FIG. 16 is a view of a state in which an opened angle of the second door of the refrigerator in accordance with the embodiment of the present invention is limited.

As illustrated in FIG. 16, when the second door 50 is opened, the second stopping member 190 fixed to the lower portion of the second door 50 is rotated together with the second door 50, and when the second stopper 193 is in contact with the second contact portion 145, rotation of the second door 50 is stopped and thus the second door 50 is not opened any more.

As illustrated in FIGS. 13 and 14, a configuration in which the second lower hinge 140, the first stopping member 180, and the second elastic lever 157 are coupled to the lower portion of the first door 40, will be described in detail. First, the first insertion hole 147 of the second lower hinge 140 is inserted into and fixed to the protrusion 46 disposed to protrude from the lower portion of the first door 40.

When the second lower hinge 140 is fixed to the lower portion of the first door 40, the first stopping member 180 is placed in a lower portion of the second lower hinge 140 so that the second insertion hole 181 of the first stopping member 180 may be inserted into and fixed to the protrusion 46.

When the second lower hinge 140 and the first stopping member 180 are fixed to the lower portion of the first door 40, the second lower hinge 140 and the first stopping member 180 are coupled to the lower portion of the first door 40 by using the fastening member B.

When the second lower hinge 140 and the first stopping member 180 are coupled to the lower portion of the first door 40, the second elastic lever 157 is placed in the lower portion of the first stopping member 180 so that a third insertion hole 159 may be inserted into the protrusion 46 and may fix the second elastic lever 157.

When the second elastic lever 157 is fixed, the fastening member B is inserted into the third insertion hole 159 and is fastened into the hole 47 disposed in the protrusion 46 so that the second elastic lever 157 may be coupled to the lower portion of the first door 40.

Next, an operation in which, when the first door 40 is closed, the first door 40 is closed to be in close contact with the main body 10 by the second elastic lever 157 and the elastic lever contact portion 135 of the first lower hinge 130, will be described with reference to FIGS. 17 through 20.

Figure 17:
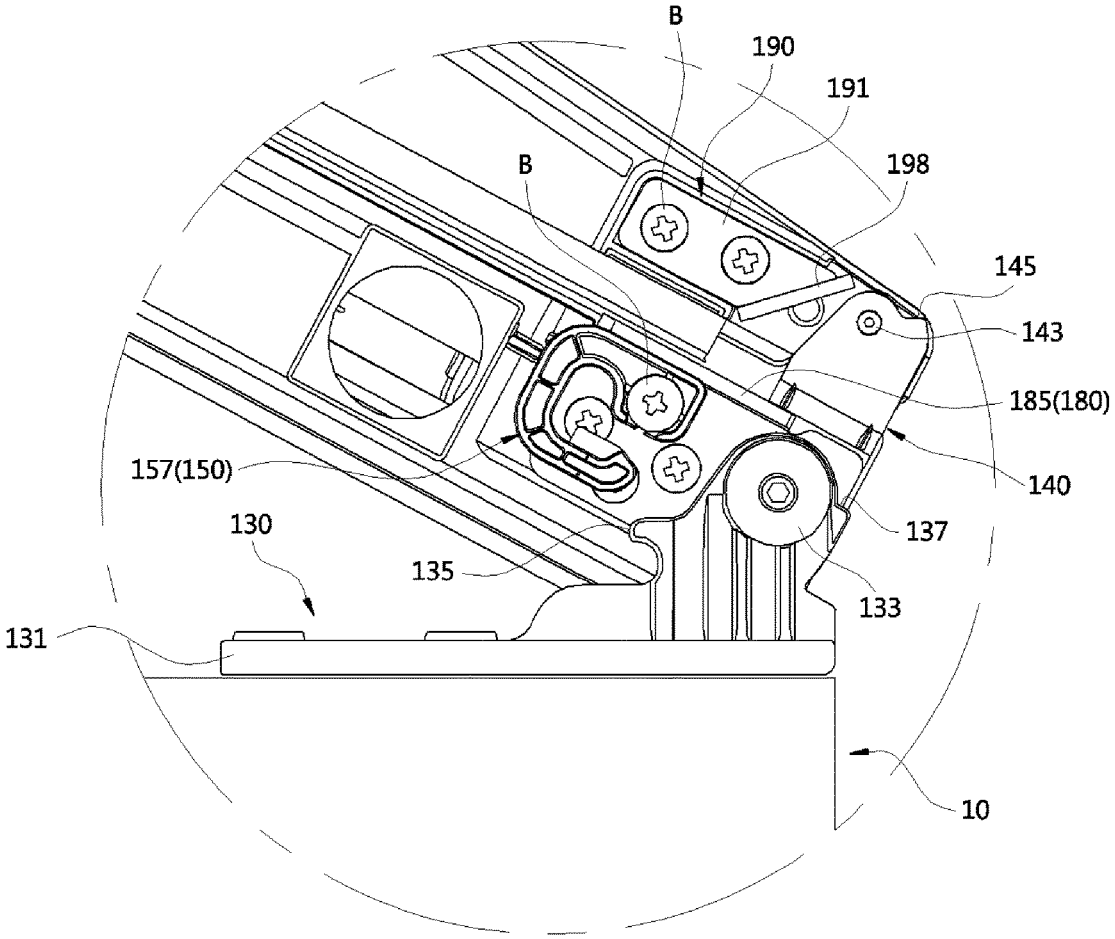
FIGS. 17 through 20 are views of an operation of closing the first door and the second door of the refrigerator in accordance with the embodiment of the present invention.

As illustrated in FIG. 17, in a state in which the first door 40 is opened, the second elastic lever 157 is maintained not to be in contact with the elastic lever contact portion 135 of the first lower hinge 130.

Figure 18:
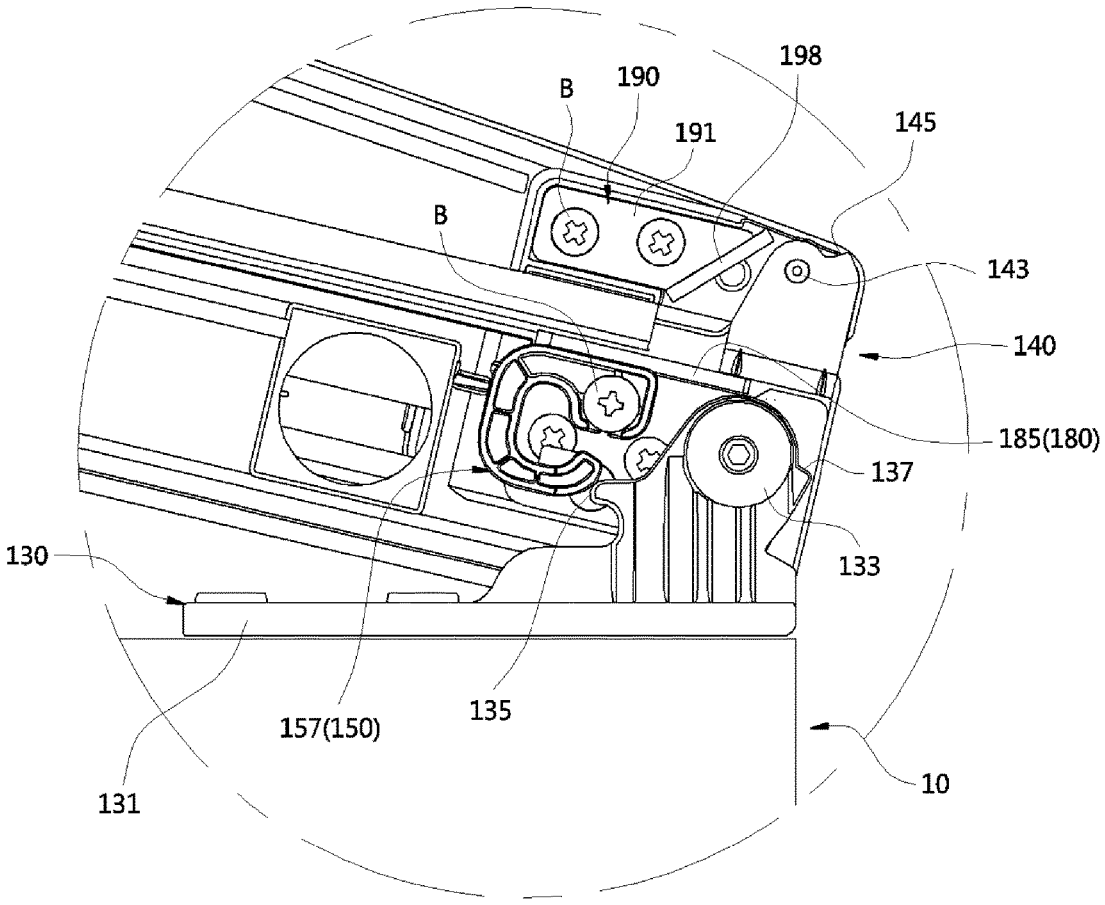

When, in a state in which the first door 40 is opened, as illustrated in FIG. 18, the first door 40 is somewhat closed, the other side of the second elastic lever 157 is in contact with the elastic lever contact portion 135.

Figure 19:
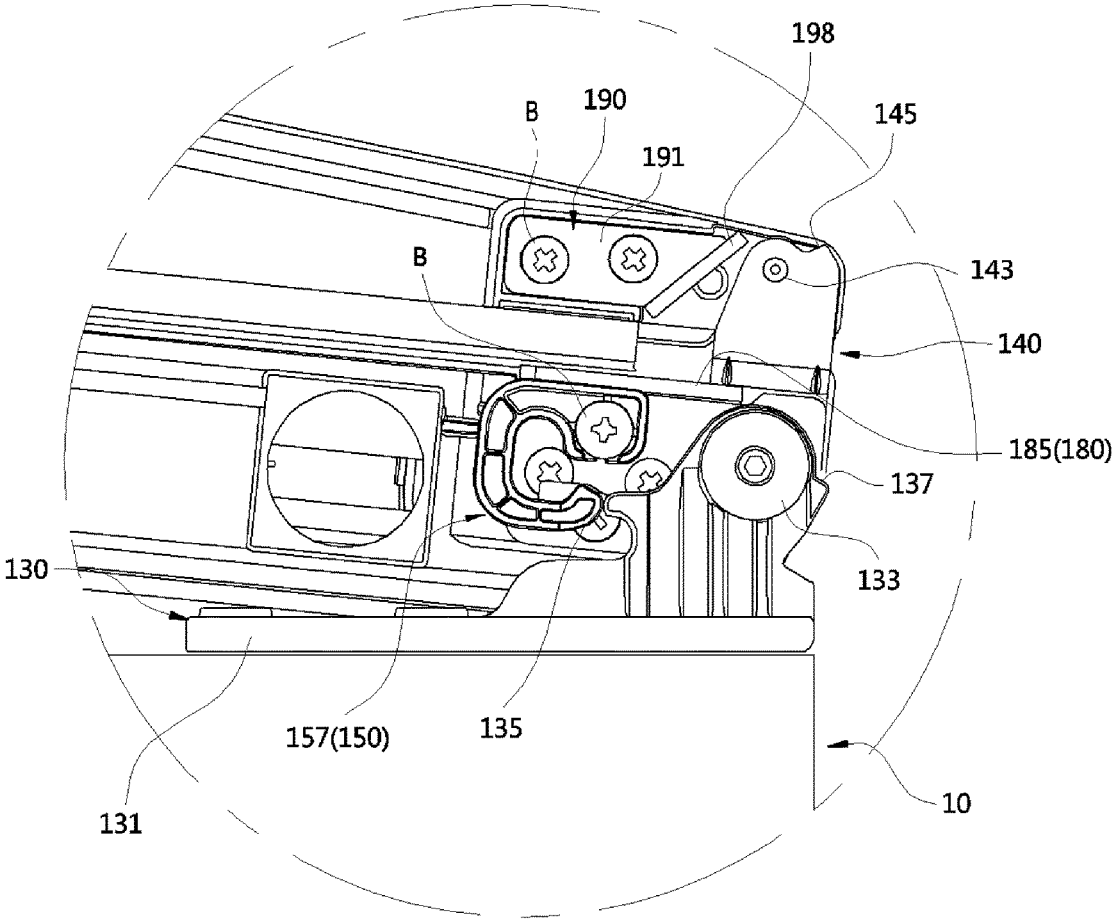

When, in a state in which the other side of the second elastic lever 157 is in contact with the elastic lever contact portion 135, as illustrated in FIG. 19, the second elastic lever 157 is pushed in the direction in which the first door 40 is closed, the other side of the second elastic lever 157 is compressed by the elastic lever contact portion 135, and the second elastic lever 157 accumulates an elastic force.

When, in a state in which the second elastic lever 157 accumulates the elastic force, the second elastic lever 157 is further pushed in the direction in which the first door 40 is closed, as illustrated in FIG. 19, the other side of the second elastic lever 157 moves along the surface of the elastic lever contact portion 135 and passes the elastic lever contact portion 135.

Figure 20:
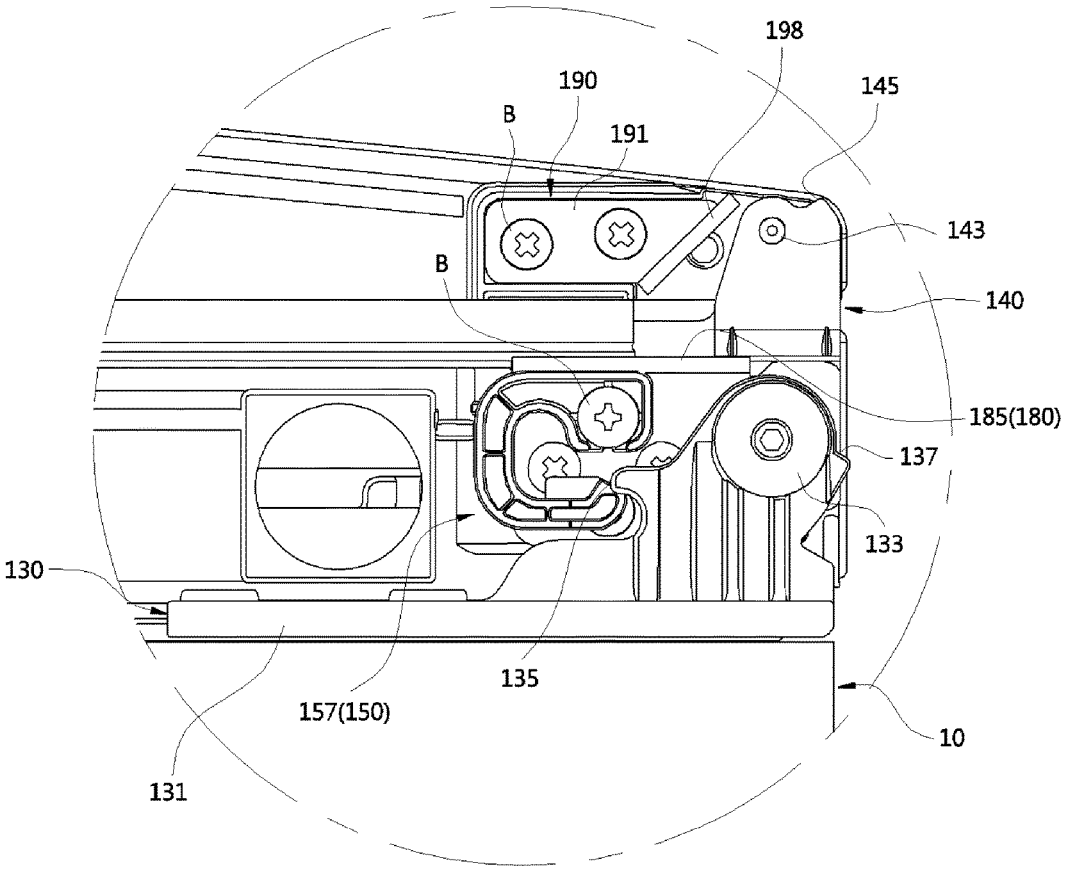

The other side of the second elastic lever 157 passes the elastic lever contact portion 135 and is supported by the elastic lever contact portion 135, and the second elastic lever 157 transfers the accumulated elastic force to the first door 40, and due to the transferred elastic force, the first door 40 is fully closed, as illustrated in FIG. 20.

When the first door 40 is closed, the first door 40 receives the elastic force in the direction in which the first door 40 is closed, due to the elastic force that remains in the second elastic lever 157 and is maintained to be fully in close contact with the main body 10.

Although not shown, when the first door 40 is opened, the other side of the second elastic lever 157 is in contact with the elastic lever contact portion 135 in an opposite direction to the direction in which the first door 40 is closed, moves along the surface of the elastic lever contact portion 135, and passes the elastic lever contact portion 135. Since the first door 40 is maintained in the closed state before the other side of the second elastic lever 157 passes the elastic lever contact portion 135, the first door 40 may be maintained in the closed state even when the other-side refrigerator compartment door 30 is rapidly closed.

As illustrated in FIGS. 1 through 3, the second door 50 includes the handle 70 to which the latch device 200 that selectively opens/closes the first door 40 and the second door 50, is coupled.

The handle 70 is coupled to a front side of the second door 50. The latch device 200 is coupled to a rear side of the handle 70 so that the second door 50 is fixed to the first door 40 and fixing of the second door 50 is released.

Figure 21:
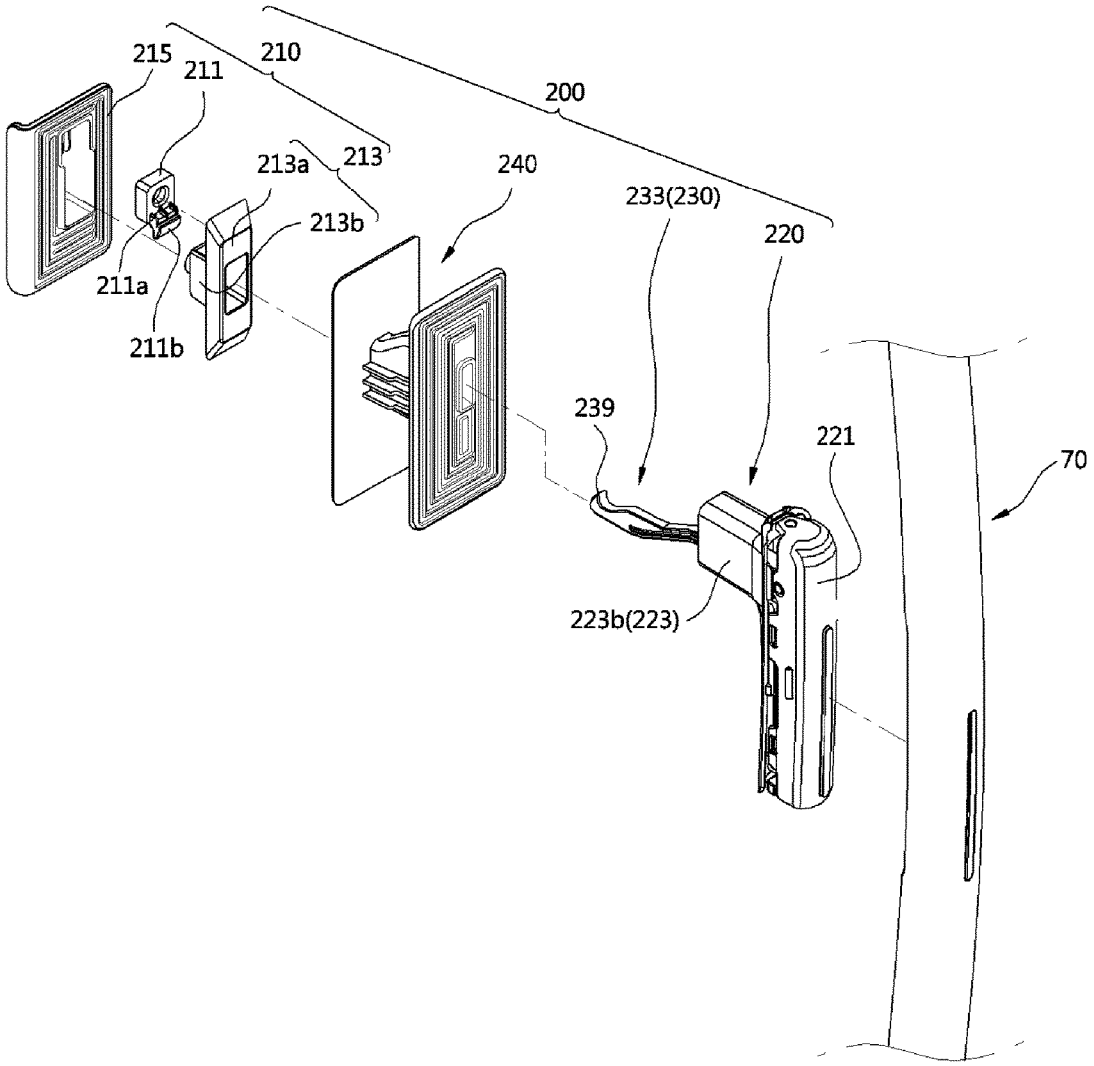
FIG. 21 is an exploded perspective view of a latch device coupled to a handle in accordance with the embodiment of the present invention.
Figure 22:
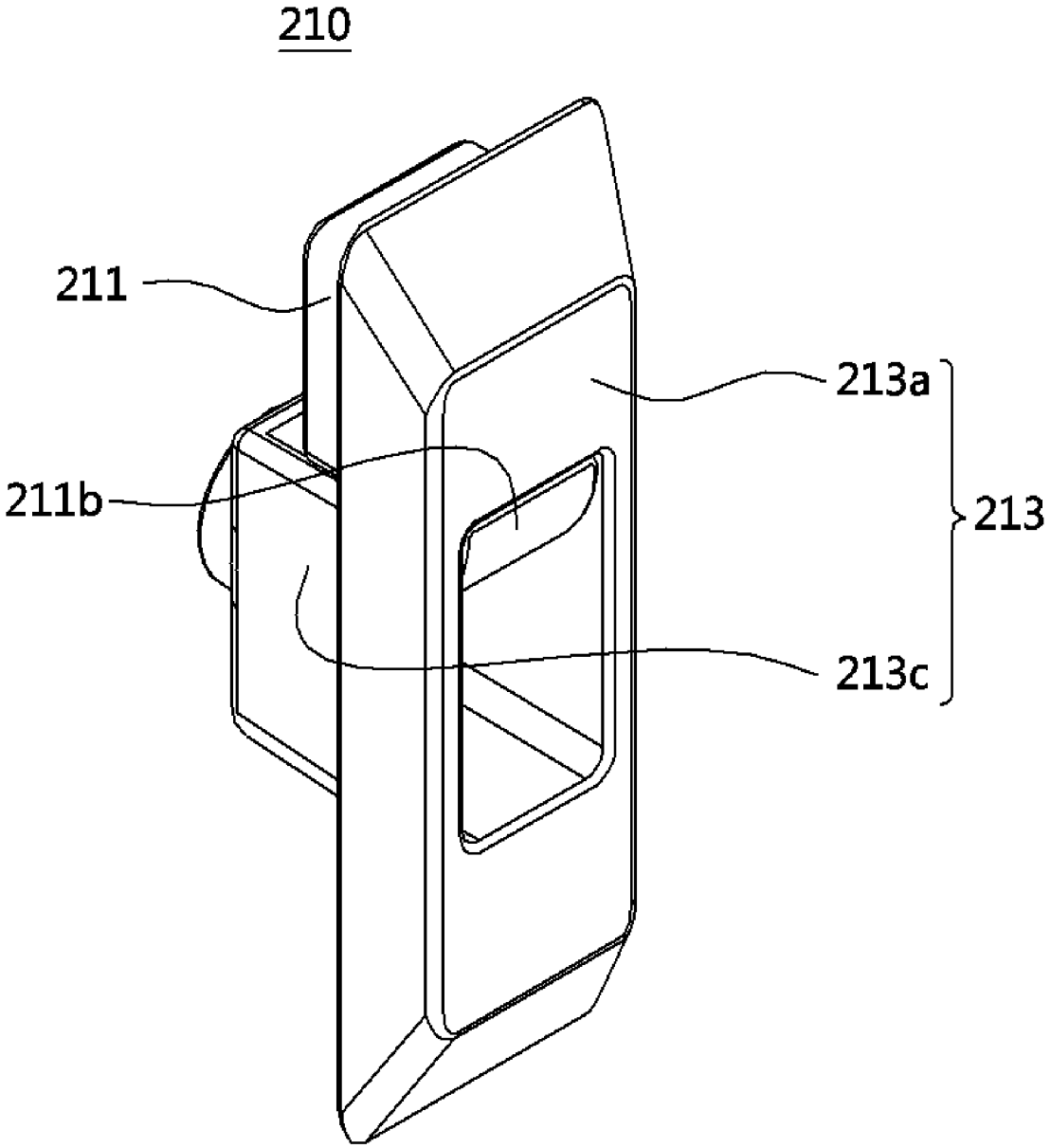
FIG. 22 is a view of a fixing unit in accordance with an embodiment of the present invention.
Figure 23:
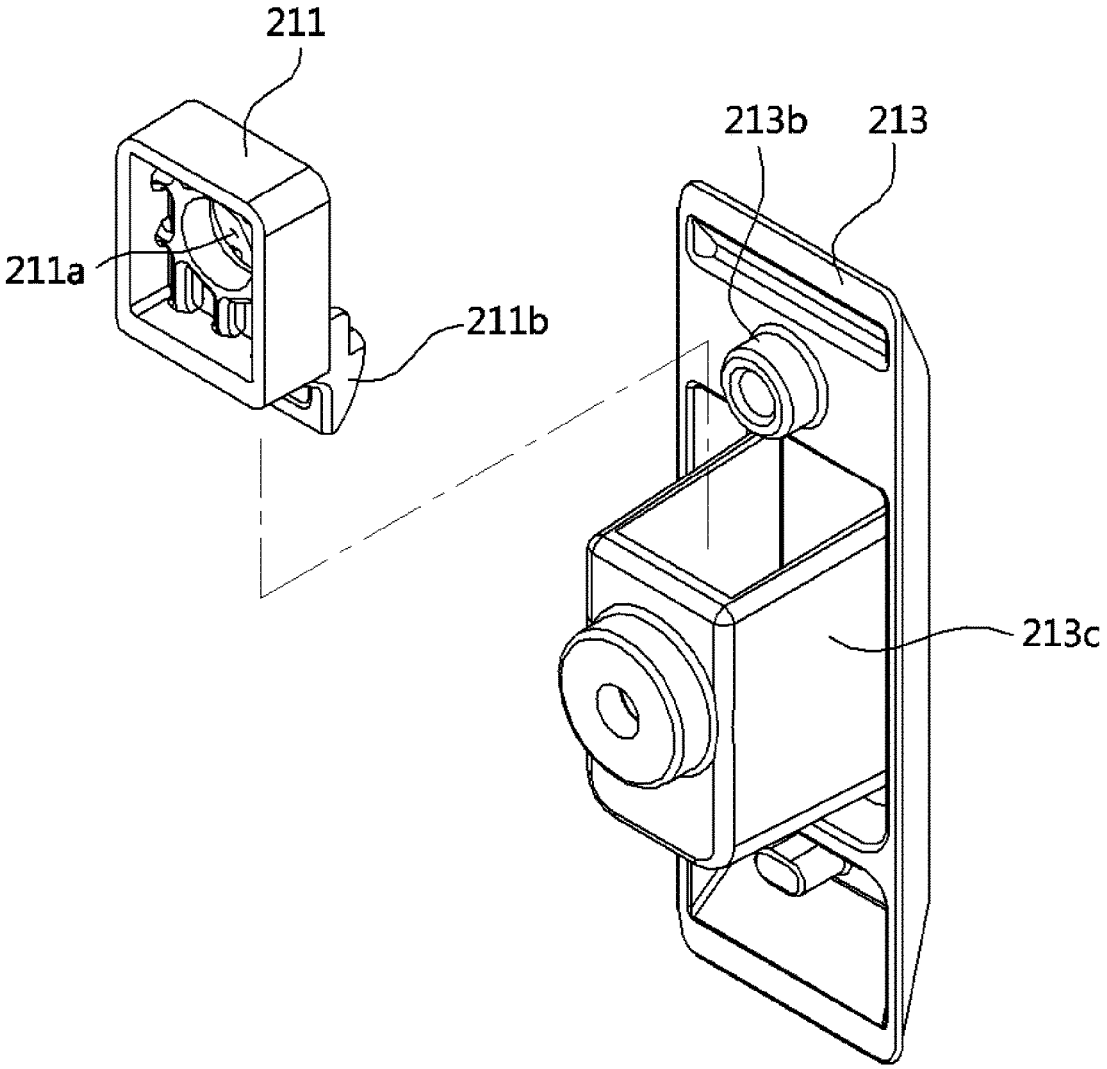
FIG. 23 is a view of a hanging portion of FIG. 22 is disassembled.
Figure 24:
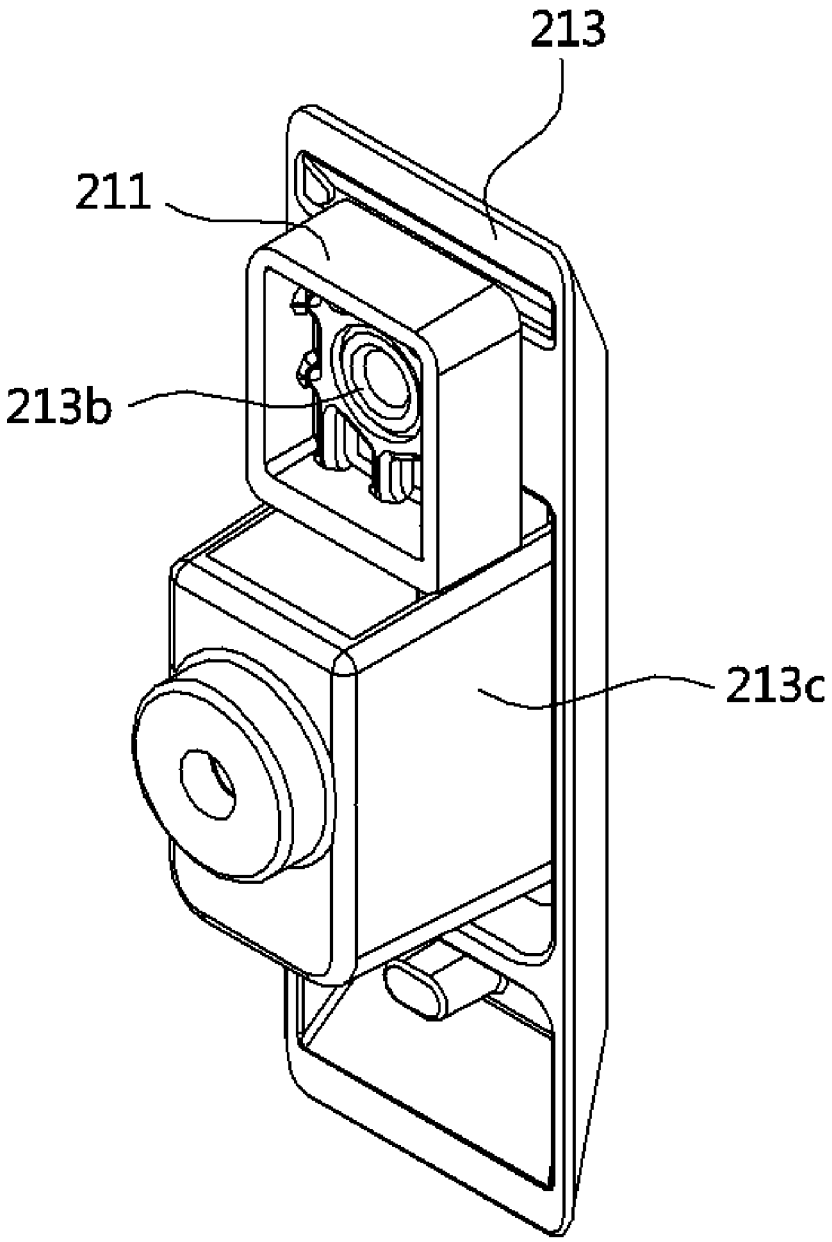
FIG. 24 is a rear view of the fixing unit illustrated in FIG. 22.
Figure 25:
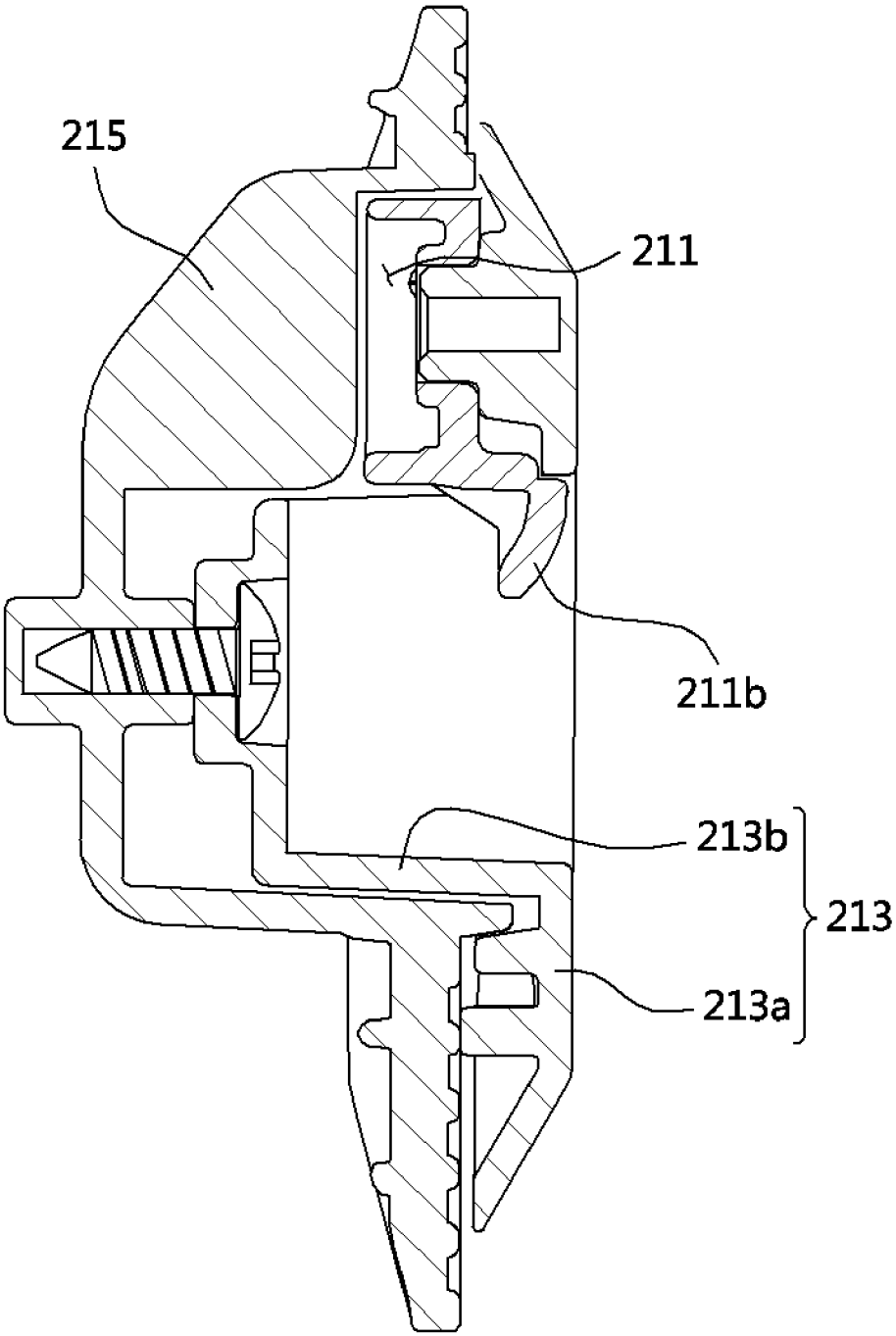
FIG. 25 is a cross-sectional view of the fixing unit in accordance with the embodiment of the present invention.

As illustrated in FIG. 21, the latch device 200 includes a fixing unit 210 buried in the front side of the first door 40, a support 220 that is accommodated in and coupled to the rear side of the handle 70, a handle lever 230 including a first handle lever 231 coupled to the support 220 and a second handle lever 233 that is connected to the first handle lever 231 and is hung in the fixing unit 210 or is released from hanging in the fixing unit 210, and a guide 240 which is buried in the second door 50 and through which the handle lever 230 penetrates.

As illustrated in FIGS. 22 through 25, the fixing unit 210 includes a hanging portion 211 in which the second handle lever 233 is hung and from which hanging of the second handle lever 233 is released, a flow prevention portion 213 that prevents the hanging portion 211 from flowing inside the first door 40, and a cover 215 that is coupled to a rear side of the flow prevention portion 213 and prevents an insulating material U (see FIG. 31) filled in the first door 40 from penetrating into a space formed between the insulating material U and the flow prevention portion 213.

The hanging portion 211 includes a fixing hole 211*a* fixed to the flow prevention portion 213, and a hanging hook 211*b* which is disposed at a lower portion of the fixing hole 211*a* and in which the second handle lever 233 is hung and hanging of which is released.

The flow prevention portion 213 includes a front side portion 213*a* exposed to an outside of a front side of the first door 40, a fixing protrusion 213*b* which protrudes from a rear side of the front side portion 213*a* and into which the fixing hole 211*a* is inserted, and an accommodation portion 213*c* that protrudes from the rear side of the front side portion 213*a* so that an accommodation space may be formed in the rear side of the front side portion 213*a*.

When the fixing protrusion 213*b* is disposed at an upper portion of the accommodation portion 213*c* and the accommodation portion 213*c* in which the accommodation space is formed, is disposed so that front and top sides of the accommodation portion 213*c* may be opened and thus the fixing hole 211*a* of the hanging portion 211 is inserted into the fixing protrusion 213*b* and the hanging portion 211 is fixed to the flow prevention portion 213, the hanging hook 211*b* is accommodated in the accommodation portion 213*c* through the opened top side of the accommodation portion 213*c*, and the hanging hook 211*b* accommodated in the accommodation portion 213*c* is exposed to the outside through the opened front side of the accommodation portion 213*c* so that the second handle lever 233 may be hung in the hanging hook 211*b* and hanging of the second handle lever 233 may be released.

When seeing from the opened front side of the accommodation portion 213*c*, the hanging hook 211*b* is placed in the upper portion of the accommodation portion 213*c*, and a front end of the second handle lever 233 is accommodated in the accommodation portion 213*c* through the opened front side of the accommodation portion 213*c* and moves in a vertical direction and thus, a hanging protrusion 239 disposed on the front end of the second handle lever 233 is hung in the hanging hook 211*b* and hanging of the hanging protrusion 239 is released.

The cover 215 is coupled to the rear side of the flow prevention portion 213 and prevents the insulating material U filled in the first door 40 from penetrating into the space formed between the insulating material U and the flow prevention portion 213. The cover 215 supports the rear side of the hanging portion 211 so that the hanging portion 211 fixed when the fixing protrusion 213*b* of the flow prevention portion 213 fixing hole is inserted into the fixing hole 211*a* fixing protrusion may be prevented from escaping from the fixing protrusion 213*b*.

Figure 26:
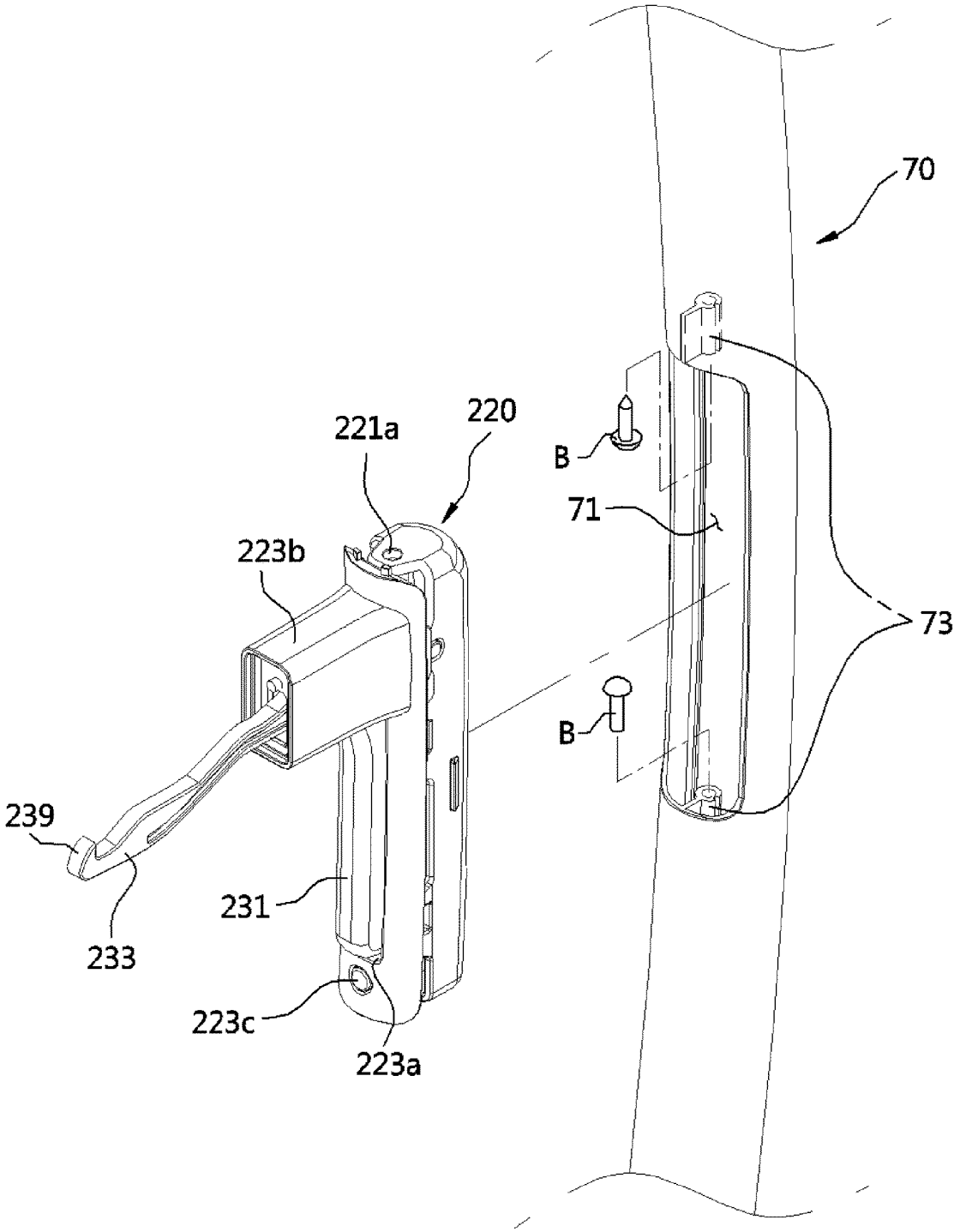
FIG. 26 is a view of a state in which a support is coupled to the handle, in accordance with an embodiment of the present invention.
Figure 27:
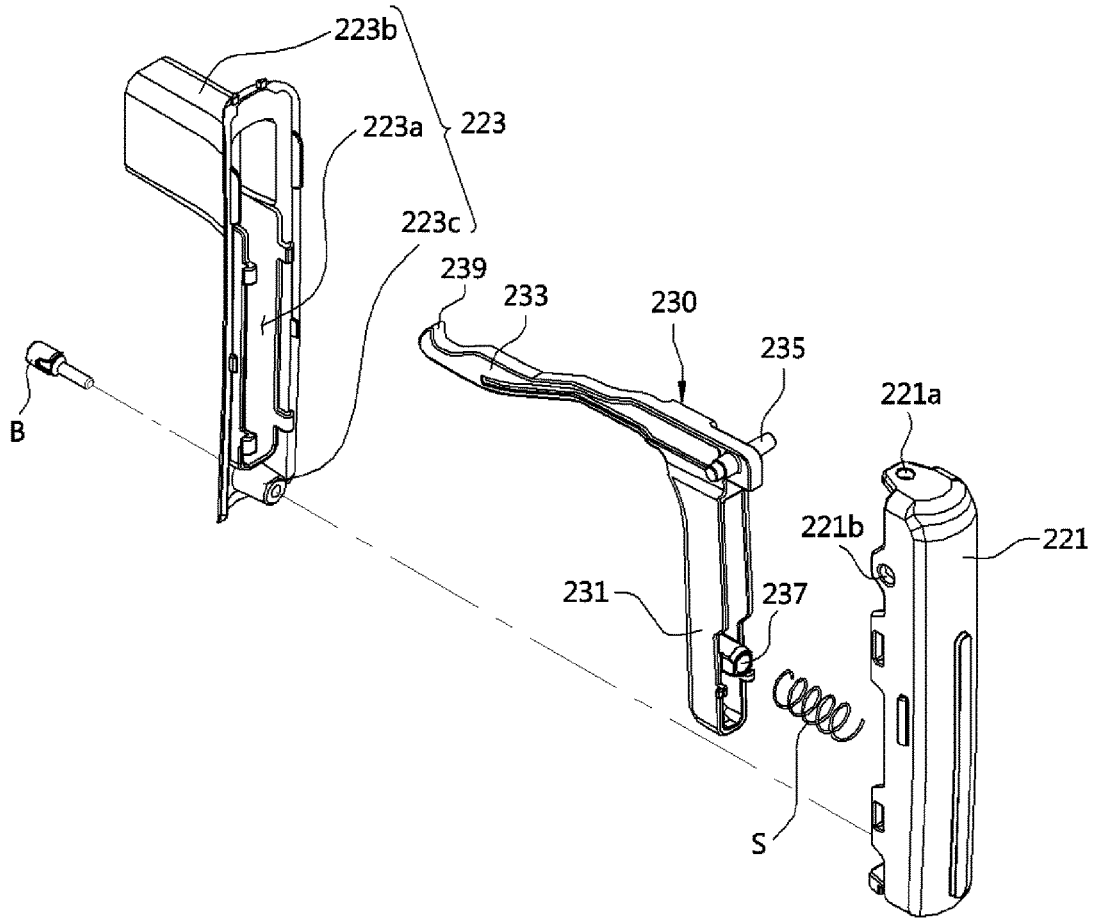
FIG. 27 is an exploded perspective view of the support and a handle lever in accordance with an embodiment of the present invention.
Figure 28:
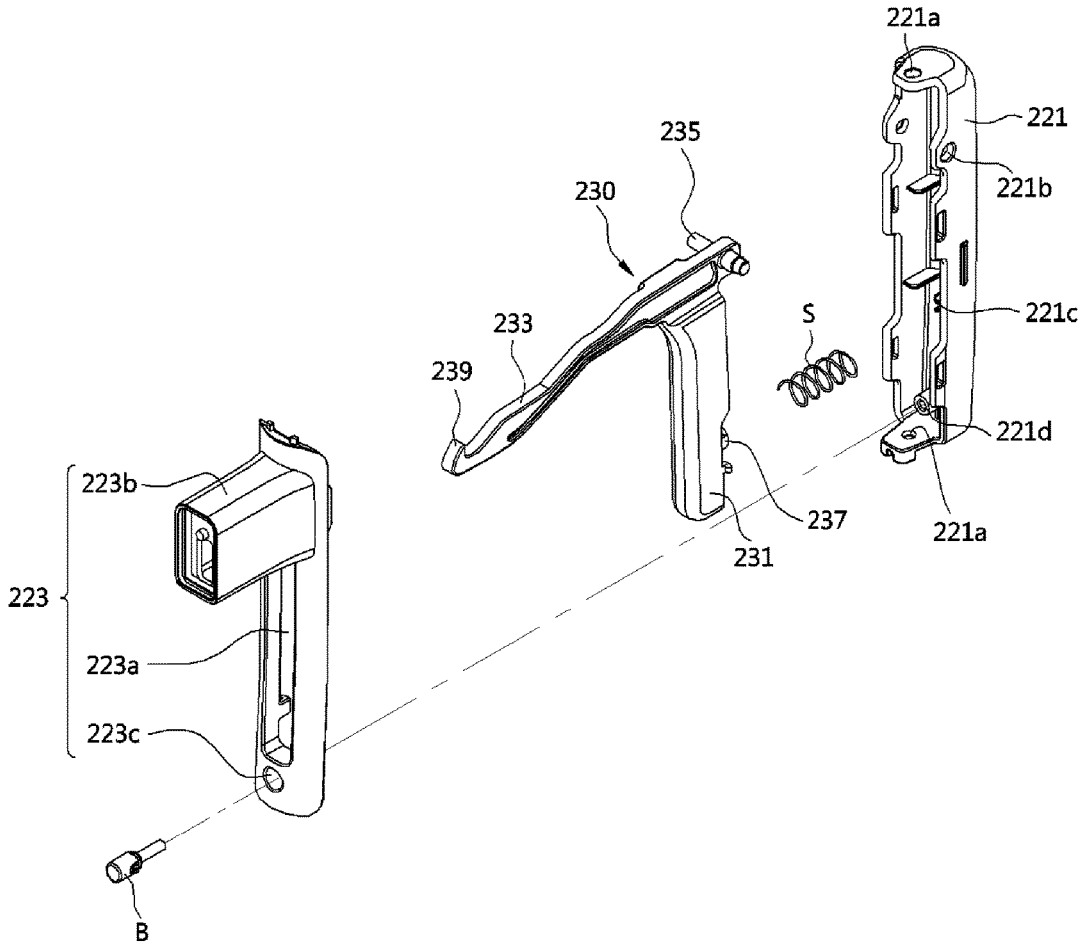
FIG. 28 is a view of FIG. 27 at a different angle.

As illustrated in FIGS. 26 through 28, the support 220 is accommodated in and coupled to the rear side of the handle 70, and a support accommodation portion 71 in which the support 220 is accommodated, is disposed in the rear side of the handle 70.

The support 220 includes a housing 221 which is accommodated in and coupled to the support accommodation portion 71 and a rear side of which is opened, and a rear cover 223 coupled to the opened rear side of the housing 221.

A first coupling hole 73 into which the housing 221 is coupled, is disposed in the support accommodation portion 71, and a second coupling hole 221*a* is disposed in a position of the housing 221 corresponding to the first coupling hole 73 so that the housing 221 may be coupled to the support accommodation portion 71 by the fastening member B.

A rotation hole 221*b* into which a rotation shaft 235 of the handle lever 230 that will be described later is rotatably coupled, a first support portion 221*c* that supports one side of a spring S elastically supporting the first handle lever 231, and a third coupling hole 221*d* into which the rear cover 223 is coupled, are disposed in the housing 221.

The rear cover 223 includes an opening 223*a* opened so that the rear side of the first handle lever 231 that will be described later may be exposed to the outside, a guide portion 223*b* that guides the second handle lever 233 not to be exposed to the outside, and a fourth coupling hole 223*c* disposed in a position corresponding to the third coupling hole 221*d* disposed in the housing 221.

The rear side of the first handle lever 231 is exposed to the outside through the opening 223*a* of the rear cover 223 and thus, a user may pressurize the rear side of the first handle lever 231 exposed to the outside forward by grasping the handle 70.

The guide portion 223*b* causes the second handle lever 233 coupled to the housing 221 not to be exposed to the outside in the space between the handle 70 and the second door 50 to pass through the second door 50 so that the second handle lever 233 may be hung in the fixing unit 210 disposed in the first door 40 and hanging of the second handle lever 233 may be released.

The guide portion 223*b* is disposed to have a sufficient space in the vertical direction so that the second handle lever 233 may be moved in the vertical direction. The guide portion 223*b* communicates with the guide 240 buried in the second door 50.

The rear cover 223 is coupled to the housing 221 by using the fastening member B through the third coupling hole 221*d* disposed in the housing 221 and the fourth coupling hole 223*c* disposed in the rear cover 223.

The handle lever 230 is rotatably coupled to the support 220 and is hung in the fixing unit 210, and hanging of the handle lever 230 is released.

The rotation shaft 235 is disposed in the handle lever 230. The rotation shaft 235 is rotatably coupled to the rotation hole 221*b* disposed in the housing 221 of the support 220 so that the handle lever 230 may be rotated.

The handle lever 230 includes the first handle lever 231 disposed to be rotated about the rotation shaft 235 in the forward/backward direction, and a second handle lever 233 that is linked to the first handle lever 231, is rotated about the rotation shaft 235 in the vertical direction when the first handle lever 231 is rotated in the forward/backward direction, and is hung in the hanging portion 211 of the fixing unit 210 and hanging of the second handle lever 233 is released.

When seeing from the rotation shaft 235, the first handle lever 231 is disposed to extend from the rotation shaft 235 downward so that the front side of the first handle lever 231 is accommodated in the housing 221 of the support 220.

The rear side of the first handle lever 231 is exposed to the outside through the opening 223*a* of the rear cover 223 coupled to the rear side of the housing 221 so that the user may pressurize the first handle lever 231 forward by grasping the handle 70.

A second support portion 237 that supports the spring S is disposed in a lower portion of the first handle lever 231, and both sides of the spring S are supported by the first support portion 221*c* disposed in the housing 221 and the second support portion 237 of the first handle lever 231.

Since the spring S is disposed in the lower portion of the first handle lever 231, when the user pressurizes the first handle lever 231, the first handle lever 231 is rotated about the rotation shaft 235 backward and compresses the spring S and accumulates an elastic force.

When the user takes his/her hand off from the first handle lever 231 in a state in which the first handle lever 231 is pressurized, the first handle lever 231 is rotated about the rotation shaft 235 backward by the accumulated elastic force of the spring S and is returned to its original position.

When seeing from the rotation shaft 235, the second handle lever 233 is disposed to extend from the rotation shaft 235 backward.

The second handle lever 233 is guided by the guide portion 223*b* of the rear cover 223 and the guide 240 buried in the second door 50 and extends so that the second handle lever 233 may be hung in the fixing unit 210 buried in the front side of the first door 40 and hanging of the second handle lever 233 may be released.

The second handle lever 233 is connected to the first handle lever 231. When the user pressurizes the first handle lever 231 to be rotated about the rotation shaft 235 forward, the second handle lever 233 is rotated about the rotation shaft 235 downward.

The hanging protrusion 239 is disposed on an end of the second handle lever 233. The hanging protrusion 239 causes the second handle lever 233 to be hanging-released from the hanging hook 211*b* of the fixing unit 210 when the second handle lever 233 is rotated about the rotation shaft 235 downward.

Figure 29:
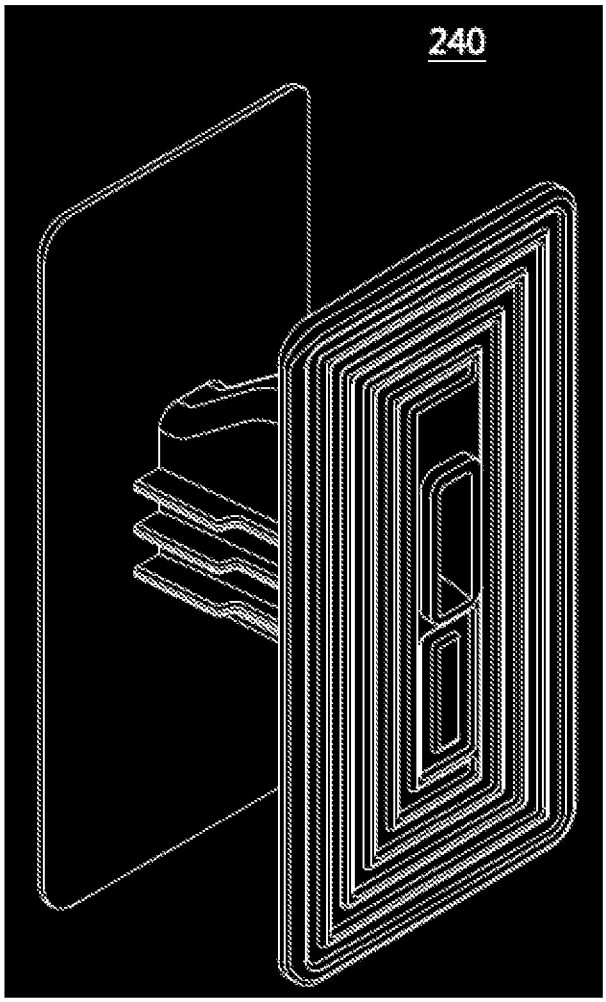
FIG. 29 is a view of a guide in accordance with an embodiment of the present invention.
Figure 31:
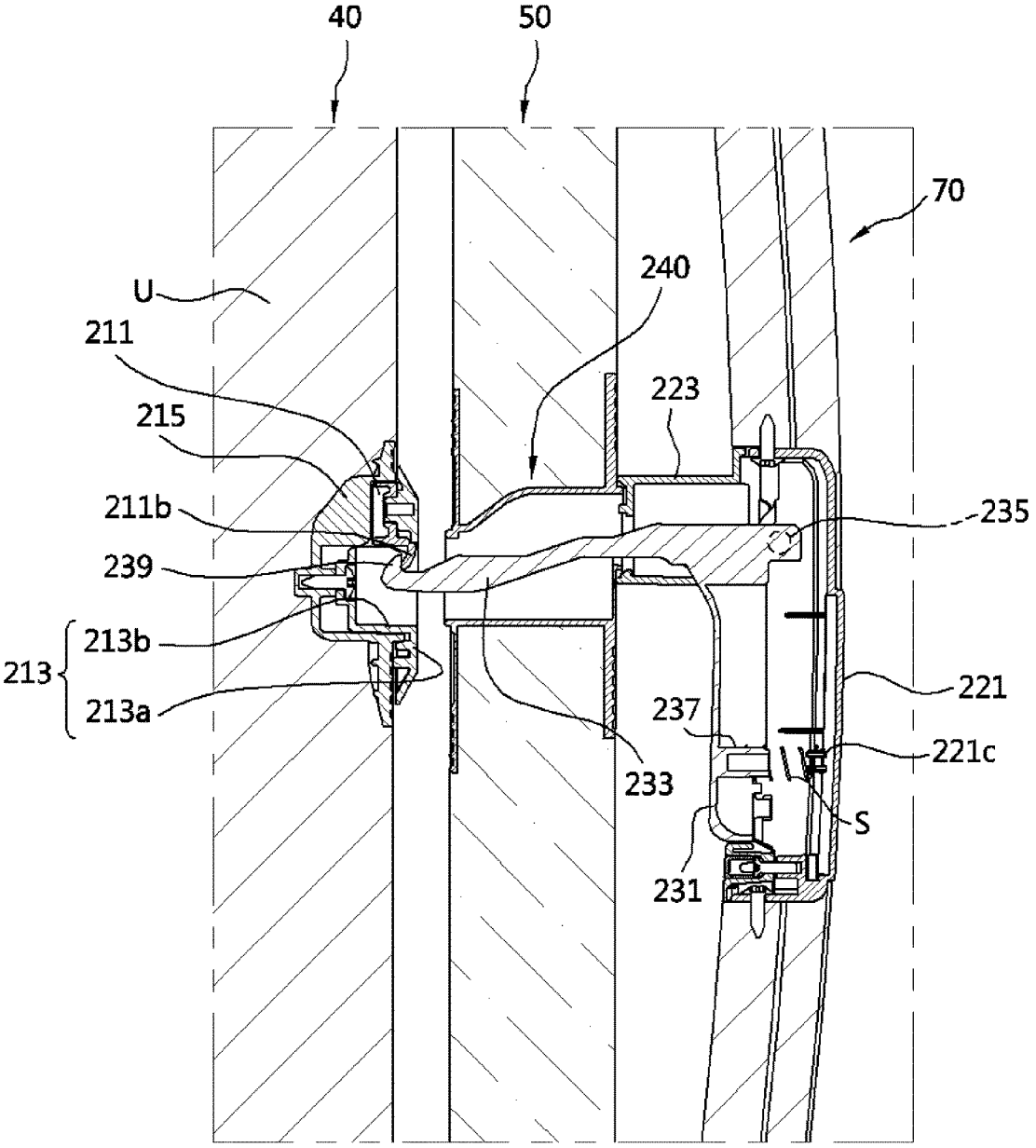
FIG. 31 is a cross-sectional view of a state in which the second door is fixed to the first door by using the latch device in accordance with the embodiment of the present invention.

As illustrated in FIGS. 29 and 31, the guide 240 is buried in the second door 50, communicates with the guide portion 223*b* disposed in the rear cover 223 of the support 220, and guides the second handle lever 233 to pass through the second door 50.

Figure 30:
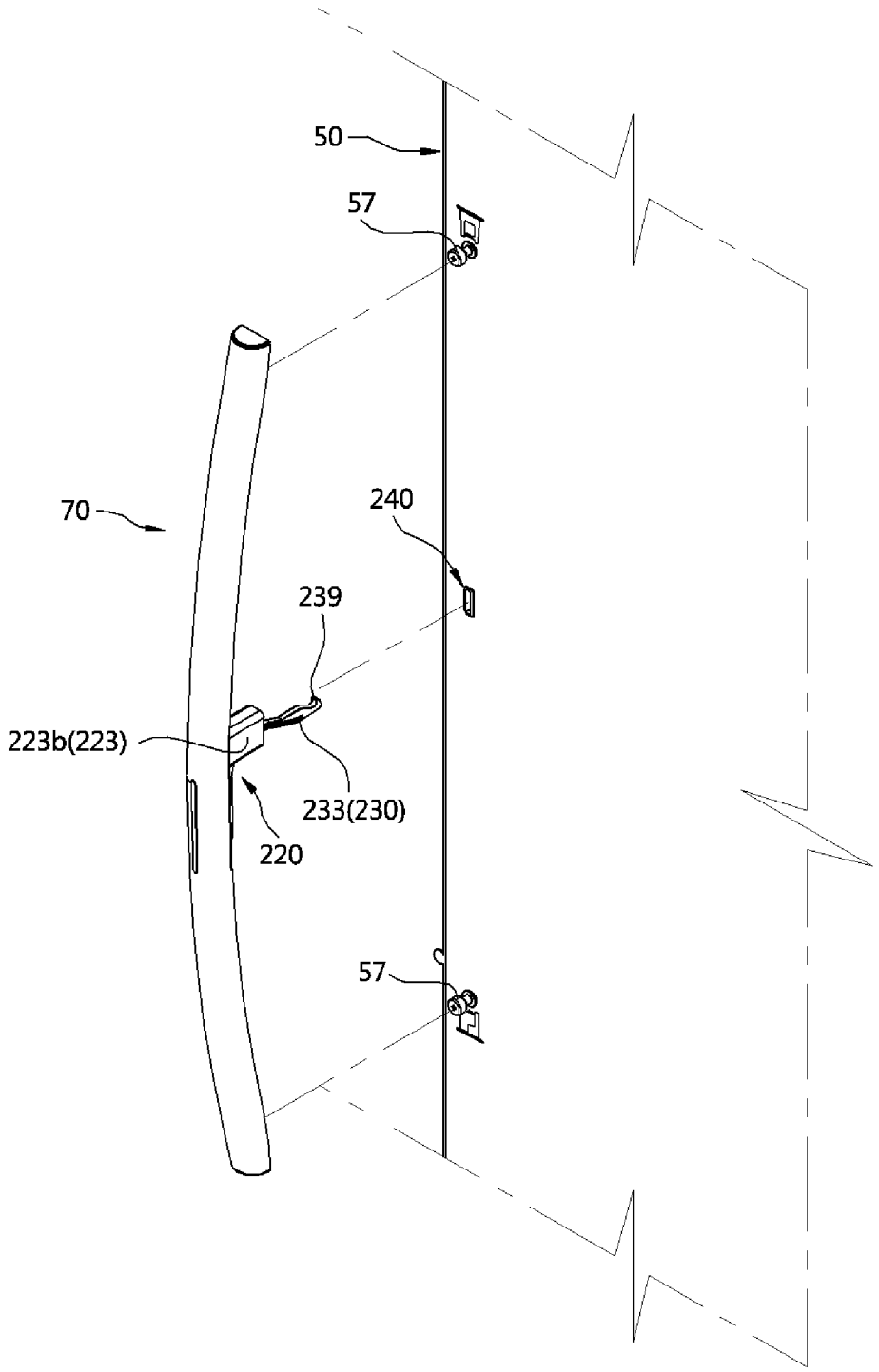
FIG. 30 schematically illustrates a state in which the second door is coupled to the handle in accordance with the embodiment of the present invention.

As described above, the latch device 200 includes the housing 221 coupled to the handle 70, the handle lever 230 coupled to the housing 221, the fixing unit 210 buried in the first door 40, and the guide 240 buried in the second door 50. As illustrated in FIG. 30, both ends of the handle 70 are configured to be inserted into and coupled to the coupling member 57 disposed at the front side of the second door 50 by using a sliding method. Thus, even when the refrigerator is put on the market in a state in which the handle 70 is separated from the second door 50 without the need of coupling the handle 70 to the second door 50, the user may easily couple the handle 70 to the second door 50 and use the refrigerator.

Since the housing 221 and the handle lever 230 of the latch device 200 are coupled to the handle 70 and the fixing unit 210 and the guide 240 are buried in the first door 40 and the second door 50, respectively, by coupling the handle 70 to the second door 50, the latch device 200 may be used without performing a separate assembly operation so that the refrigerator may be put on the market in the state in which the handle 70 is separated from the second door 50 and then the user may couple the handle 70 to the second door 50 and use the refrigerator.

Since the refrigerator may be put on the market in the state in which the handle 70 is separated from the second door 50, the refrigerator may be easily transported, and damage of the handle 70 when the refrigerator is transported may be prevented.

Next, an operation of the latch device 200 will be described with reference to FIGS. 31 through 34.

As illustrated in FIG. 31, when both the first door 40 and the second door 50 are closed, the hanging protrusion 239 of the second handle lever 233 is hung in the hanging hook 211*b* of the fixing unit 210. Thus, the second door 50 is fixed to the first door 40, and the user opens the second door 50 by grasping the handle 70 so that the first door 40 and the second door 50 may be opened together.

Figure 32:
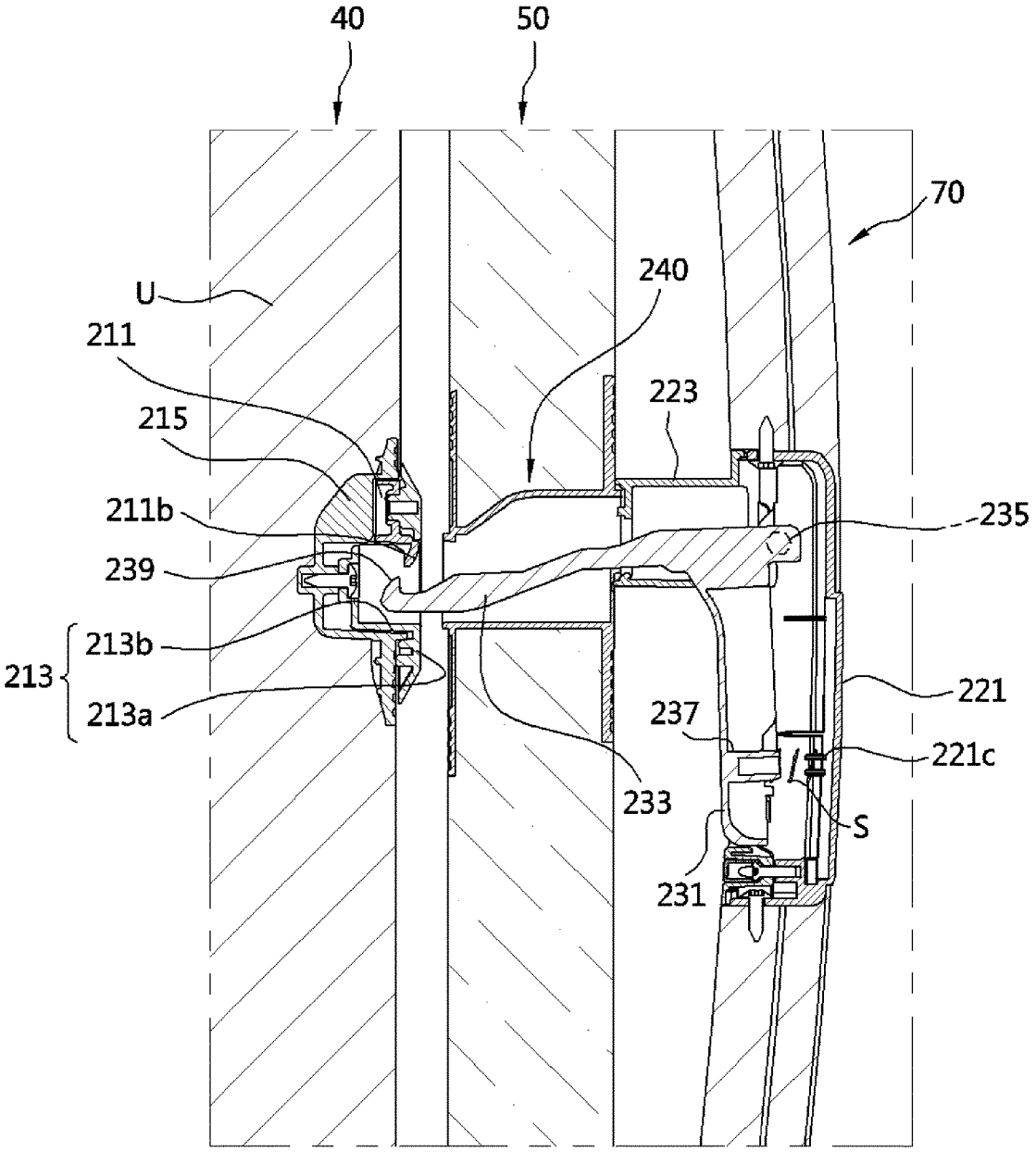
FIG. 32 is a cross-sectional view of a state in which fixing of the second door is released from the first door by using the latch device in accordance with the embodiment of the present invention.

As illustrated in FIG. 32, when the user pressurizes the first handle lever 231 forward, the first handle lever 231 is rotated about the rotation shaft 235 forward, and the second handle lever 233 is rotated about the rotation shaft 235 downward.

Figure 33:
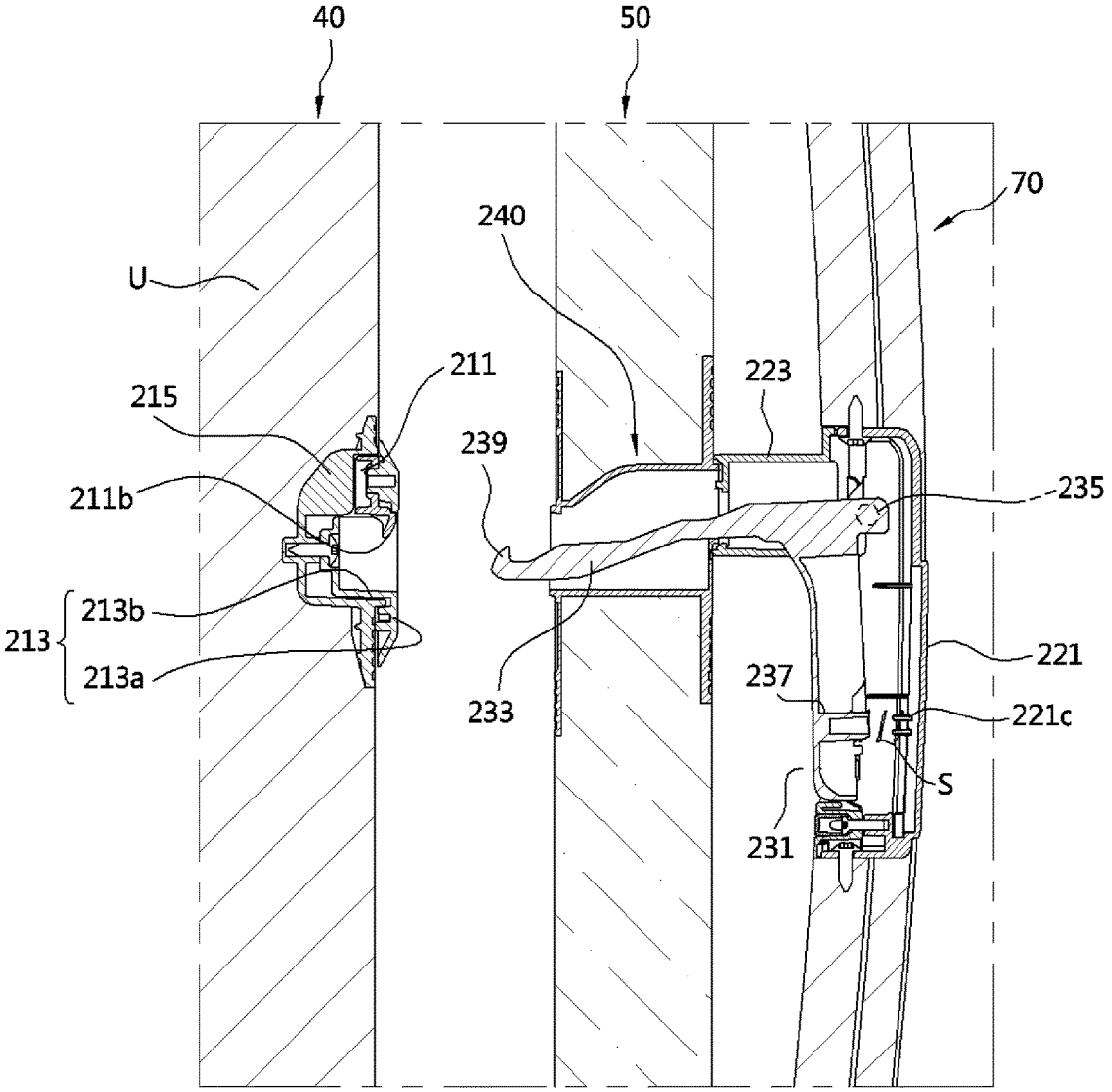
FIG. 33 is a cross-sectional view of a state in which the second door is opened in the state of FIG. 32.

When the second handle lever 233 is rotated about the rotation shaft 235 downward, hanging of the hanging protrusion 239 disposed on the end of the second handle lever 233 is released from the hanging hook 211*b*. Thus, when fixing of the second door 50 to the first door 40 is released and the user opens the second door 50 by grasping the handle 70, as illustrated in FIG. 33, only the second door 50 is opened.

Figure 34:
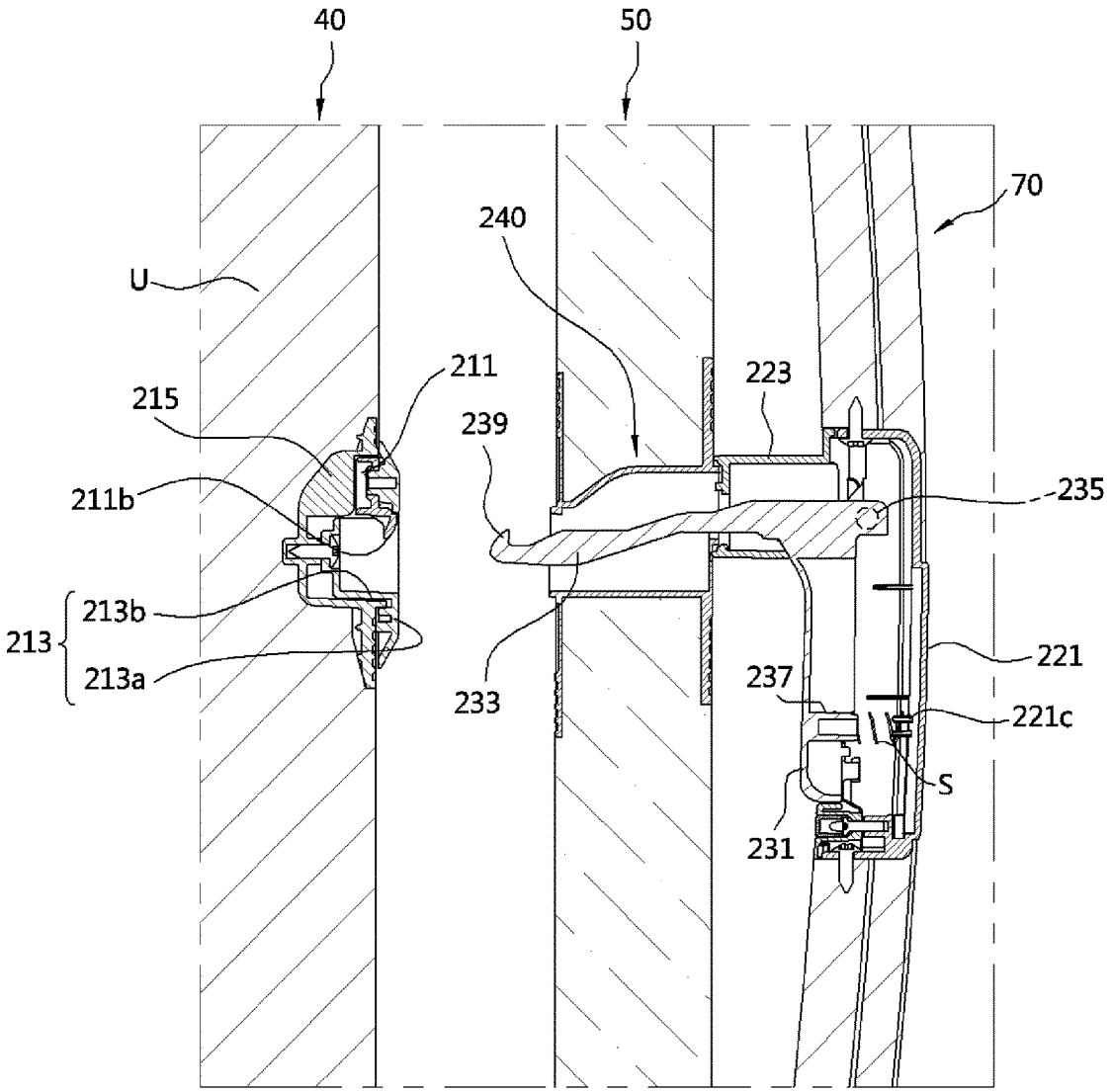
FIG. 34 is a cross-sectional view of a state in which a force applied to a first handle lever is removed from the state of FIG. 33.

When the user takes his/her hand off from the handle 70 in a state in which only the second door 50 is opened, as illustrated in FIG. 34, the first handle lever 231 is rotated about the rotation shaft 235 backward by the elastic force of the spring S, and the second handle lever 233 is rotated about the rotation shaft 235 upward and is returned to its original state.

Although not shown, when the user closes the second door 50 in the state in which only the second door 50 is opened, if the user pressurizes the first handle lever 231 by grasping the handle 70, the first handle lever 231 is rotated about the rotation shaft 235 forward, and the second handle lever 233 is rotated about the rotation shaft 235 downward. Thus, when the second door 50 is closed in the above state, the hanging protrusion 239 of the second handle lever 233 is accommodated in the accommodation portion 213*c* of the fixing unit 210.

When the user takes his/her hand off from the second handle lever 233 in a state in which the hanging protrusion 239 of the second handle lever 233 is accommodated in the accommodation portion 213*c*, due to the elastic force of the spring S, the first handle lever 231 is rotated about the rotation shaft 235 backward, and the second handle lever 233 is rotated about the rotation shaft 235 upward, and the hanging protrusion 239 is hung in the hanging hook 211*b*.

When the second door 50 is closed in the state in which only the second door 50 is opened, if the user closes the second door 50 by grasping the handle 70 without pressurizing the first handle lever 231, the hanging protrusion 239 of the second handle lever 233 is in contact with the hanging hook 211*b*.

When the second door 50 is further pushed to be closed in a state in which the hanging protrusion 239 is in contact with the hanging hook 211*b*, the second handle lever 233 is rotated about the rotation shaft 235 downward, and the second door 50 is closed in a state in which the first handle lever 231 is rotated about the rotation shaft 235 forward.

When the second door 50 is closed, the first handle lever 231 is rotated about the rotation shaft 235 backward due to the elastic force of the spring S, the second handle lever 233 is rotated about the rotation shaft 235 upward, and the hanging protrusion 239 is hung in the hanging hook 211*b*.

Figure 35:
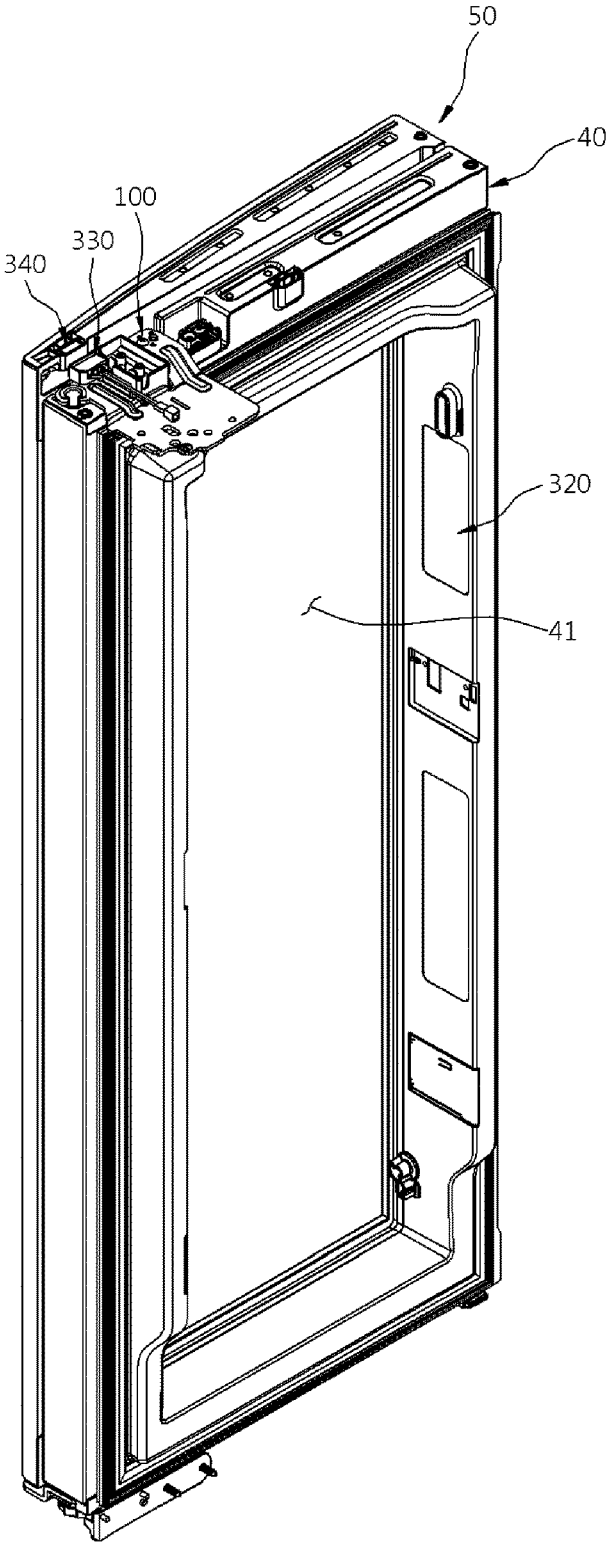
FIG. 35 is a view of a state in which a lamp is installed at sidewalls of an opening of the first door in accordance with the embodiment of the present invention.
Figure 36:
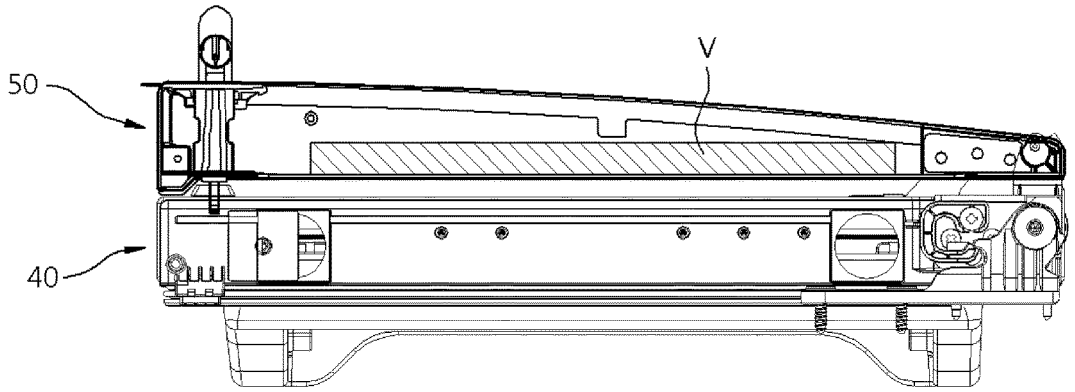
FIG. 36 is a view of a state in which a vacuum insulation panel (VIP) is filled in the second door in accordance with the embodiment of the present invention.
Figure 37:
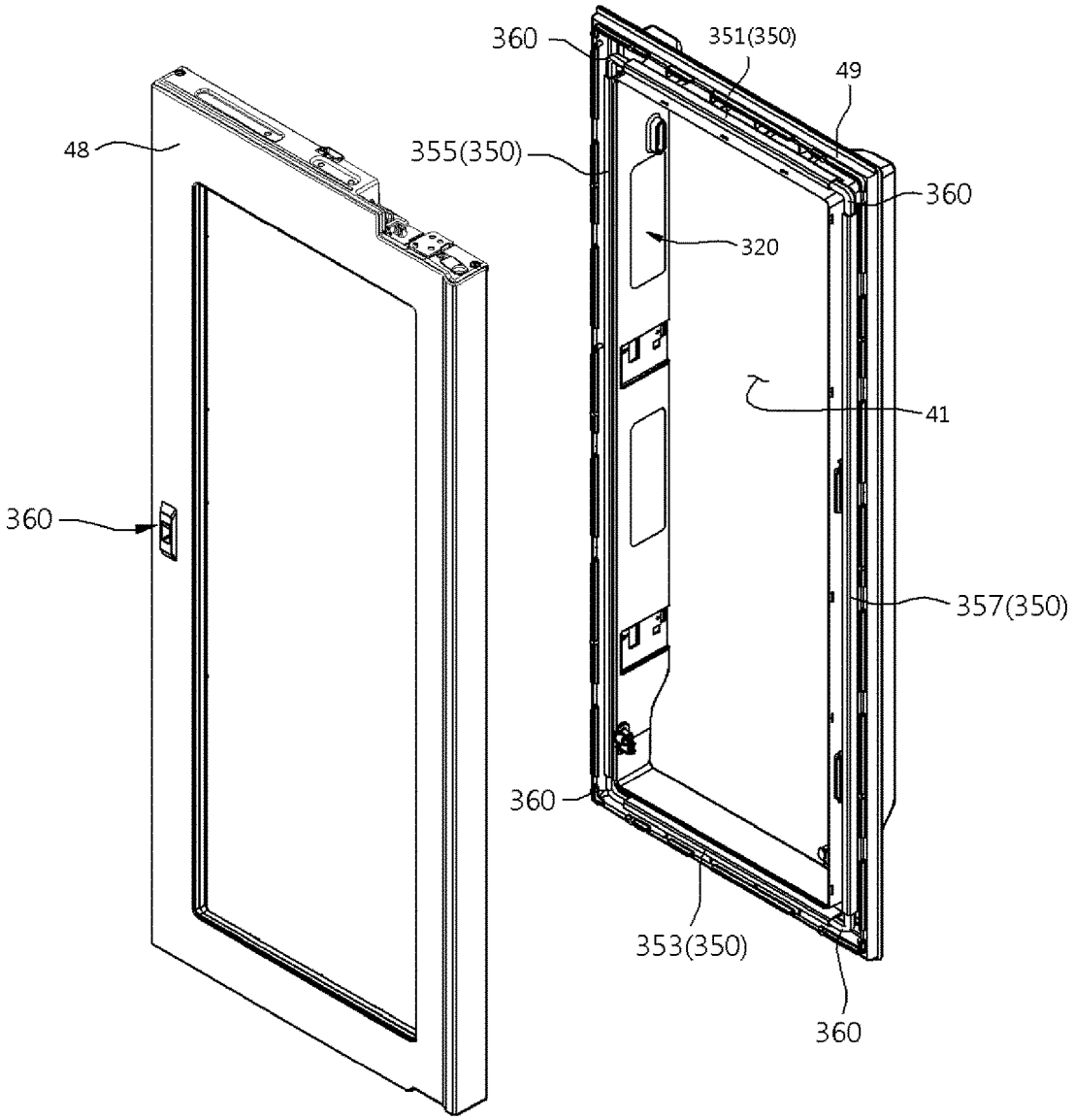
FIG. 37 is a view of a state in which a reinforcement frame is coupled to an internal injection-molded body of the first door in accordance with the embodiment of the present invention.

As illustrated in FIG. 2, when only the second door 50 is opened and the first door 40 is closed, at least one lamp 320 may be installed at sidewalls of the opening 41, as illustrated in FIG. 35, so that the user may easily identify food stored in the door guard 33 disposed in the opening 41 of the first door 40.

As illustrated in FIG. 2 and FIGS. 36 through 41, since the refrigerator compartment door 30 having the double door structure of the pair of refrigerator compartment doors 30 includes the first door 40 and the second door 50, both the first door 40 and the second door 50 have small thicknesses.

The insulating material U is filled in the second door 50. As a larger amount of insulating material U is filled in the second door 50, an insulating property of the second door 50 is improved. Thus, the thickness of the second door 50 needs to be increased so as to improve the insulating property of the second door 50 having a small thickness. However, for the reason of esthetic appealing, the pair of refrigerator compartment doors 30 are required to be balanced. Thus, instead of increasing the thickness of the second door 50, a vacuum insulation panel (VIP) V may be filled in the second door 50 so as to supplement the insulating property of the insulating material U.

The first door 40 includes a cabinet 48 that constitutes an exterior, and an internal injection-molded body 49 that constitutes the sidewalls of the opening 41. The insulating material U is foamed between the cabinet 48 and the internal injection-molded body 49.

Since the first door 40 has a small thickness and is disposed in a rectangular shape having the opening 41, insulating performance of the first door 40 may be reduced, and rigidity of the first door 40 is lowered so that the first door 40 may be deformed by the weight of the first door 40 and a load of a material stored in the door guard 33 disposed in the opening 41.

In order to supplement lowered rigidity of the first door 40, a reinforcement frame 350 may be disposed between the cabinet 48 and the internal injection-molded body 49.

The reinforcement frame 350 includes an upper reinforcement frame 351 that is disposed at a front side of the internal injection-molded body 49, supplements rigidity of the first door 40, and is coupled to an upper portion of the internal injection-molded body 49, a lower reinforcement frame 353 coupled to a lower portion of the internal injection-molded body 49, a first side reinforcement frame 355 disposed at the left side of the first door 40 that is a portion to which the handle 70 is coupled, of both sides of the reinforcement frame 350, and a second side reinforcement frame 357 disposed at the right side of the first door 40 that is an opposite side to the left side of the first door 40.

The upper reinforcement frame 351 and the lower reinforcement frame 353 are inserted into and coupled to coupling ribs 49*a* disposed in the upper and lower portions of the internal injection-molded body 49, respectively.

In order to fix the first side reinforcement frame 355 and the second side reinforcement frame 357 disposed on both sides of the reinforcement frame 350, fixing members 360 bent in a '¬' shape are inserted into and coupled to both ends of each of the upper reinforcement frame 351 and the lower reinforcement frame 353.

One side of each of the fixing members 360 disposed in the upper portion of the internal injection-molded body 49 is inserted into and coupled to the upper reinforcement frame 351. The other side of each of the fixing members 360 is inserted into and coupled to a top end of the first side reinforcement frame 355 and a top end of the second side reinforcement frame 357.

One side of each of the fixing members 360 disposed in the lower portion of the internal injection-molded body 49 is inserted into and coupled to the lower reinforcement frame 353. The other side of each of the fixing members 360 is inserted into and coupled to a bottom end of the first side reinforcement frame 355 and a bottom end of the second side reinforcement frame 357.

Thus, the first side reinforcement frame 355 and the second side reinforcement frame 357 may be fixed to the upper reinforcement frame 351 and the lower reinforcement frame 353 by using the fixing members 360.

Since the fixing units 210 of the latch device 200 coupled to the handle 70 are buried in the left side of the first door 40 in which the first side reinforcement frame 355 is disposed, an auxiliary reinforcement frame 359 may be additionally disposed so as to further reinforce rigidity.

The auxiliary reinforcement frame 359 may be inserted into and fixed to fixing ribs 48*a* disposed on the right side of the cabinet 48 and may be disposed to be placed at an outer side than the first side reinforcement frame 355.

Although not shown, like in the second door 50, the VIP V may be filled in the first door 40 so as to improve an insulating property of the first door 40.

Figure 38:
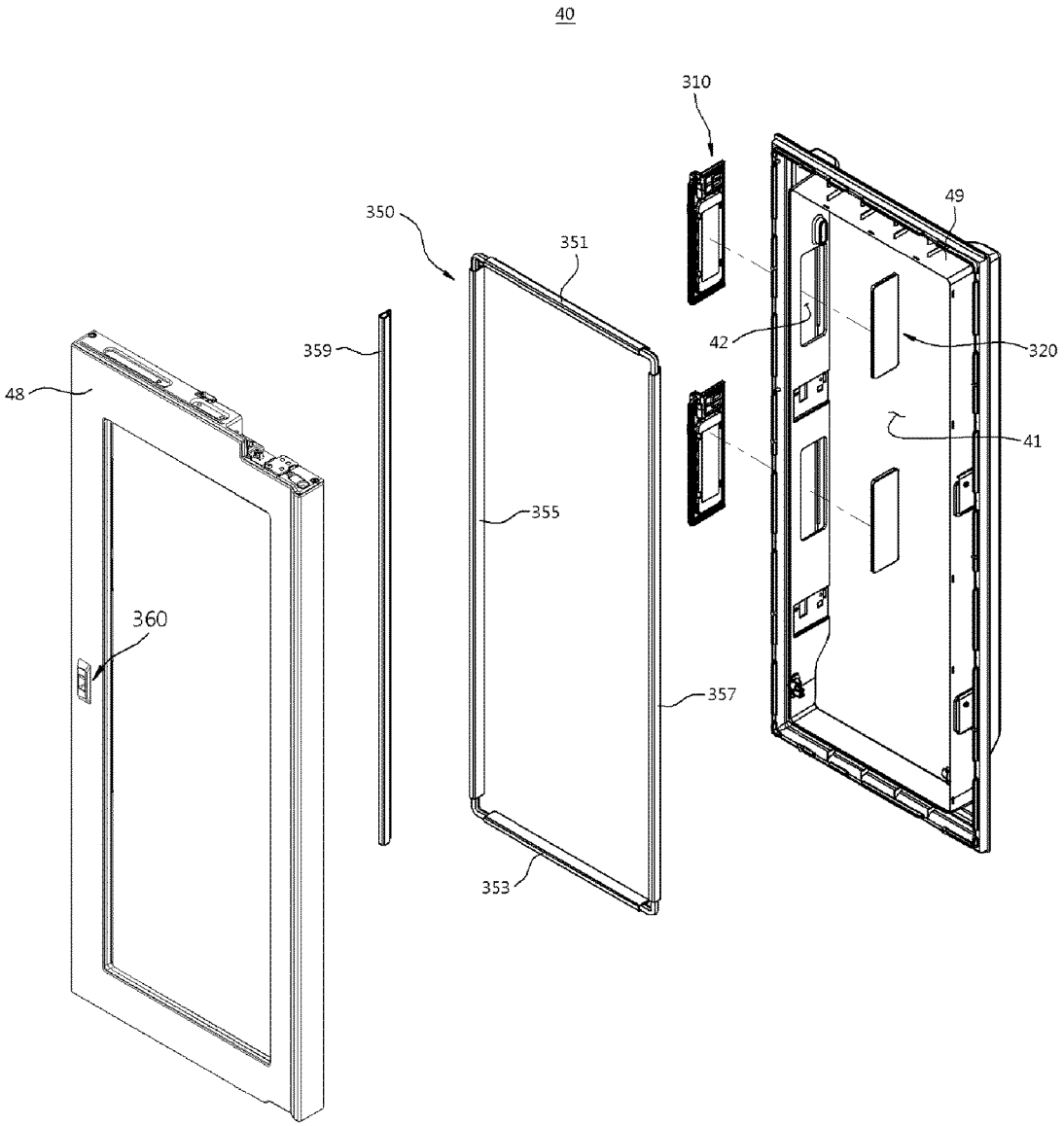
FIG. 38 is an exploded perspective view of the first door in accordance with the embodiment of the present invention.
Figure 39:
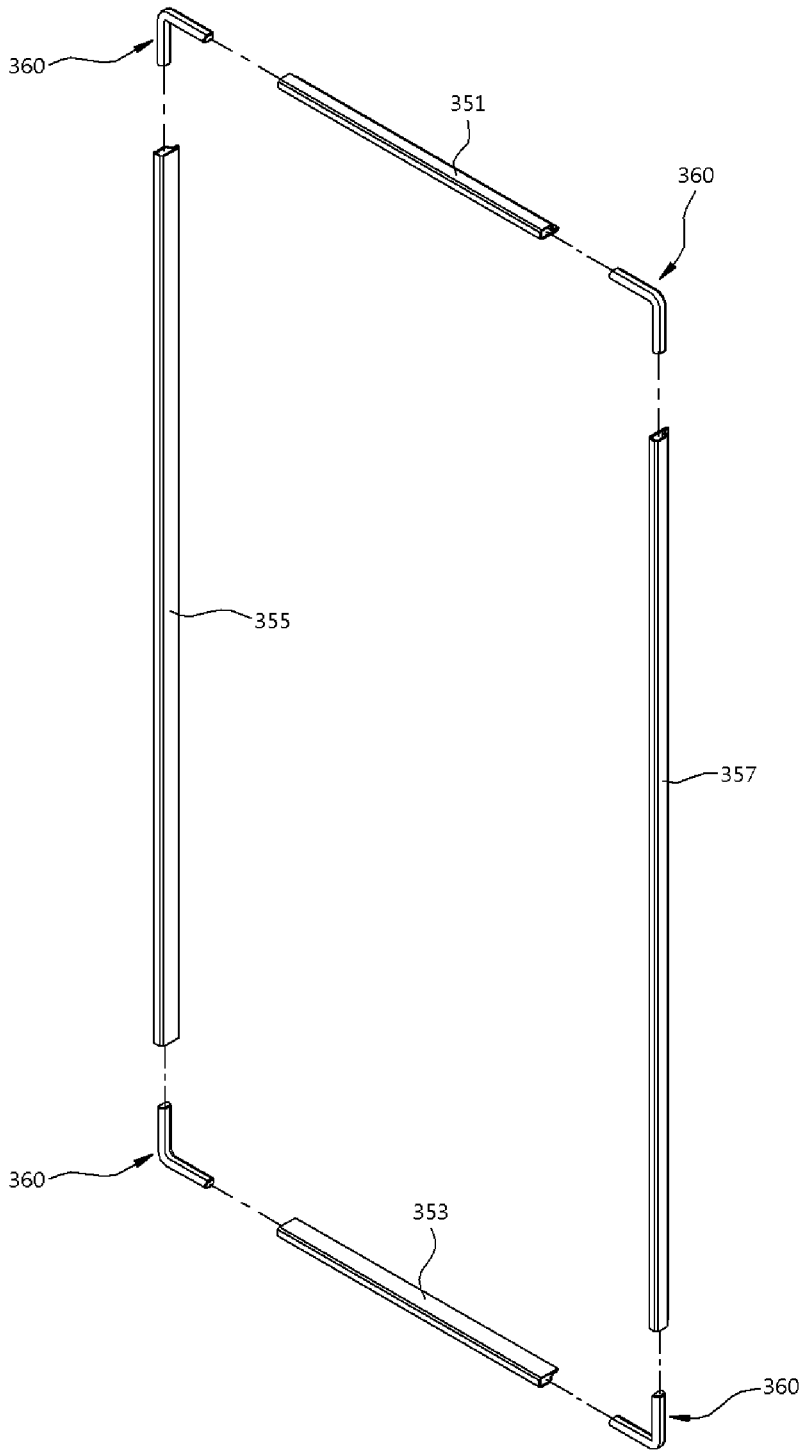
FIG. 39 is a view of the reinforcement frame in accordance with the embodiment of the present invention.
Figure 40:
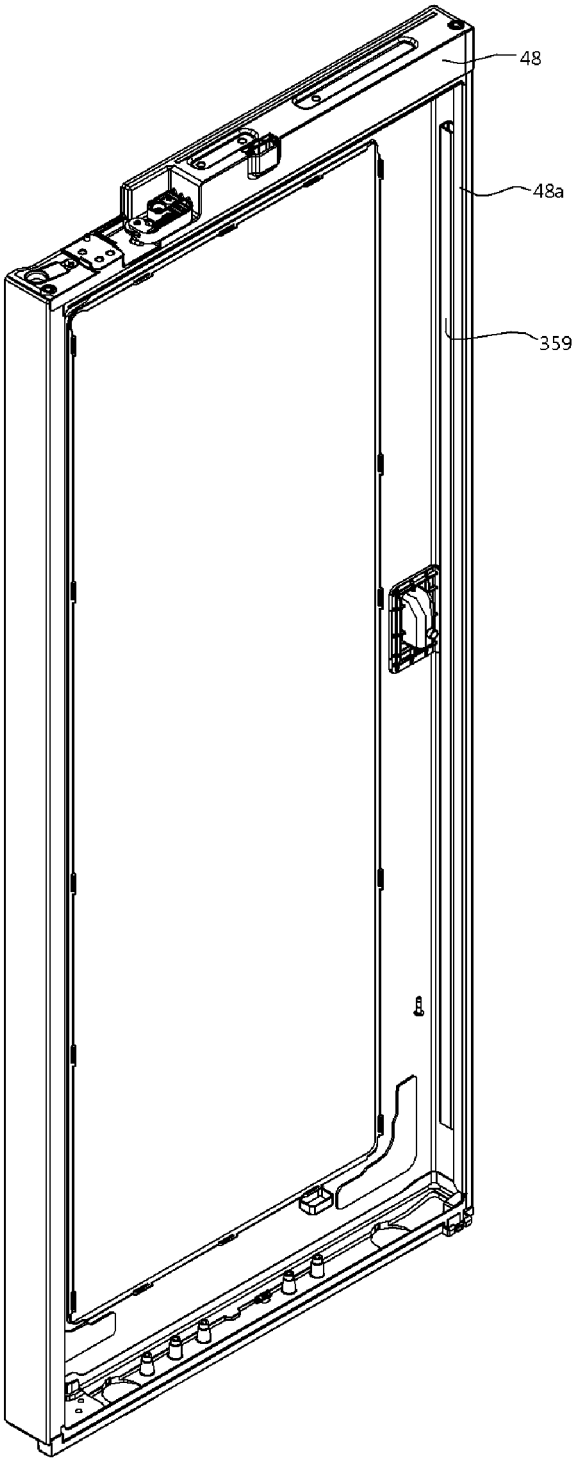
FIG. 40 is a view of a state in which an auxiliary reinforcement frame is coupled to a cabinet, in accordance with the embodiment of the present invention.
Figure 41:
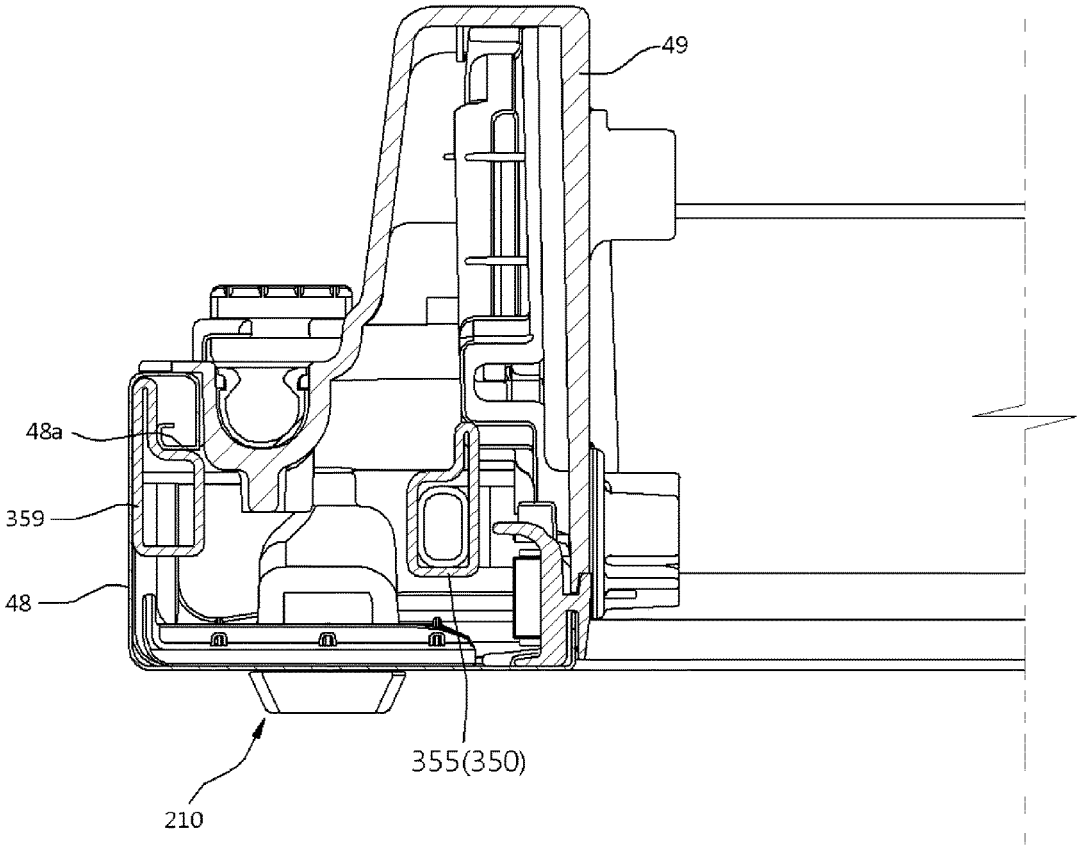
FIG. 41 is a cross-sectional view of a state in which the reinforcement frame in accordance with the embodiment of the present invention is disposed in the first door.
Figure 42:
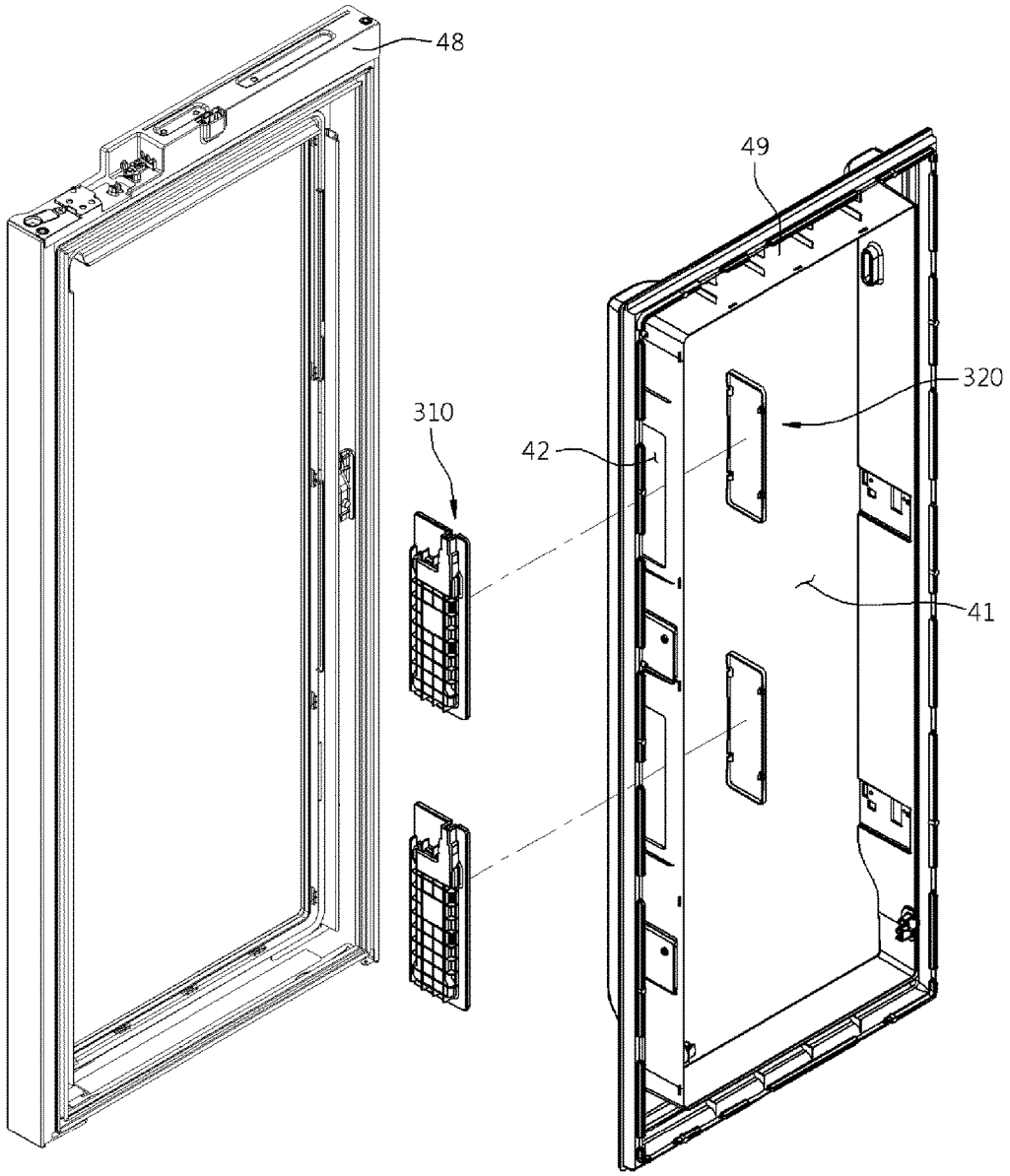
FIG. 42 is a schematic exploded perspective view of the first door in accordance with the embodiment of the present invention.
Figure 43:
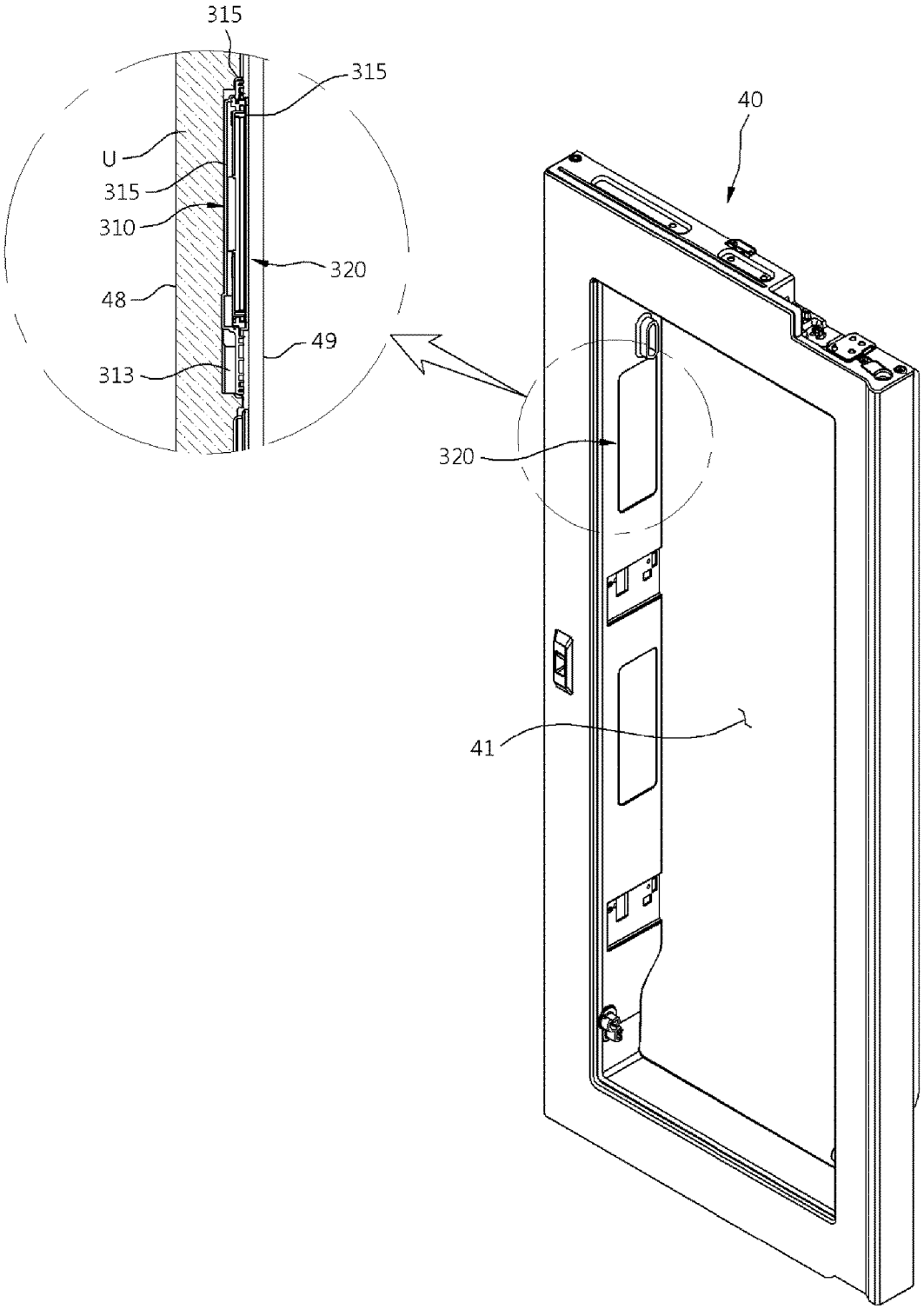
FIG. 43 is a cross-sectional view of a state in which a lamp fixing member is disposed in the first door in accordance with the embodiment of the present invention.

As illustrated in FIGS. 38 and 43, at least one lamp installation hole 42 is disposed in the internal injection-molded body 49 so as to install the lamp 320.

At least one lamp fixing member 310 is disposed between the cabinet 48 and the internal injection-molded body 49 so as to fix the lamp 320.

The lamp fixing member 310 is fixed to the internal injection-molded body 49 so as to correspond to the position of the lamp installation hole 42 disposed in the internal injection-molded body 49 before the insulating material U is foamed between the cabinet 48 and the internal injection-molded body 49. When the lamp fixing member 310 is fixed to the internal injection-molded body 49, the insulating material U is foamed between the cabinet 48 and the internal injection-molded body 49.

Figure 44:
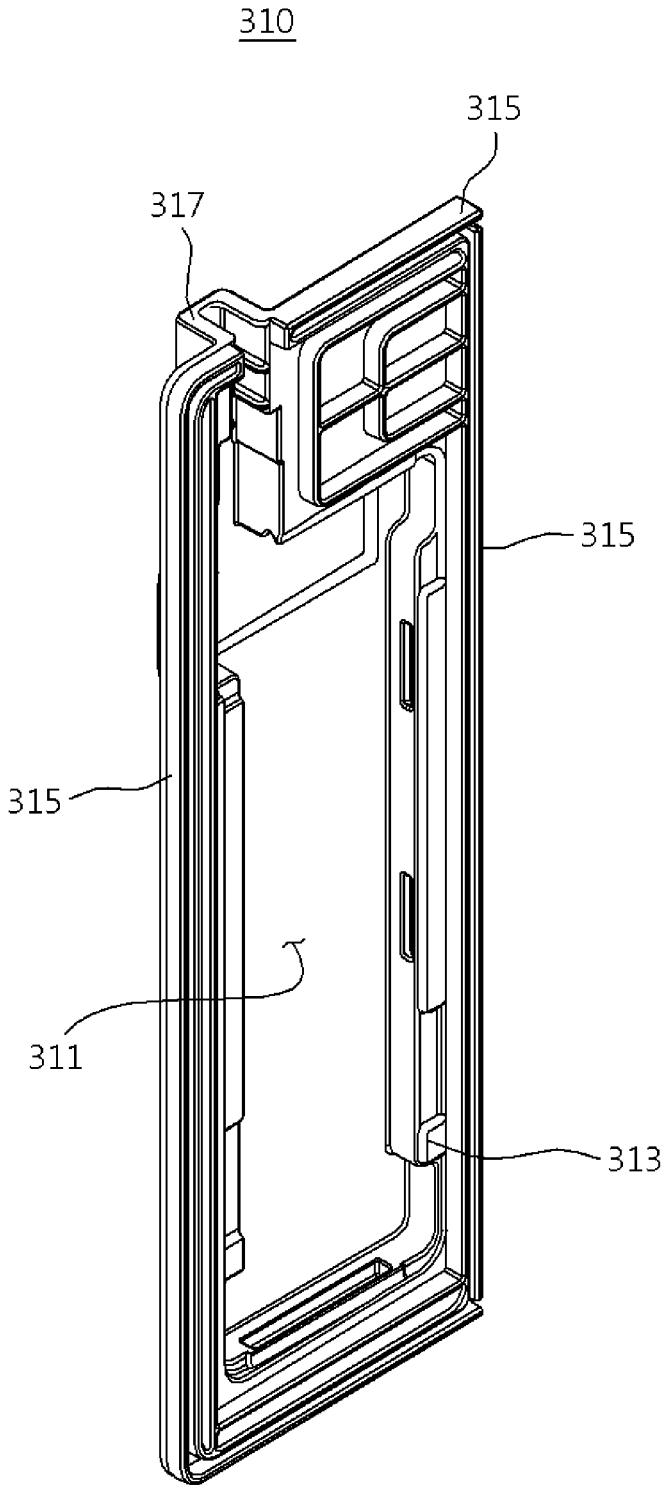
FIG. 44 is a perspective view of the lamp fixing member in accordance with the embodiment of the present invention.

The lamp fixing member 310 includes a seating portion 311 on which the lamp 320 is seated, a plurality of fixing hooks 313 that fix the lamp 320 seated on the seating portion 311, ribs 315 that are disposed on upper and right and left side edges of the lamp fixing member 310 and prevents the insulating material U from penetrating into the seating portion 311, and a wire guide portion 317 that guides a wire W for supplying power so that the lamp 320 may emit light, as illustrated in FIG. 44.

When the lamp fixing member 310 is fixed to the internal injection-molded body 49 and the insulating material U is foamed between the cabinet 48 and the internal injection-molded body 49, the lamp 320 is seated on the seating portion 311 of the lamp fixing member 310 through the lamp installation hole 42.

When the lamp 320 is seated on the seating portion 311, the lamp 320 is fixed to the seating portion 311 by using the plurality of fixing hooks 313.

The ribs 315 may be disposed on the upper and right and left side edges of the lamp fixing member 310 so as to prevent the insulating material U from penetrating into the seating portion 311 through a space between the lamp fixing member 310 and the internal injection-molded body 49 when the insulating material U is foamed between the cabinet 48 and the internal injection-molded body 49 after the lamp fixing member 310 is fixed to the internal injection-molded body 49.

Although the ribs 315 are disposed on the upper and right and left side edges of the lamp fixing member 310, embodiments of the present invention are not limited thereto. The ribs 315 may be disposed on the internal injection-molded body 49 in which the lamp fixing member 310 is disposed, and a separate structure may be disposed between the upper and right and left side edges of the lamp fixing member 310 and the internal injection-molded body 49 so as to prevent penetration of the insulating material U.

Figure 45:
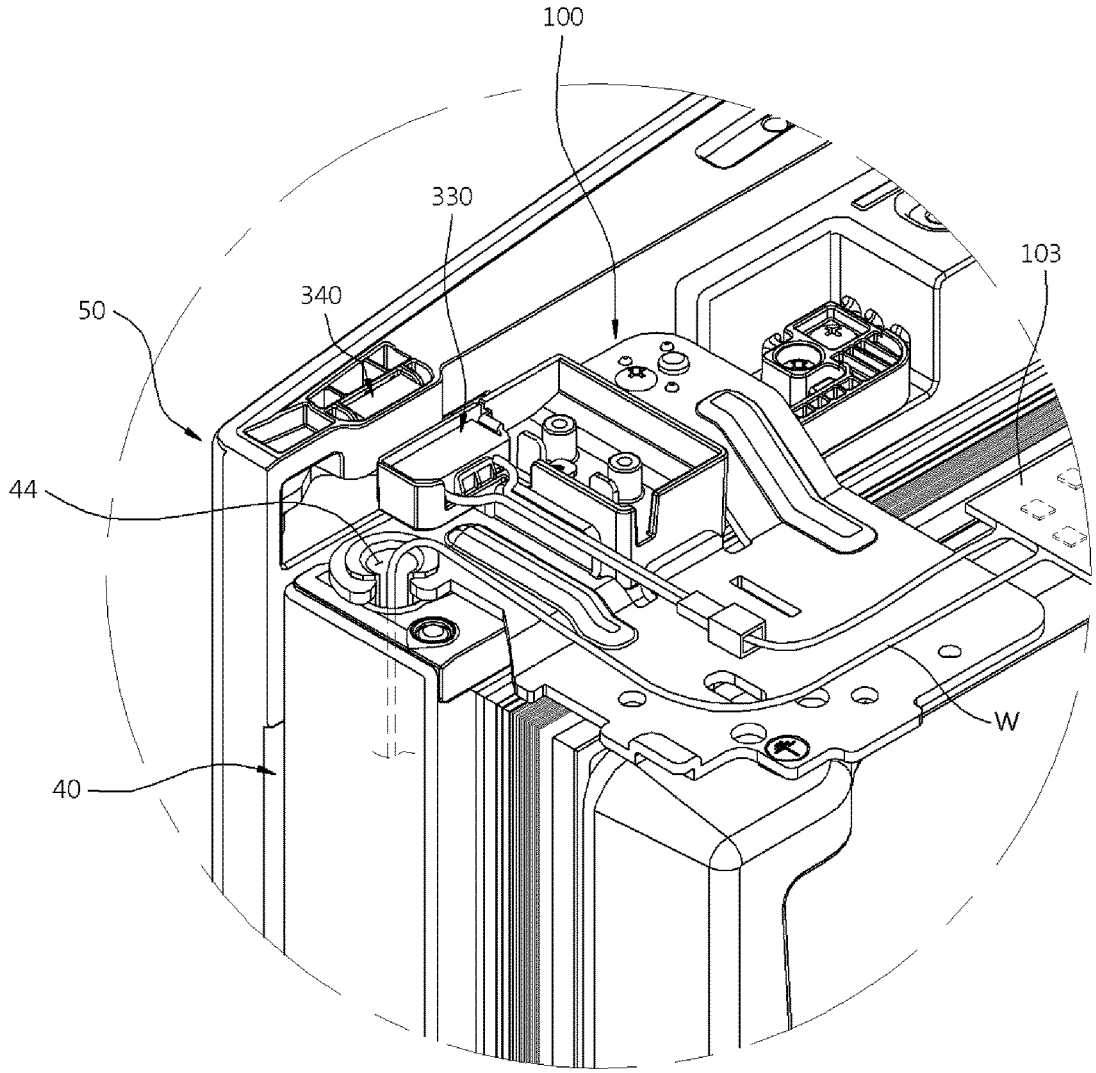
FIG. 45 is a view of a wire that connects electronic apparatus components and a lamp is guided toward a main body through a first hinge hole in accordance with an embodiment of the present invention.

As illustrated in FIG. 45, an opening/closing detection sensor 330 is disposed in the hinge unit 100 disposed in the upper portion of the main body 10 so as to detect opening/closing of the first door 40, and a sensor detection unit 340 is disposed in the upper portion of the second door 50 to correspond to the opening/closing detection sensor 330 so as to transfer the result of detection regarding whether the second door 50 is opened/closed, to the opening/closing detection sensor 330.

A hinge cover 101 (see FIG. 1) that covers the hinge unit 100 not to be exposed to the outside, is disposed in an upper portion of the hinge unit 100, and electronic apparatus components 103 are accommodated in the hinge cover 101 so as to control an operation of the refrigerator.

The opening/closing detection sensor 330 disposed in the hinge unit 100 is connected to the electronic apparatus components 103, and the electronic apparatus components 103 and the lamp 320 are connected to each other by using the wire W so that the opening/closing detection sensor 330 may detect whether the first door 40 is opened/closed and may transfer the result of detection to the electronic apparatus components 103 and the electronic apparatus components 103 supply power to the lamp 320 by using the wire W or cut off the supply of power.

Figure 46:
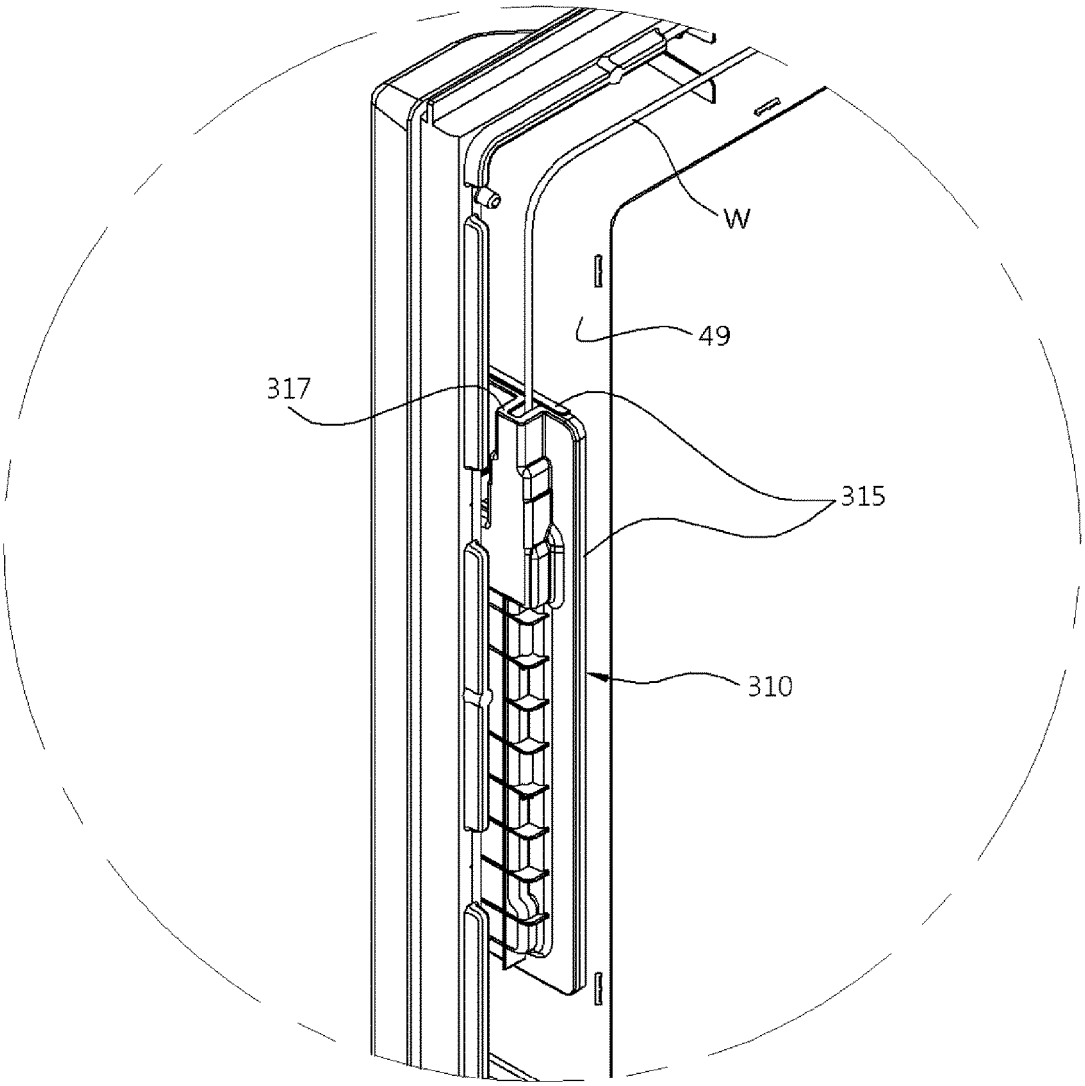
FIG. 46 is a view of a state in which the wire that connects the electronic apparatus components and the lamp is guided by a wire guide portion of the lamp fixing member in accordance with an embodiment of the present invention.

The wire W that connects the electronic apparatus components 103 and the lamp 320 is connected to the electronic apparatus components 103 and is guided into the main body 10 through the first hinge hole 44, as illustrated in FIG. 45. The wire W guided into the main body 10 is guided by the wire guide portion 317 disposed in the lamp fixing member 310 and is connected to the lamp 320, as illustrated in FIG. 46.

The sensor detection unit 340 is disposed in the upper portion of the second door 50, and the opening/closing detection sensor 330 detects a distance at which the sensor detection unit 340 is spaced apart from the opening/closing detection sensor 330, and causes power to be supplied to the lamp 320 or to cut off the supply of power depending on whether the second door 50 is opened/closed.

An operation of the lamp 320 depending on whether each of the first door 40 and the second door 50 is opened, will now be described.

When the first door 40 is opened, the opening/closing detection sensor 330 detects opening of the first door 40 and transfers the result of detection to the electronic apparatus components 103, and the electronic apparatus components 103 supply power to the lamp 320 by using the wire W so that the lamp 320 may emit light.

Since, when the first door 40 is opened, the first door 40 is distant from the refrigerator compartment 21, the user cannot easily identify food stored in the door guard 33 disposed in the opening 41 by using only light emitted from an inside of the refrigerator compartment 21. However, when the lamp 320 disposed on the sidewalls of the opening 41 emits light, the user may easily identify food stored in the door guard 33 disposed in the opening 41 so that, even when there is no light around the refrigerator, the user does not feel inconvenience.

When the first door 40 is closed, the opening/closing detection sensor 330 detects closing of the first door 40 and transfers the result of detection to the electronic apparatus components 103. The electronic apparatus components 103 cut off power supplied to the lamp 320 by using the wire W.

When the second door 50 is opened, the opening/closing detection sensor 330 detects a distance at which the sensor detection unit 340 is spaced apart from the opening/closing detection sensor 330, and transfers the result of detection that the second door 50 is opened, to the electronic apparatus components 103, and the electronic apparatus components 103 supply power to the lamp 320 by using the wire W so that the lamp 320 may emit light.

When the second door 50 is opened, the user may identify food stored in the door guard 33 disposed in the opening 41 of the first door 40 by using light emitted from the inside of the refrigerator compartment 21. However, when food or an article having a large height is disposed in the refrigerator compartment 21, light emitted from the inside of the refrigerator compartment 21 is cut off, and the user may not easily identify food stored in the door guard 33. However, when the lamp 320 disposed on the sidewalls of the opening 41 emits light, the user may easily identify food stored in the door guard 33.

When the second door 50 is closed, the opening/closing detection sensor 330 detects a distance between the opening/closing detection sensor 330 and the sensor detection unit 340 and transfers the result of detection that the second door 50 is closed, to the electronic apparatus components 103, and the electronic apparatus components 103 cut off power supplied to the lamp 320 by using the wire W.

As illustrated in FIG. 1, the freezer compartment door 60 is configured as a drawer type door that moves in the forward/backward direction by using the sliding method.

A storing unit 400 is coupled to a rear side of the freezer compartment door 60. The storing unit 400 is inserted into and drawn from the inside of the freezer compartment 23 by using the sliding method.

In order to guide the storing unit 400 to be inserted into and drawn from the inside of the freezer compartment 23, a guide rail 13 is coupled to both sidewalls of the inside of the freezer compartment 23 in which the storing unit 400 is accommodated.

Figure 47:
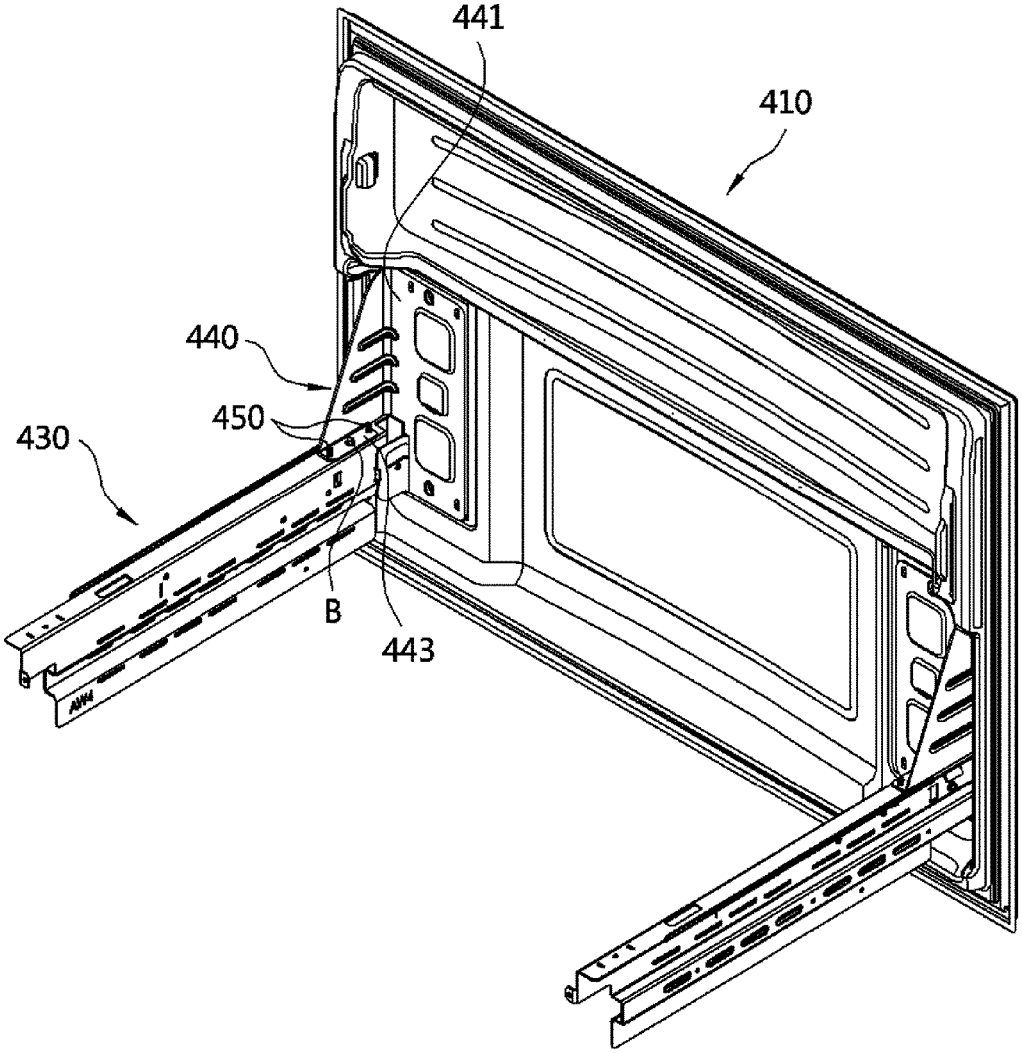
FIG. 47 is a view of a part of a storing unit in accordance with an embodiment of the present invention.
Figure 48:
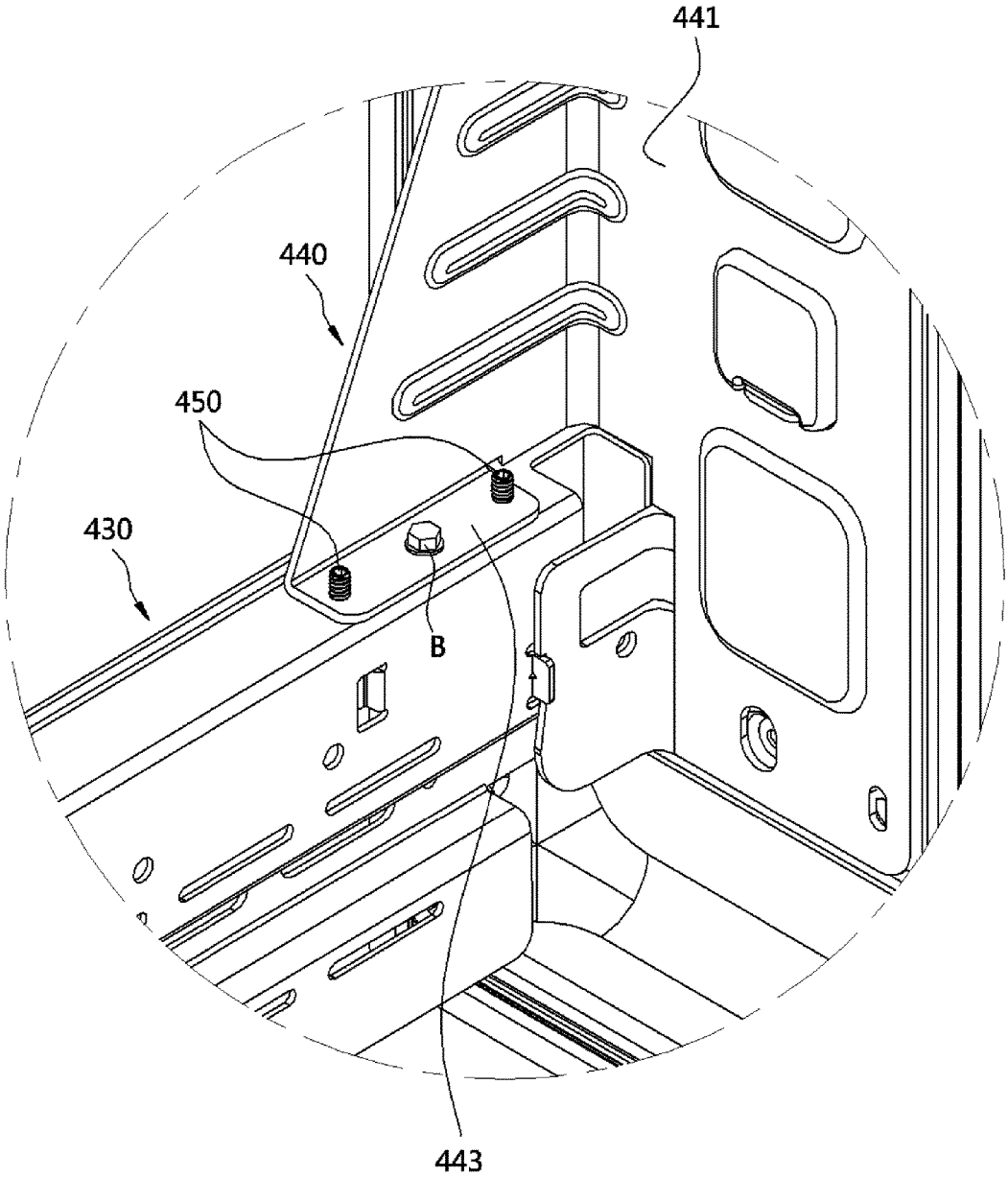
FIG. 48 is a view of a portion in which a slide rail and a hanger are coupled to each other, in accordance with an embodiment of the present invention.

As illustrated in FIG. 1 and FIGS. 47 and 48, the storing unit 400 includes a panel 410 coupled to the rear side of the freezer compartment door 60, a storage box 420 which is disposed at a rear side of the panel 410 and in which food is stored, a slide rail 430 that is coupled to the rear side of the panel 410, supports a lower portion of sides of the storage box 420, and is guided by the guide rail 13, a hanger 440 that connects the panel 410 and the slide rail 430, and at least one tilting adjustment unit 450 that adjusts the hanger 440 to be tilted from the slide rail 430.

The hanger 440 includes a panel coupling portion 441 coupled to the panel 410 and a rail coupling portion 443 coupled to the slide rail 430.

Figure 49:
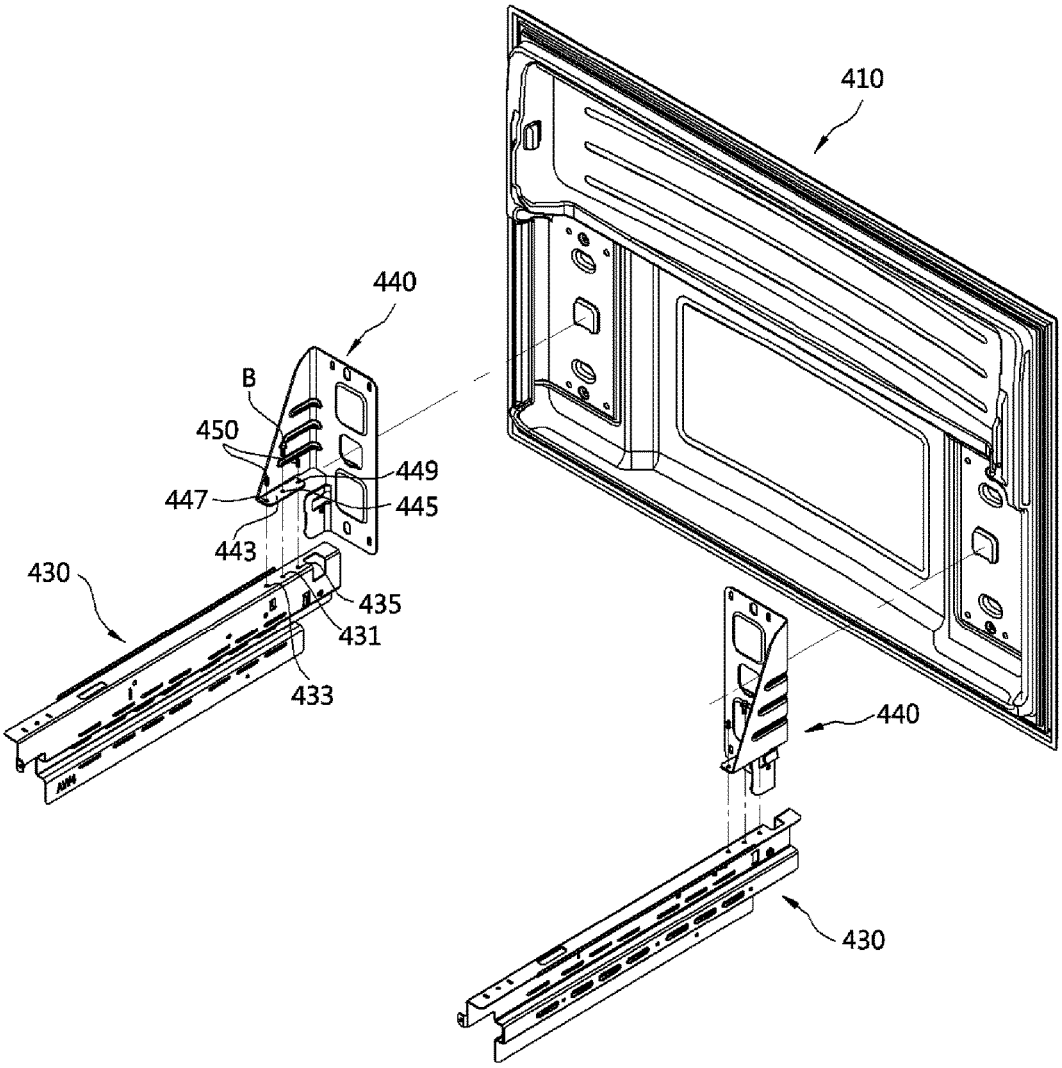
FIG. 49 is an exploded perspective view of the storing unit illustrated in FIG. 40.
Figure 50:
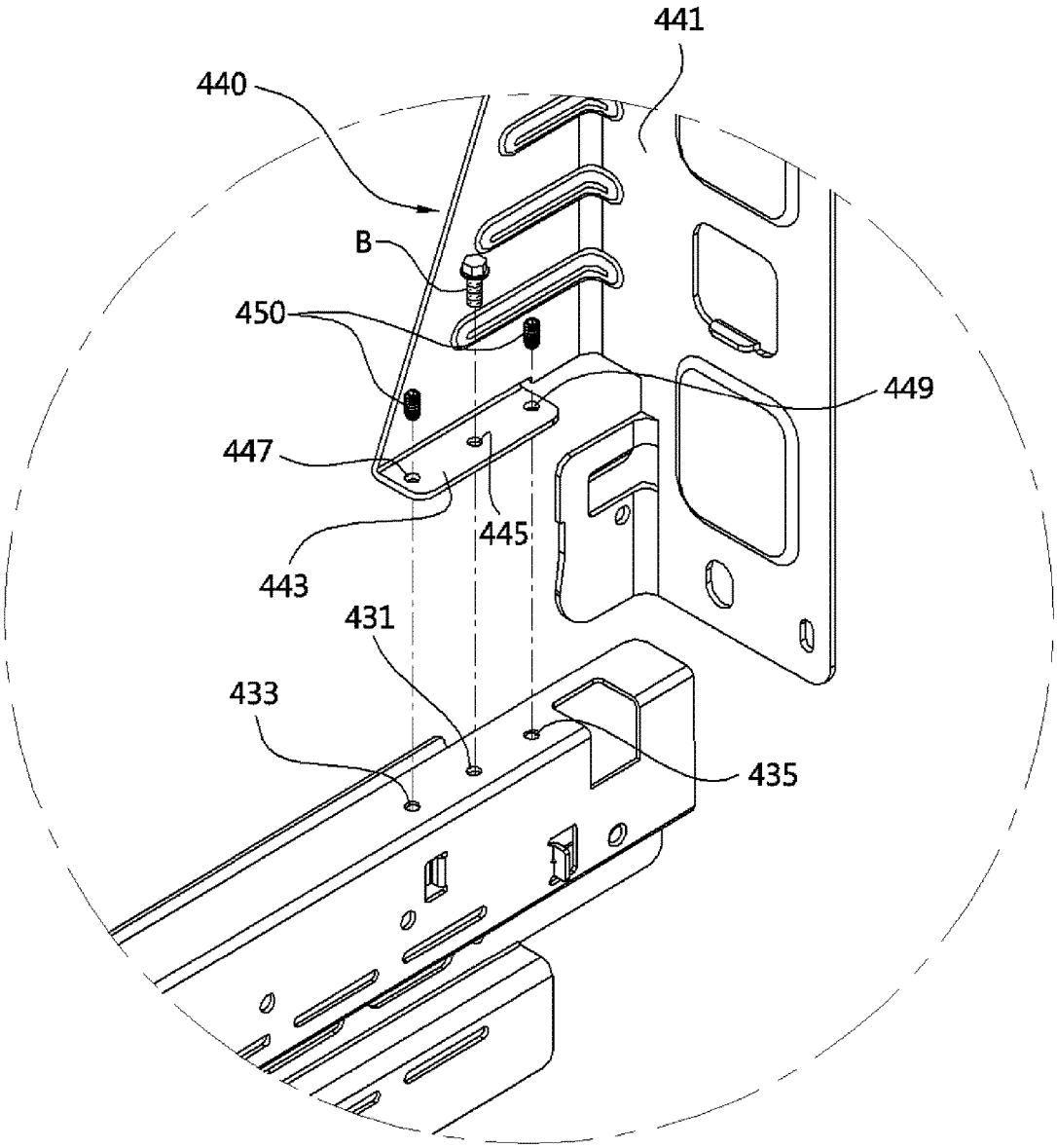
FIG. 50 is a view of a state in which the slide rail and the hanger are coupled to each other, in accordance with an embodiment of the present invention.

As illustrated in FIGS. 49 and 50, a first fastening member insertion hole 445 through which the hanger 440 and the slide rail 430 are coupled to each other, is disposed in the rail coupling portion 443. A second fastening member insertion hole 431 is disposed in the slide rail 430 to correspond to the first fastening member insertion hole 445, and the hanger 440 and the slide rail 430 are coupled to each other by using the fastening member B inserted into the first fastening member insertion hole 445 and the second fastening member insertion hole 431.

The first fastening member insertion hole 445 is disposed in the center of the rail coupling portion 443. A first tilting adjustment hole 447 and a second tilting adjustment hole 449 into which the tilting adjustment unit 450 is inserted, are disposed in a front end and a rear end of the rail coupling portion 443.

A first fixing groove 433 and a second fixing groove 435 into which the tilting adjustment unit 450 inserted into the first tilting adjustment hole 447 and the second tilting adjustment hole 449 is rotatably fixed to prevent from moving, are disposed in the slide rail 430 to correspond to the first tilting adjustment hole 447 and the second tilting adjustment hole 449.

Since the hanger 440 and the slide rail 430 are coupled in an upper portion of the slide rail 430, the tilting adjustment unit 450 inserted into the first tilting adjustment hole 447 and the second tilting adjustment hole 449 disposed in the rail coupling portion 443 is inserted in the upper portion of the rail coupling portion 443. The first fixing groove 433 and the second fixing groove 435 disposed in the slide rail 430 are disposed in a top surface of the slide rail 430, and a part of a bottom end of the tilting adjustment unit 450 inserted into the first tilting adjustment hole 447 and the second tilting adjustment hole 449 is inserted into the first fixing groove 433 and the second fixing groove 435 and is fixed thereto.

Figure 51:
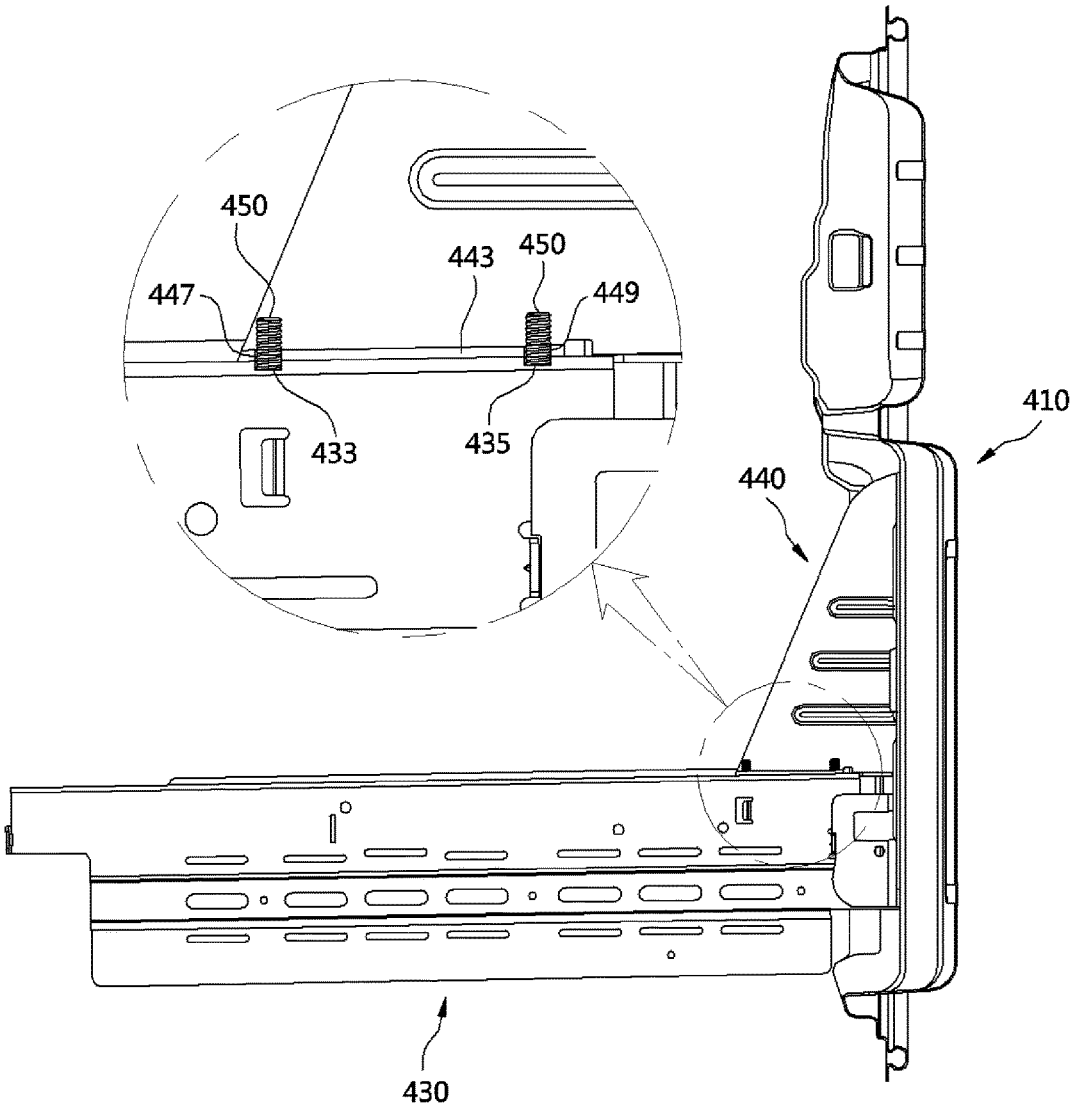
FIGS. 51 through 53 are views of an operation in which the hanger is tilted by a tilting adjustment unit, in accordance with an embodiment of the present invention.
Figure 52:
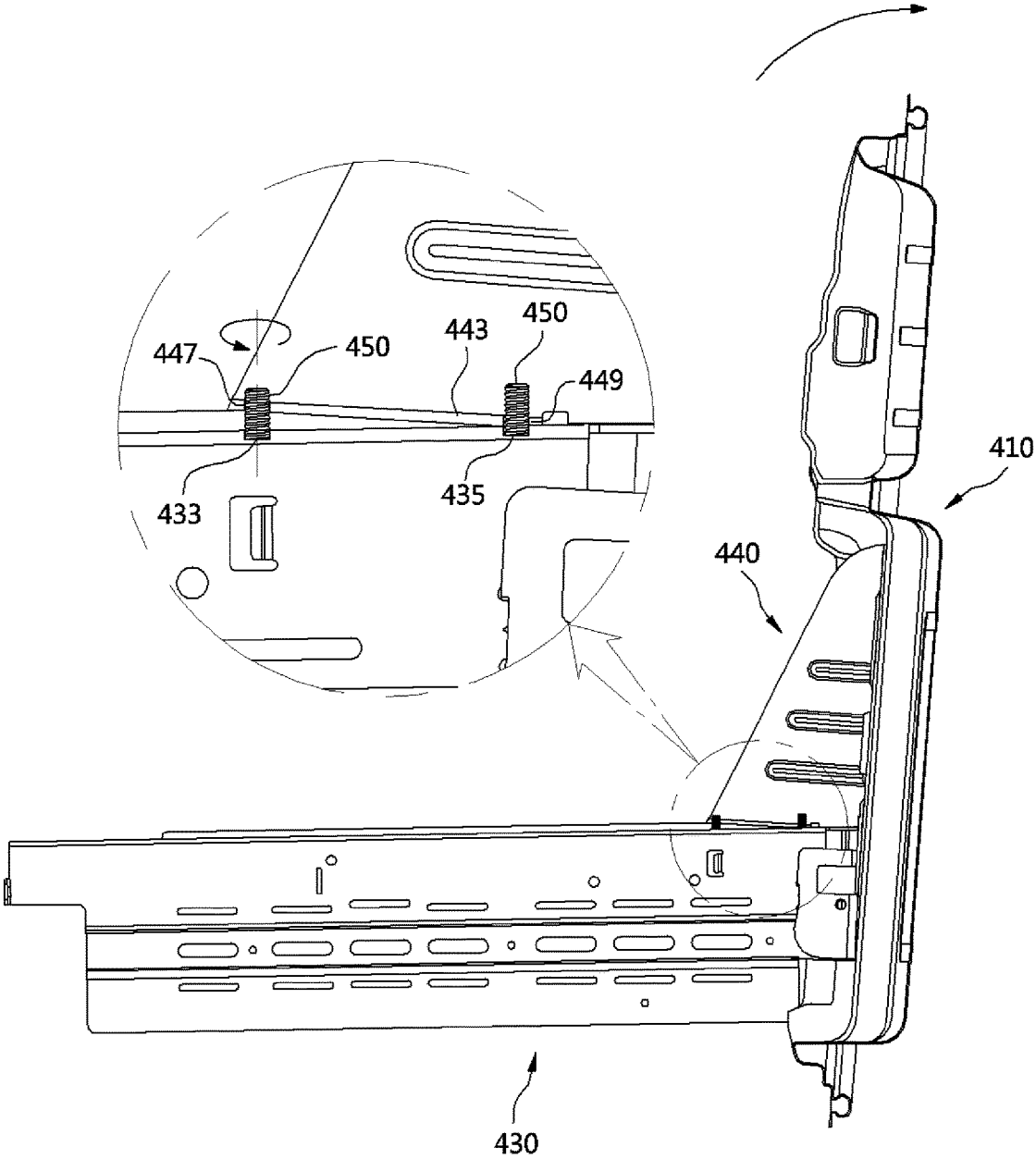
Figure 53:
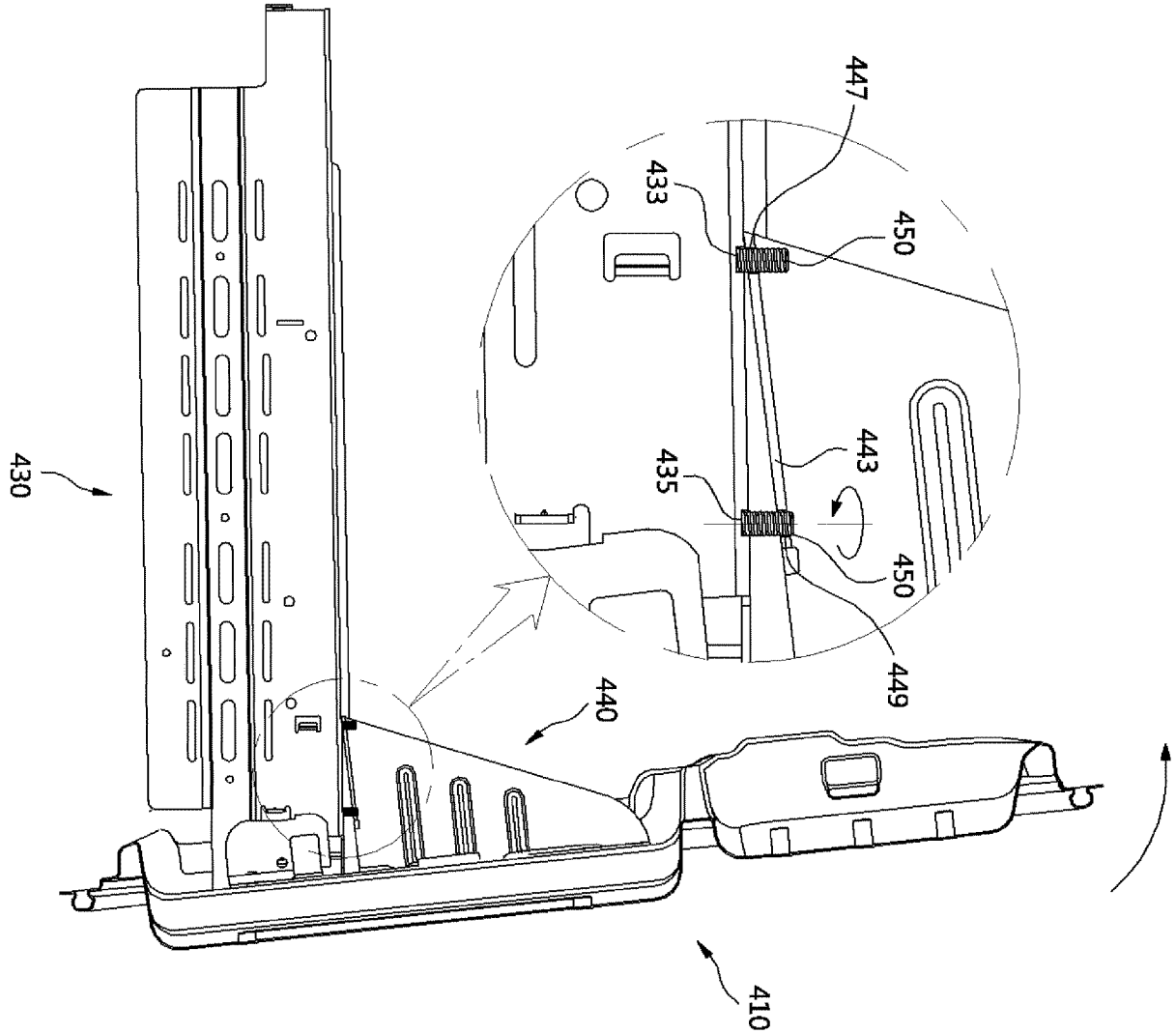

Next, an operation in which the hanger 440 is tilted from the slide rail 430 by using the tilting adjustment unit 450, will be described with reference to FIGS. 51 through 53.

In order to allow the hanger 440 to be tilted from the slide rail 430 by using the tilting adjustment unit 450, when tilting is finished after removing the fastening member B that couples the hanger 440 and the slide rail 430 each other, the fastening member B needs to be fastened again. Thus, in the drawings that illustrate an operation in which the hanger 440 is tilted from the slide rail 430 by using the tilting adjustment unit 450, the fastening member B, and the first fastening member insertion hole 445, and the second fastening member insertion hole 431 into which the fastening member B is inserted, are deleted.

When sealing of a bottom end of the freezer compartment door 60 is defective and cold air in the freezer compartment 23 leaks toward the outside, in order to improve defective sealing, when the tilting adjustment unit 450 inserted into the first tilting adjustment hole 447 is rotated in the state of FIG. 45, as illustrated in FIG. 46, the bottom end of the tilting adjustment unit 450 is rotatably fixed into the first fixing groove 433. Thus, the first tilting adjustment hole 447 is moved in an upward direction of the tilting adjustment unit 450 and thus, the front end of the rail coupling portion 443 is spaced apart from the slide rail 430 and is rotated about the second tilting adjustment hole 449 upward.

When the hanger 440 is rotated about the second tilting adjustment hole 449 upward, in the drawings, the panel 410 coupled to the hanger 440 is rotated clockwise.

When the panel 410 is rotated clockwise, the freezer compartment door 60 to which the panel 410 is coupled, is rotated clockwise. Thus, the bottom end of the freezer compartment door 60 is moved in a downward direction compared to a case before the freezer compartment door 60 is rotated so that defective sealing of the bottom end of the freezer compartment door 60 may be prevented.

When sealing of the top end of the freezer compartment door 60 is defective and cold air in the freezer compartment 23 leaks toward the outside, in order to improve defective sealing, when the tilting adjustment unit 450 inserted into the second tilting adjustment hole 449 is rotated in the state of FIG. 45, as illustrated in FIG. 47, the bottom end of the tilting adjustment unit 450 is rotatably fixed into the second fixing groove 435. Thus, the second tilting adjustment hole 449 is moved in the upward direction of the tilting adjustment unit 450 and thus, a rear end of the rail coupling portion 443 is spaced apart from the slide rail 430 and rotated about the first tilting adjustment hole 447 upward.

When the hanger 440 is rotated about the first tilting adjustment hole 447 upward, in the drawings, the panel 410 coupled to the hanger 440 is rotated counterclockwise.

When the panel 410 is rotated counterclockwise, since the freezer compartment door 60 to which the panel 410 is coupled, is rotated counterclockwise, the top end of the freezer compartment door 60 is moved in an upward direction compared to the case before the freezer compartment door 60 is rotated so that defective sealing of the top end of the freezer compartment door 60 may be prevented.

Next, another embodiment in which positions of the tilting adjustment hole and the fixing groove are changed, will be described.

Figure 54:
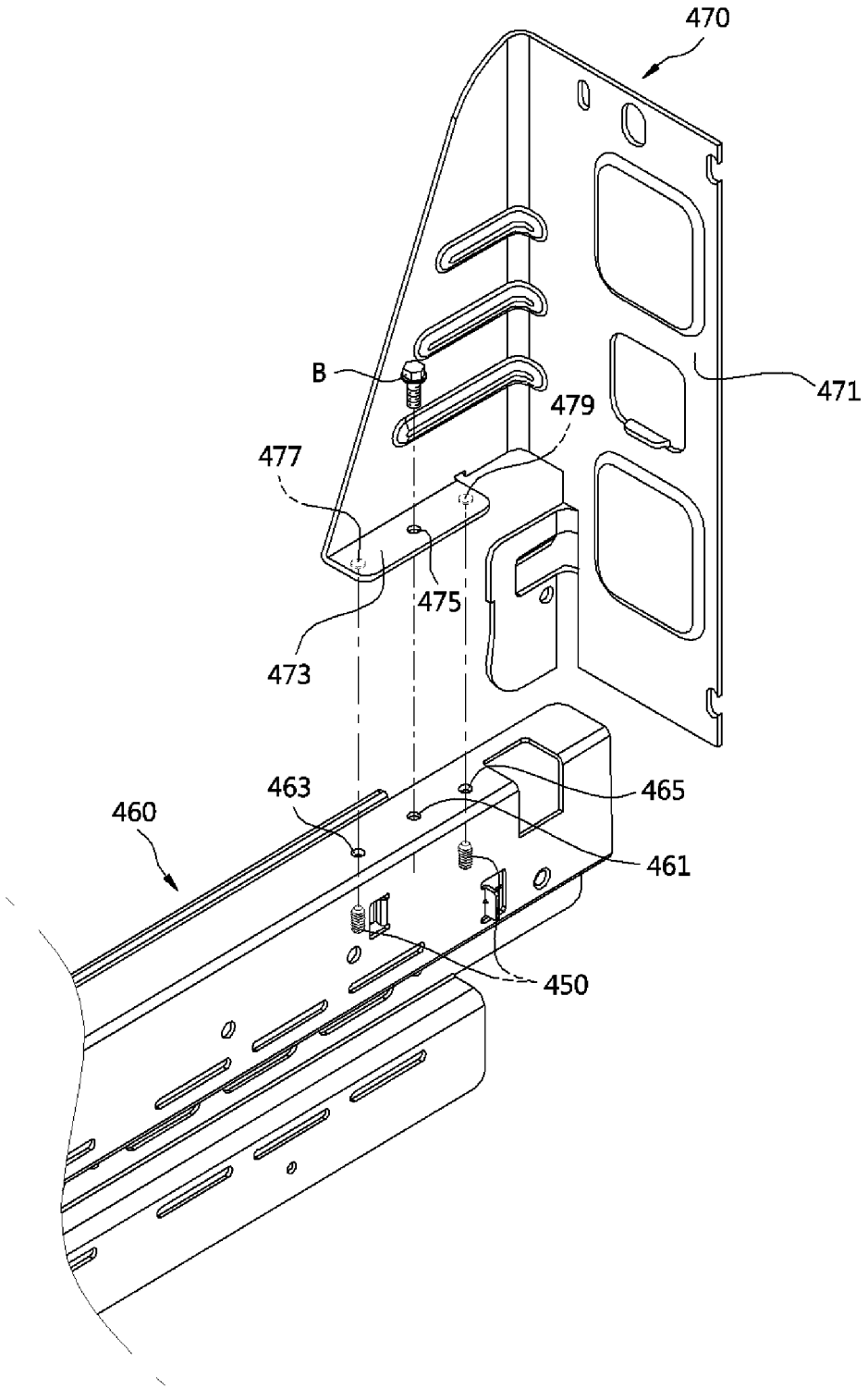
FIG. 54 is a view of a state in which the slide rail and the hanger are coupled to each other, in accordance with another embodiment of the present invention.

As illustrated in FIG. 54, a first fastening member insertion hole 475 through which a hanger 470 and a slide rail 460 are coupled to each other, is disposed in a rail coupling portion 473, and a second fastening member insertion hole 461 is disposed in the slide rail 460 to correspond to the first fastening member insertion hole 475 so that the hanger 470 and the slide rail 460 may be coupled to each other by using the fastening member B inserted into the first fastening member insertion hole 475 and the second fastening member insertion hole 461.

The first fastening member insertion hole 475 is disposed in the center of the rail coupling portion 473. A first tilting adjustment hole 463 and a second tilting adjustment hole 465 into which the tilting adjustment unit 450 is inserted, are disposed in the slide rail 460 in the position corresponding to the front end and the rear end of the rail coupling portion 473.

A first fixing groove 477 and a second fixing groove 479 into which the tilting adjustment unit 450 inserted into the first tilting adjustment hole 463 and the second tilting adjustment hole 465 is rotatably fixed to prevent from moving, are disposed in the rail coupling portion 473 in positions corresponding to the first tilting adjustment hole 463 and the second tilting adjustment hole 465.

Since the hanger 470 and the slide rail 460 are coupled in an upper portion of the slide rail 460, the tilting adjustment unit 450 inserted into the first tilting adjustment hole 463 and the second tilting adjustment hole 465 disposed in the slide rail 460 is inserted in the lower portion of the slide rail 460. The first fixing groove 477 and the second fixing groove 479 disposed in the rail coupling portion 473 are disposed in a bottom surface of the rail coupling portion 473, and a part of a top end of the tilting adjustment unit 450 inserted into the first tilting adjustment hole 463 and the second tilting adjustment hole 465 is inserted into the first fixing groove 477 and the second fixing groove 479 and is fixed thereto.

An operation in which the hanger 470 is tilted from the slide rail 460 by using the tilting adjustment unit 450, is merely different from the operation illustrated in FIGS. 45 through 47 in positions of the first tilting adjustment hole 463 and the second tilting adjustment hole 465 and positions of the first fixing groove 477 and the second fixing groove 479. Since, when the tilting adjustment unit 450 inserted into the first tilting adjustment hole 463 is rotated, the hanger 470 is rotated about the second tilting adjustment hole 465 upward and when the tilting adjustment unit 450 inserted into the second tilting adjustment hole 465 is rotated, the hanger 470 is rotated about the first tilting adjustment hole 463 upward, a detailed description of the operation will be omitted.

Figure 55:
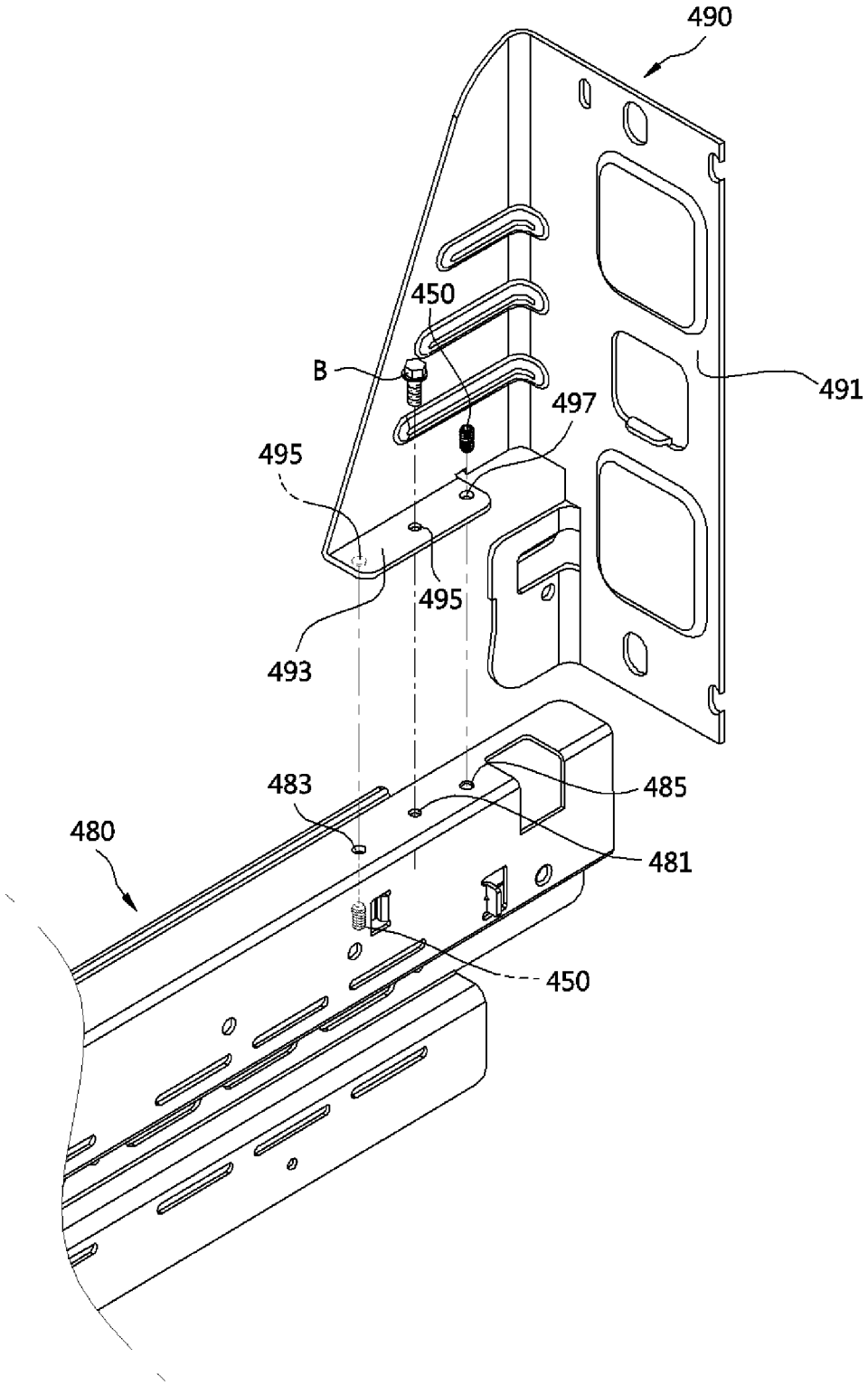
FIG. 55 is a view of a state in which the slide rail and the hanger are coupled to each other, in accordance with still another embodiment of the present invention.
Figure 56:
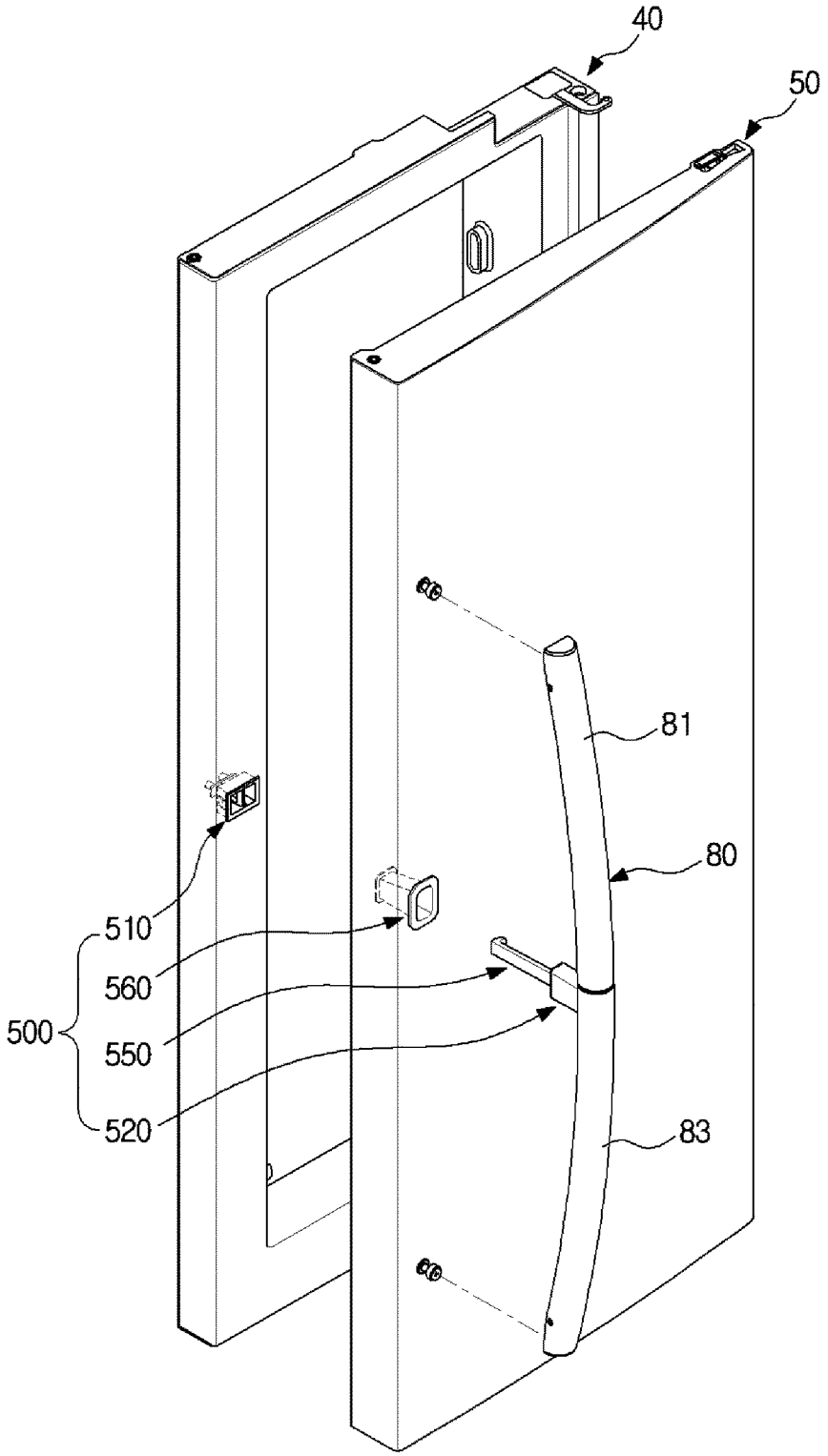
FIG. 56 is a view of the first door and the second door to which a latch device in accordance with another embodiment of the present invention is applied.
Figure 57:
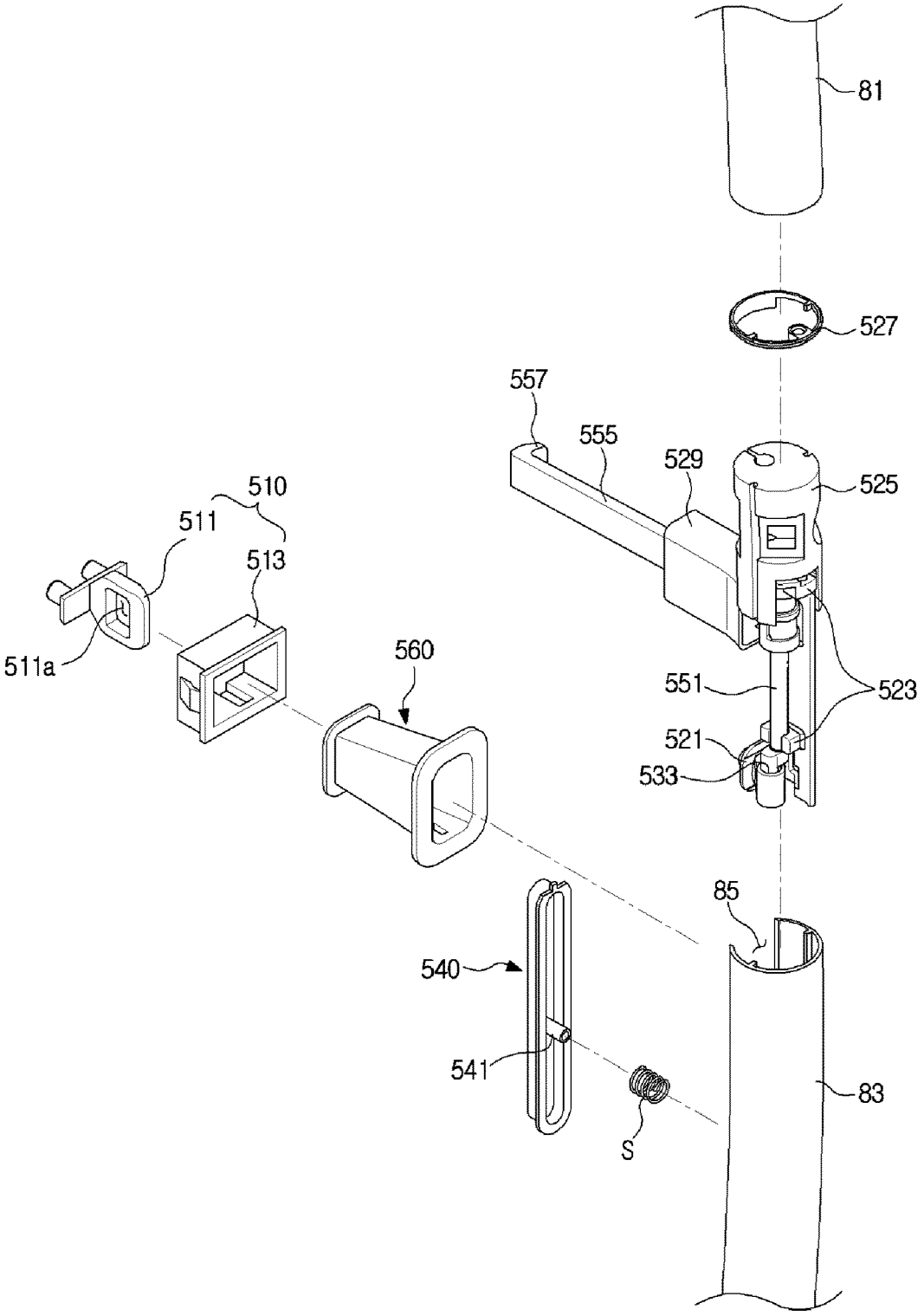
FIGS. 57 and 58 are exploded perspective view of the latch device of FIG. 56.
Figure 58:
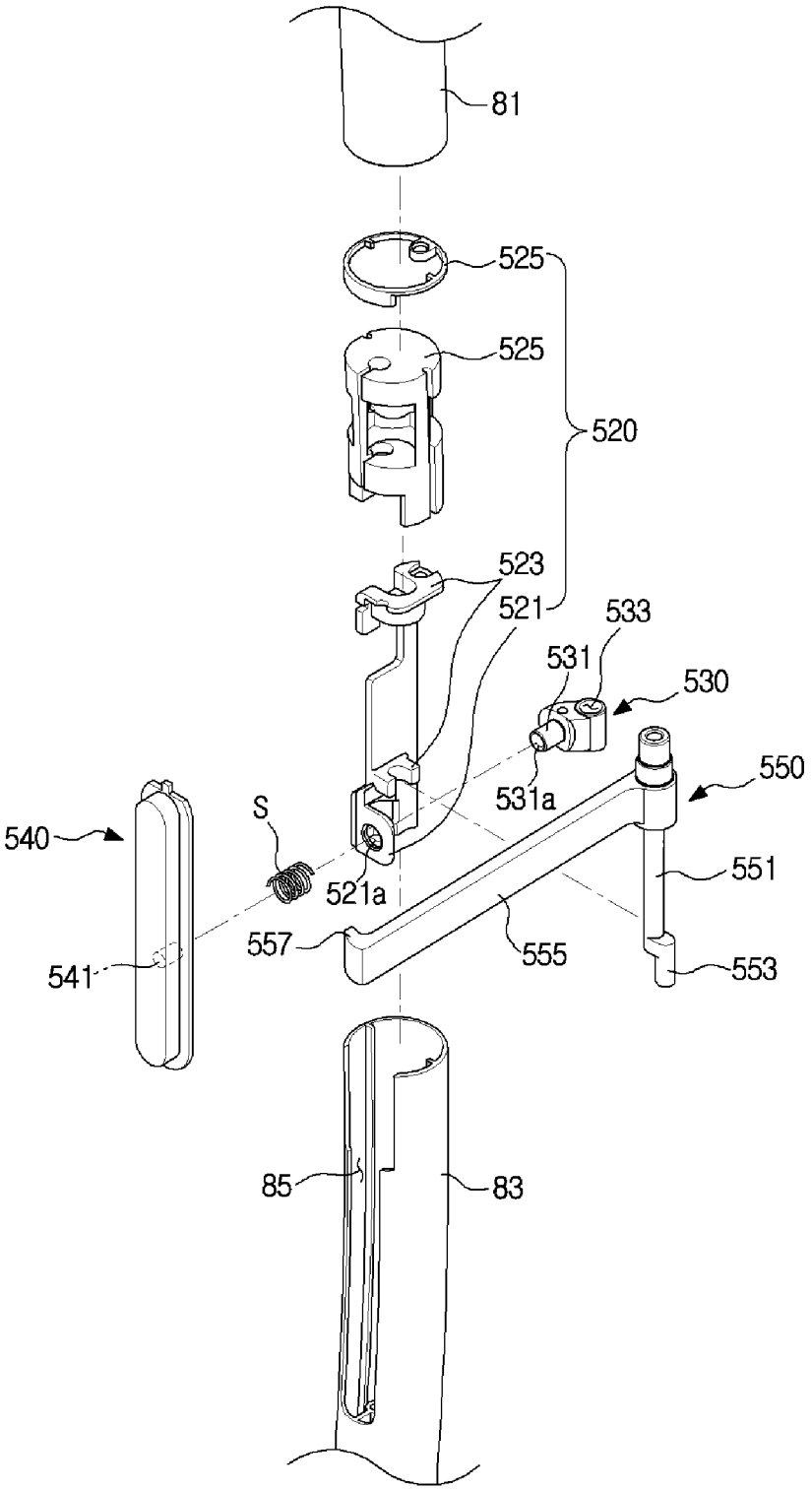

As illustrated in FIG. 55, a first fastening member insertion hole 495 through which a hanger 490 and a slide rail 480 are coupled to each other, is disposed in a rail coupling portion 493. A second fastening member insertion hole 481 is disposed in the slide rail 480 to correspond to the first fastening member insertion hole 495 so that the hanger 490 and the slide rail 480 may be coupled to each other by using the fastening member B inserted into the first fastening member insertion hole 495 and the second fastening member insertion hole 481.

The first fastening member insertion hole 495 is disposed in the center of the rail coupling portion 493. A second tilting adjustment hole 497 into which the tilting adjustment unit 450 is inserted, is disposed in the rear end of the rail coupling portion 493, and a first tilting adjustment hole 483 into which the tilting adjustment unit 450 is inserted, is disposed in the slide rail 480 in a position corresponding to the front end of the rail coupling portion 493.

A first fixing groove 499 into which the tilting adjustment unit 450 inserted into the first tilting adjustment hole 483 is rotatably fixed, is disposed in the front end of the rail coupling portion 493 to correspond to a position corresponding to the first tilting adjustment hole 483. The second fixing groove 485 into which the tilting adjustment unit 450 inserted into the second tilting adjustment hole 497 is rotatably fixed, is disposed in the slide rail 480 in a position corresponding to the second tilting adjustment hole 497.

Since the hanger 490 is coupled in an upper portion of the slide rail 480, the tilting adjustment unit 450 is inserted into a lower portion of the first tilting adjustment hole 483 disposed in the slide rail 480, and the tilting adjustment unit 450 is inserted into an upper portion of the second tilting adjustment hole 497 disposed in the rail coupling portion 493.

The first fixing groove 499 disposed in the rail coupling portion 493 is disposed in a bottom surface of the rail coupling portion 493 so that a part of a top end of the tilting adjustment unit 450 inserted into the first tilting adjustment hole 483 may be inserted into and fixed into the first fixing groove 499. The second fixing groove 485 disposed in the slide rail 480 is disposed in a top surface of the slide rail 480 so that a part of a bottom end of the tilting adjustment unit 450 inserted into the second tilting adjustment hole 497 may be inserted into and fixed into the second fixing groove 485.

An operation in which the hanger 490 is tilted from the slide rail 480 by using the tilting adjustment unit 450, is merely different from the operation illustrated in FIGS. 45 through 47 in positions of the first tilting adjustment hole 483 and the second tilting adjustment hole 497 and positions of the first fixing groove 499 and the second fixing groove 485. Since, when the tilting adjustment unit 450 inserted into the first tilting adjustment hole 483 is rotated, the hanger 490 is rotated about the second tilting adjustment hole 497 upward and when the tilting adjustment unit 450 inserted into the second tilting adjustment hole 497 is rotated, the hanger 490 is rotated about the first tilting adjustment hole 483 upward, a detailed description of the operation will be omitted.

The following description will be made in relation to a latch device in accordance with another embodiment of the present invention, which allows the first door and the second door 50 to be selectively opened and closed.

Referring to FIGS. 56 to 59, the second door 50 is provided with a handle 80 to which a latch device 500 is coupled to selectively open and close the first door 40 and the second door 50.

The handle 80 is coupled to a front side of the second door 50, and the latch device 500 is coupled to a rear side of the handle 80 with some portion thereof accommodated at an inside of the handle 80, so as to fix the second door 50 to the first door 40 and release the second door 50 from being fixed to the first door 40.

The handle 80 includes a upper handle 81 and a lower handle 83, and the lower handle 83 is provided at a rear surface thereof with an opening 85 allowing the portion accommodated at an inside of the handle 80 to be protruded from the rear side of the handle 80.

The latch device 500 includes a fixing unit 510 buried inside a front side of the first door 40, a support 520 coupled to the handle 80 while accommodated in the handle 80, a connection member 530 provided to be movable forward and backward at an inside of the handle 80, a handle lever 540 disposed on the rear side of the handle 80 and allowing the connection member 530 to move forward, a rotation unit 550 hung and released with/from the fixing unit 510 by being rotated by the connection member 530 leftward and rightward (when viewed at a front of the refrigerator), and a guide 560 buried inside the second door 50 to guide the rotation unit 550 to be hung and released with/from the fixing unit 510 by passing through the second door 50.

The fixing unit 510 includes a hanging portion 511 in which a hanging hook 557 provided on a locking portion 555 of the rotation unit 550, which is to be described later, is hung and the hanging of which is released, and an accommodation portion 513 exposed to an outside of the front side of the first door 40 and opened at a front side thereof to form a space in which the locking portion 555 of the rotation unit 550 is movable leftward and rightward.

The hanging portion 511 is provided with a hanging hole 511*a* in which the hanging hook 557 is hung and the hanging of which is released when the locking portion 555 is rotated leftward and rightward.

The support 520 is coupled while accommodated in the handle 80, and the handle 80 is provided with an empty space at an inside thereof to accommodate the support 520.

The support 520 includes a connection member coupling portion 521 to which the connection member 530 is coupled so as to be movable forward and backward, a rotation unit coupling portion 523 to which the rotation unit 550 is rotatably coupled, a handle reinforcing member 525 to reinforce the strength of the handle 80, a handle ring 527 coupled to the handle reinforcing member 525 such that the upper handle 81 is connected to the lower handle 83, and a guide portion 529 guiding to prevent the locking portion 555 of the rotation unit 550 exposed from the rear side of the handle 80 from being exposed to the outside.

The connection member coupling portion 521 is provided with a connection member coupling hole 521*a* into which a coupling protrusion 531 of the connection member 530 is inserted and moved forward and backward.

The guide portion 529 allows the locking portion 555 of the rotation unit 550 coupled to the rotation unit coupling portion 523 to be hung and released with/from the fixing unit 510 provided on the first door 40 by passing through the second door 50 without being exposed to the outside between the handle 80 and the second door 50.

The guide portion 529 has a space formed in leftward and rightward directions allowing the locking portion 555 to move leftward and rightward. The guide portion 529 communicates with the guide 560 buried in the second door 50.

The connection member 530 includes a coupling protrusion 531 coupled to the connection member coupling portion 521 of the support 520 so as to be movable forward and backward, and a rotation unit coupling hole 533 to which the rotation unit 550 is coupled.

The coupling protrusion 531 is inserted into the connection member coupling hole 521*a* so as to be movable forward and backward, and a fixing protrusion 541 of the handle lever 540, which will be described later, is fixed to a fixing hole 531*a* provided on the coupling hole 531, so that when a user pressurizes the handle lever 540 forward, the connection member 530 moves forward due to the fixing protrusion 541.

A spring S is provided on outer circumferential surfaces of the coupling protrusion 531 and the fixing protrusion 541 and disposed between the handle lever 440 and the connection member coupling portion 521, and the spring S is compressed by the handle lever 540 when the connection member 540 is moved forward by the handle lever 540.

When a user cancels the force applied to the handle lever 540, the spring S compressed by the handle lever 540 allows the handle lever 540 to move backward by an elastic force and thus the connection member 530 is moved backward.

An extension portion 553 of the rotation unit 550, which will be described later, is coupled to the rotation unit coupling hole 533, and the extension portion 553 bent at a lower portion of a shaft, which is rotatably coupled to the rotation unit coupling portion 521, and vertically downwardly extending, so that the rotation unit 550 is rotated about the shaft 551 when the connection member 530 moves forward and backward.

The handle lever 540 is disposed at a rear side of the handle 80 such that a user pressurizes the handle lever 540 forward while gripping the handle 80.

The handle lever 540 is provided with the fixing protrusion 541, which is fixed to the coupling protrusion 531 of the connection member 530, and when a user pressurizes the handle lever 540 to move forward, the connection member 530 moves forward and thus the rotation unit 550 is rotated.

The rotation unit 550 is connected to the connection member 530, and when the connection member 530 is moved forward and backward, is rotated leftward and rightward and thus hung and released with/from the hanging portion 511 of the fixing unit 510.

The rotation unit 550 includes the shaft 551 rotatably coupled to the rotation unit coupling portion 523 of the support 520, the extension portion 553 bent at a lower portion of the shaft 551 and vertically downwardly extending to be coupled to the rotation unit coupling hole 533 of the connection member 530, and the locking unit 555 extending from an upper portion of the shaft 551 in perpendicular to an extension direction of the shaft 551.

The shaft 551 is rotated by the connection member 530 that is rotatably coupled to the rotation unit coupling portion 523 and moved forward and backward.

Since the extension portion 553 is bent at a lower portion of the shaft 551 and coupled to the connection member 530 by vertically and downwardly extending, the center of the shaft 551 is not coincide with the center of the extension portion 553 coupled to the connection member 530.

Accordingly, when the connection member 530 moves forward and backward, the rotation unit 550 rotates about the shaft 551 clockwise or counterclockwise.

The locking portion 555 extends from an upper portion of the shaft 551 to be perpendicular to an extension direction of the shaft 551 while penetrating the second door 50. The hanging hook 557 is provided at an end of the locking portion 555 to be hung and released with/from the hanging hole 511*a* provided on the hanging portion 511 of the fixing unit 510.

When the shaft 551 is rotated while guided by the guide portion 529 of the support 520 and the guide 560 buried in the second door 50, the locking portion 555 is rotated together with the shaft 551 and thus the hanging hook 557 is hung and released with/from the hanging portion 511.

The rotation unit 550 is rotated about the shaft 551 counterclockwise as the extension portion 553 is pushed forward by the connection member 530 when the connection member 530 moves forward, and thus the locking portion 555 extending from the shaft 551 is rotated leftward.

In addition, the rotation unit 550 is rotated about the shaft 551 clockwise as the extension portion 553 is pulled backward by the connection member 530 when the connection member 530 moves backward, and thus the locking portion 555 extending from the shaft 551 is rotated rightward.

The guide portion 560 is buried in the second door 50, and communicating with the guide portion 529 of the support 520 such that the locking portion 555 of the rotation unit 550 is guided to penetrate the second door 50.

Hereinafter, an operation of the latch device 500 will be described with reference to FIGS. 59 to 65.

Figure 59:
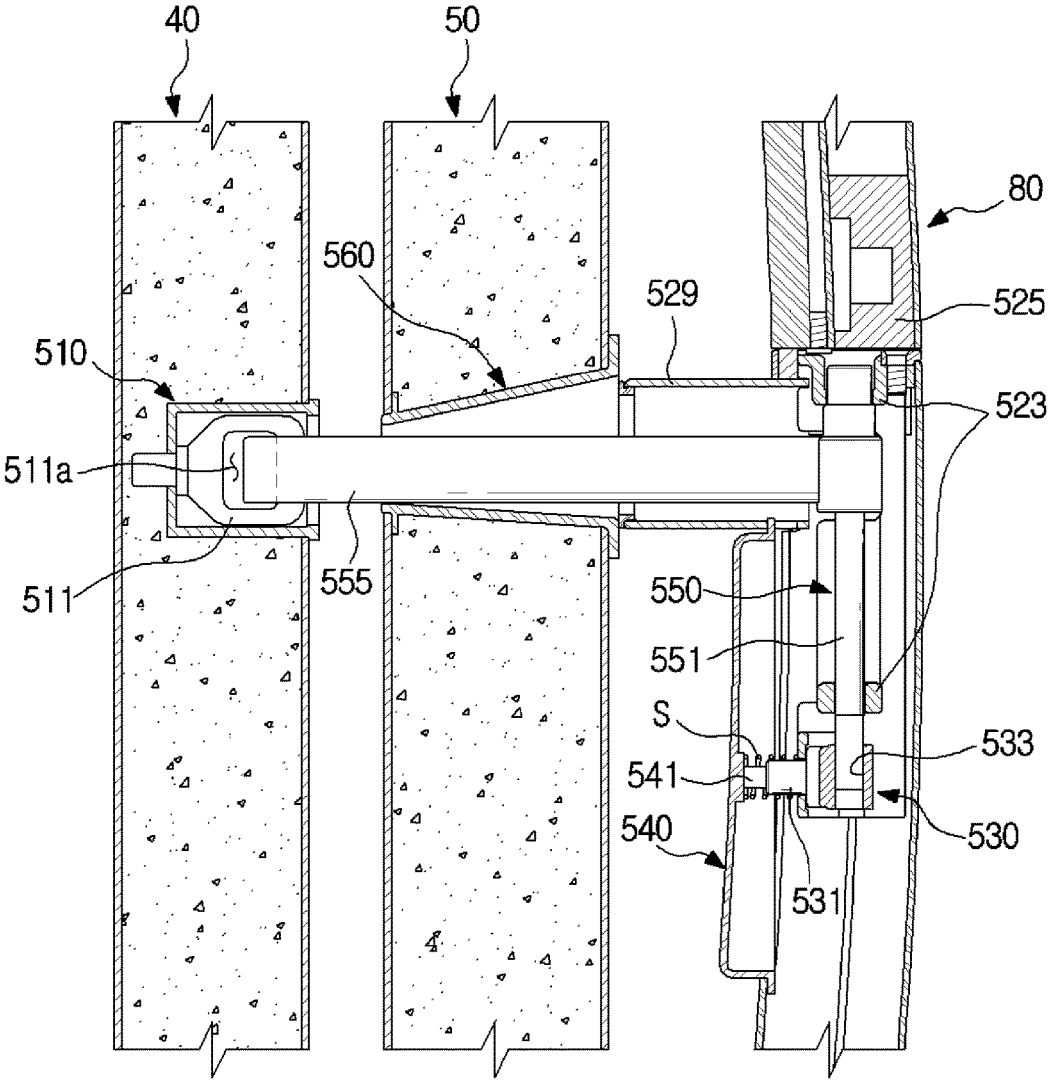
FIG. 59 is a cross-sectional view of a state in which the second door is fixed to the first door by the latch device shown in FIG. 56.
Figure 60:
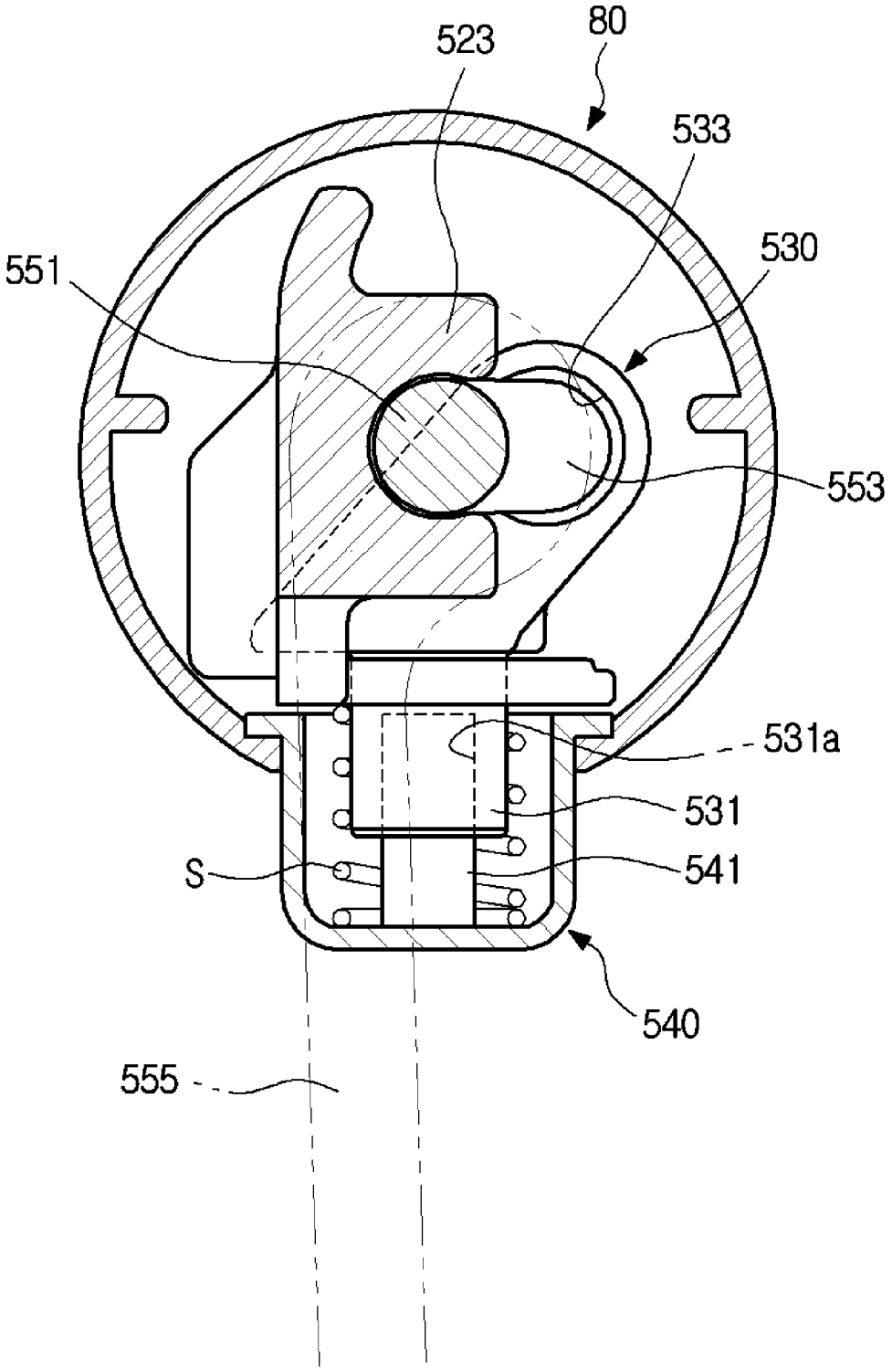
FIG. 60 is a top view of the latch device shown in FIG. 59.
Figure 61:
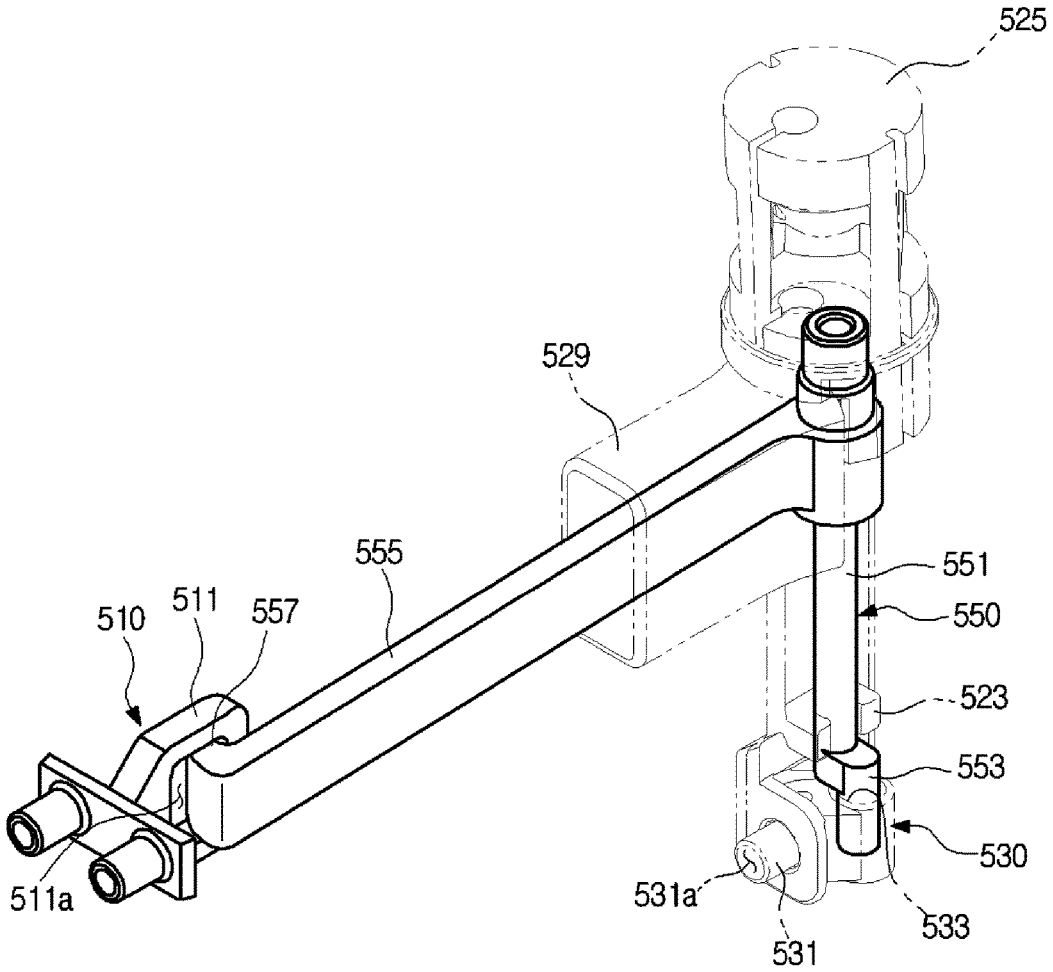
FIG. 61 is a view of the latch device shown in FIG. 59.

Referring to FIGS. 59 to 61, when both of the first door 40 and the second door 50 are closed, the hanging hook 557 provided on the locking portion 555 of the rotation unit 550 is hung with the hanging portion 511 of the fixing unit 510. In this case, the second door 50 is maintained fixed to the first door 40, and when a user opens the second door 50 by gripping the handle 80, the first door 40 and the second door 50 are open together.

Figure 62:
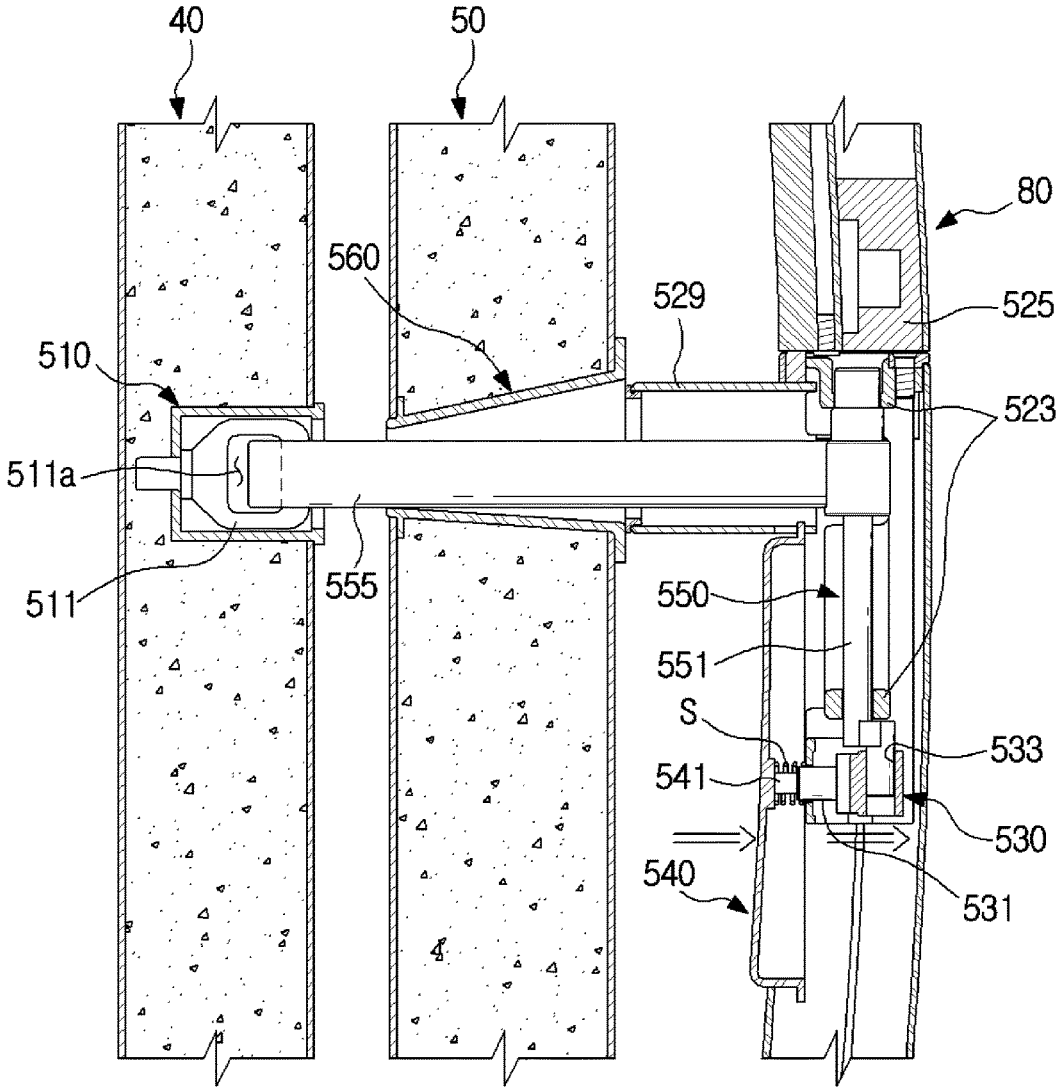
FIG. 62 is a cross-sectional view of a state in which the second door fixed to the first door is released by the latch device shown in FIG. 56.
Figure 63:
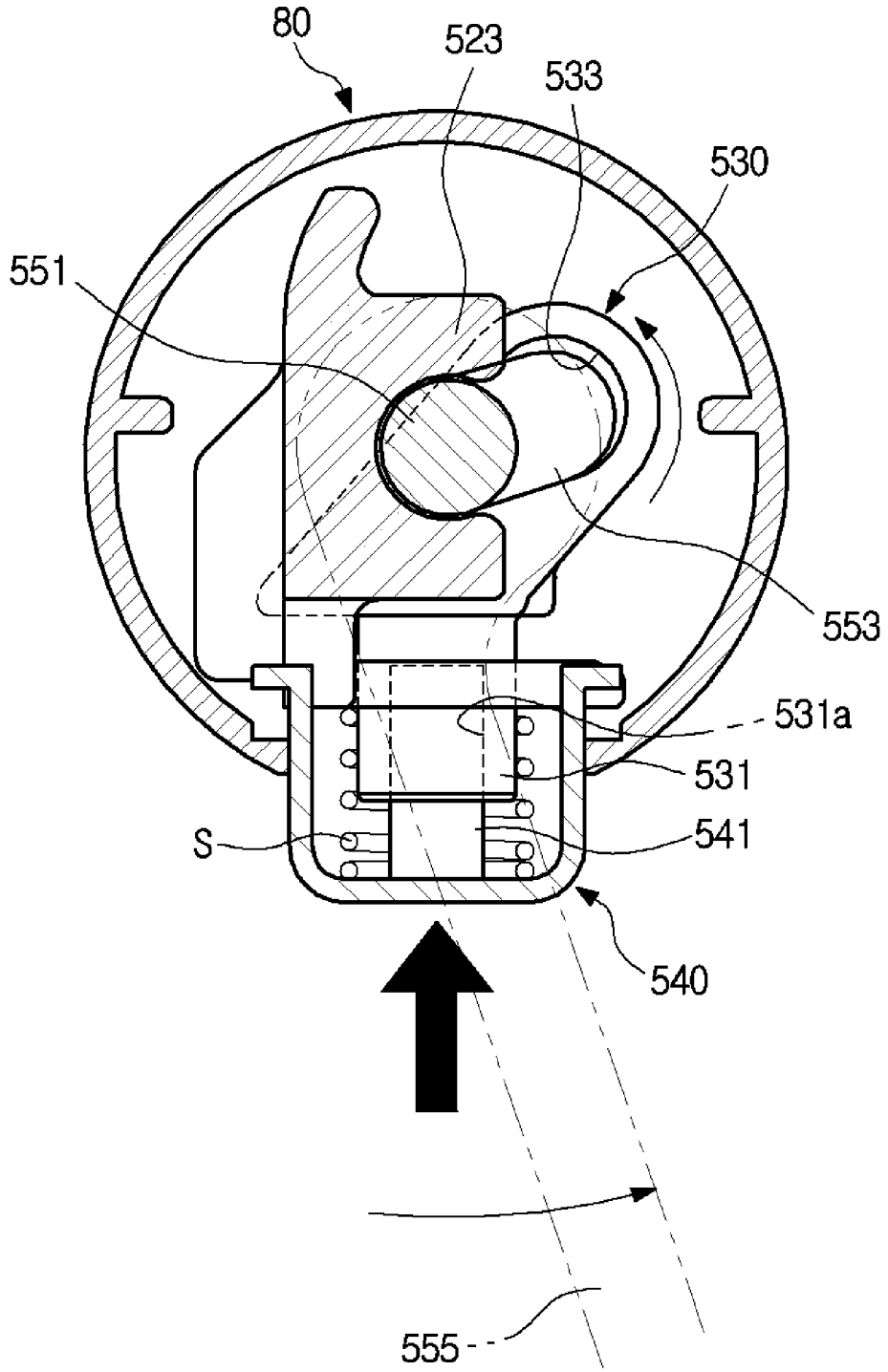
FIG. 63 is a top view of the latch device shown in FIG. 62.
Figure 64:
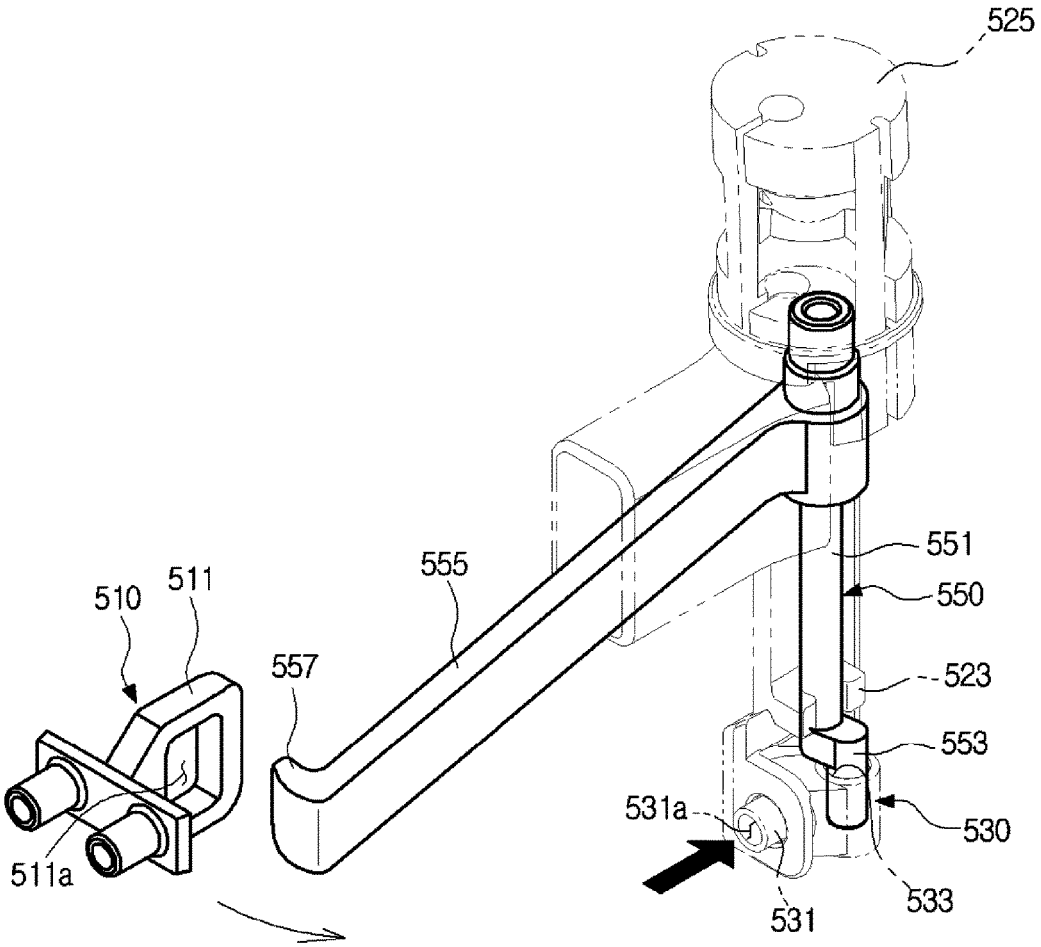
FIG. 64 is a view of the latch shown in FIG. 62.

Referring to FIGS. 62 to 64, when a user pressurizes the handle lever 40 forward while gripping the handle 80, the handle lever 540 moves forward such that the fixing protrusion 541 of the handle lever 540 pushes the coupling protrusion 531 of the connection member 530 forward.

At this time, the spring S disposed between the handle lever 540 and the connection member coupling portion 521 is compressed, and the connection member 530 is moved forward.

The connection member 530 moved forward pushes the extension portion 553 of the rotation unit 550 forward, and as the extension portion 553 is moved forward by the connection member 530, the rotation unit 550 is rotated about the shaft 553 counterclockwise.

When the rotation member 550 is rotated about the shaft 551 counterclockwise, the locking portion 550 is rotated about the shaft 551 leftward.

Figure 65:
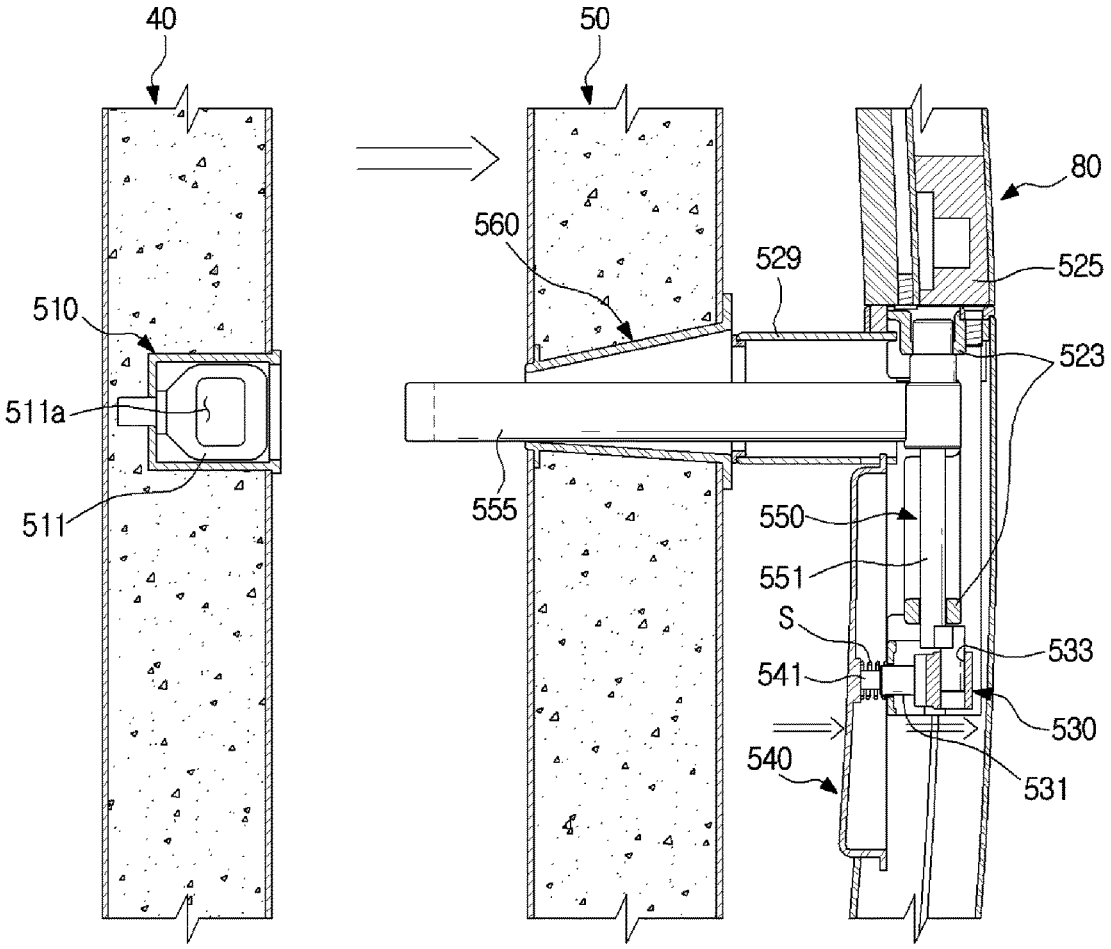
FIG. 65 is a cross-sectional view of a state in which the second door shown in FIG. 62 is opened.

When the locking portion 550 is rotated leftward, the hanging hook 557 provided on the locking portion 55 is released from the hanging portion 511 of the fixing unit 510, so that the second door 50 is released from being fixed to the first door 40. Accordingly, when a user opens the second door 50, only the second door 50 is opened as shown in FIG. 65.

Although not shown in the drawing, when a user removes the hand from the handle 80 after opening the second door 50, the handle lever 540 is moved backward by an elastic force of the spring S, and thus the connection member 530 is moved together with the handle lever 540 backward.

When the connection member 530 is moved backward, the connection member 530 pulls the extension portion 553 of the rotation unit 550 backward, and the rotation unit 550 is rotated about the shaft 551 clockwise.

As the rotation unit 550 is rotated about the shaft 551 clockwise, the locking portion 555 is rotated on the shaft 551 rightward when viewed at the front of the refrigerator.

In the case in which a user closes the second door 50 having been open, the user pressurizes the handle lever 540 forward while griping the handle 80 so that the locking portion 555 of the rotation unit 550 is rotated about the shaft 551 leftward when viewed at the front of the refrigerator. Accordingly, when the user closes the second door 500 and removes the hand with the locking portion 555 rotated leftward, the locking portion 555 of the rotation unit 550 is rotated about the shaft 551 rightward, so that the hanging hook 557 is hung with the hanging portion 511 of the fixing unit 510, thereby causing the second door 50 to be fixed to the first door 40.

Figure 66:
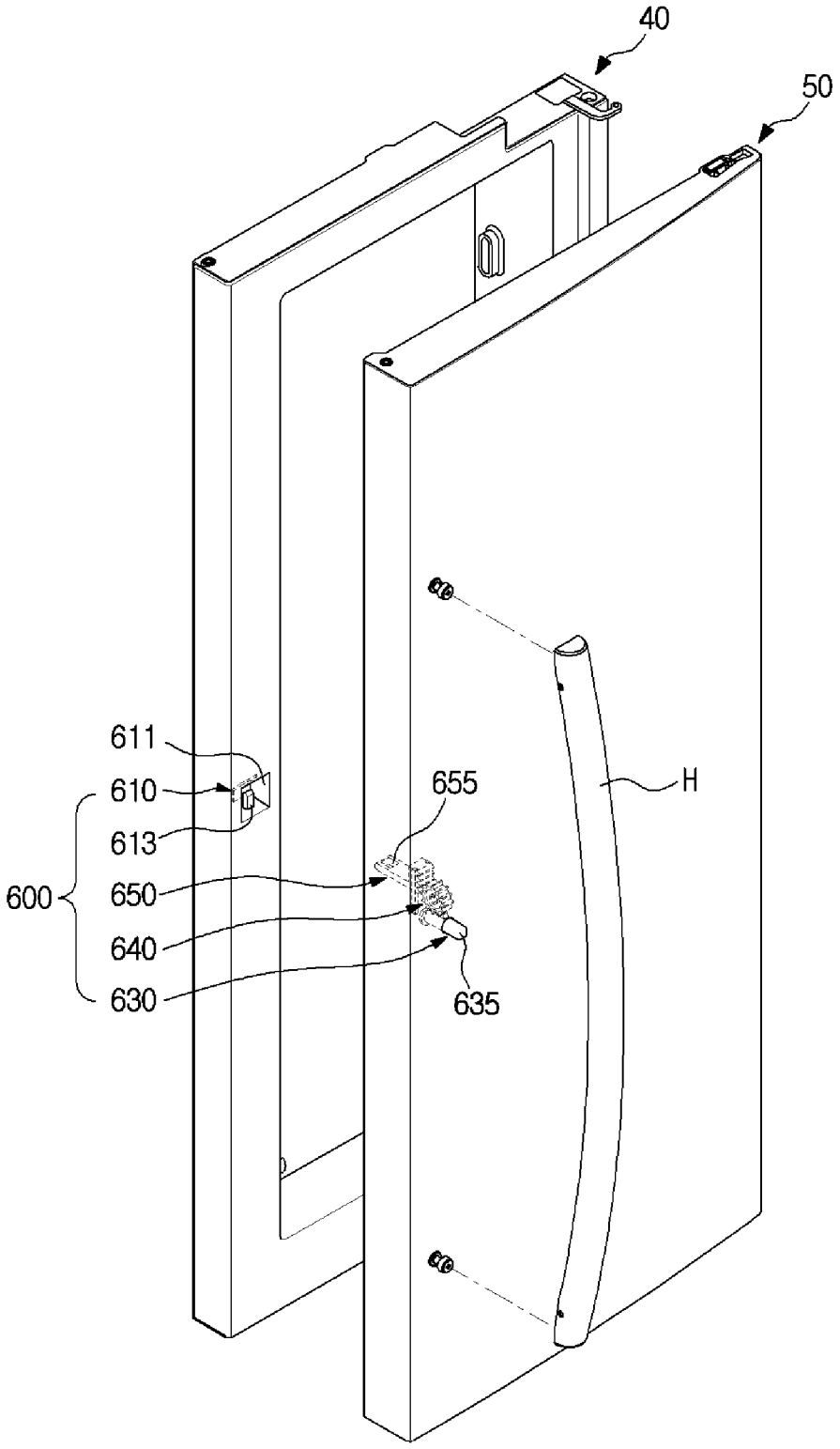
FIG. 66 is a view of the first door and the second door to which a latch device in accordance with still another embodiment of the present invention is applied.
Figure 67:
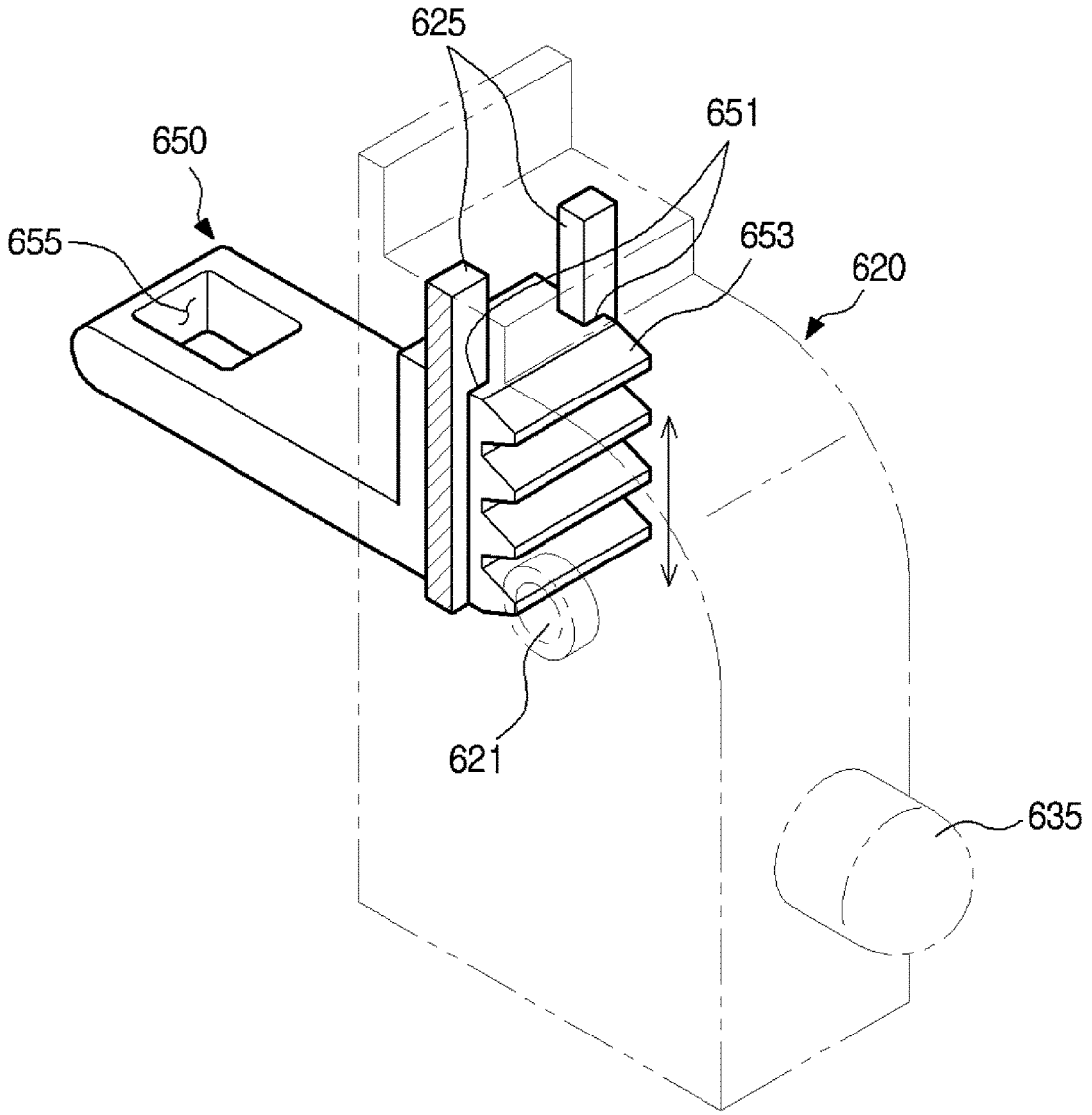
FIG. 67 is a schematic view of a part of the latch device shown in FIG. 66.
Figure 68:
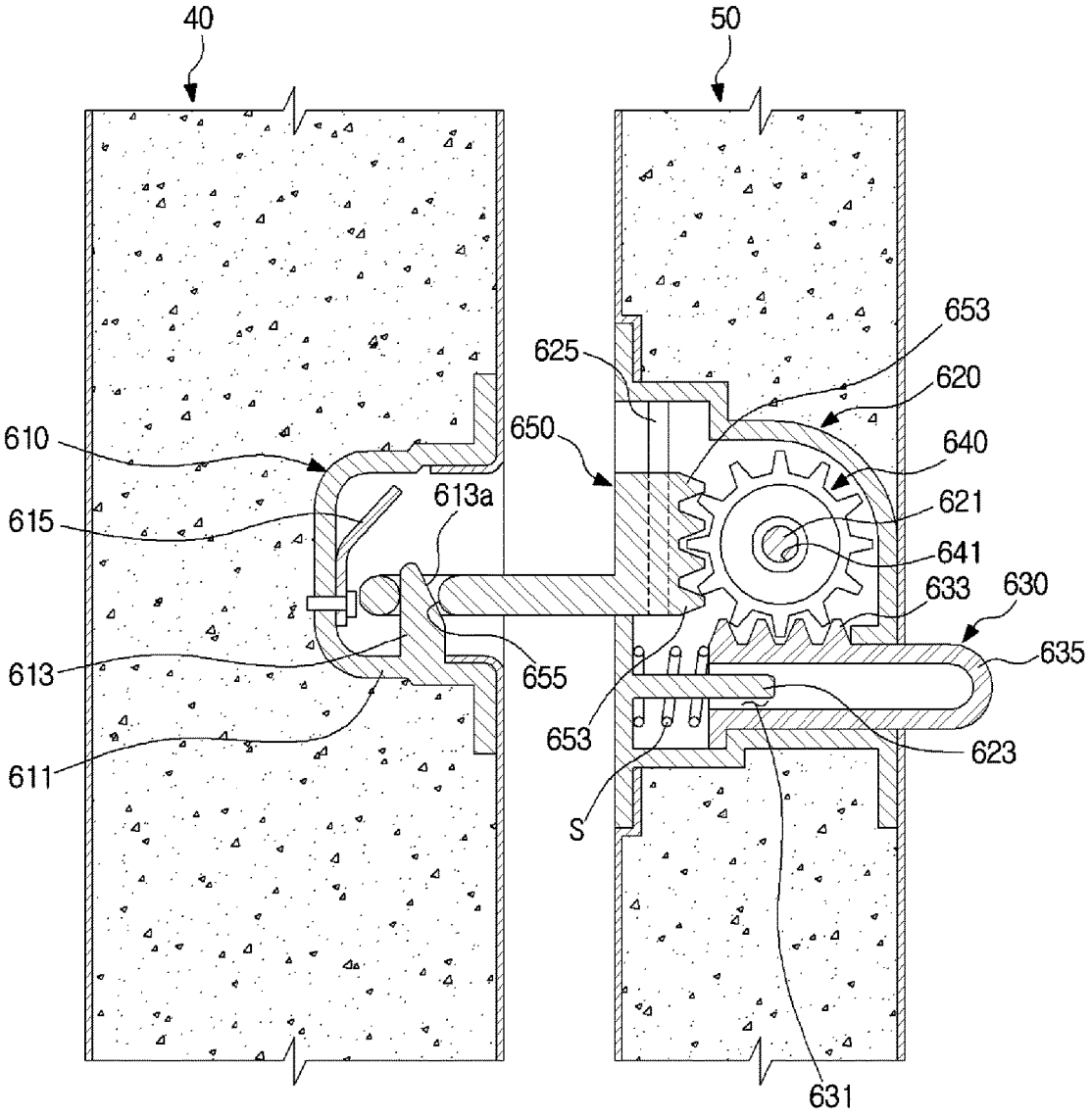
FIG. 68 is a cross-sectional view of a state in which the second door is fixed to the first door by the latch device shown in FIG. 66.

Referring to FIGS. 66 to 68, the second door 50 may be provided with a latch device 600 to selectively open and close the first door 40 and the second door 50.

The latch device 600 includes a fixing unit 610 buried in the front side of the first door 40, a support 620 buried in the second door 50, a rack 630 coupled to the support 620 so as to be movable forward and backward, a pinion gear 640 rotatably coupled to the support 620 and engaged with the rack 630 so as to be rotated when the rack 630 moves forward and backward, and a locking portion 650 engaged with the pinion gear 640 to be moved upward and downward when the pinion gear 640 is rotated.

The fixing unit 610 includes an accommodation portion 611 buried in the front side of the first door 40 and having a front side thereof open, and a hanging protrusion 631 protruding upward from a lower portion of the accommodation portion 611.

The accommodation portion 611 has the front side thereof open to accommodate a rear end of the locking portion 650 coupled to the support 620 buried in the second door 50.

The hanging protrusion 613 is provided in the accommodation portion 611 so as to be hung and released with/from a hanging groove 655 provided at the rear end of the locking portion 650 that is configured to move upward and downward.

An inclination surface 613*a* is provided at an upper end of a front side of the hanging protrusion 613, and when the second door 50 is closed, the rear end of the locking portion 650 rises and passes over the inclination surface 613*a* of the hanging protrusion 613 so that the hanging hole 655 of the locking portion 650 is hung with the hanging protrusion 611 of the fixing unit 610, thereby causing the second door 50 to be closed.

An elastic member 615 may be provided at a rear wall of the accommodation portion 611 to push the locking portion 650 forward when the locking portion 650 is moved upward and released from being hung with the hanging protrusion 613, to open the second door 50.

The support 620 is buried in the second door 50, and includes a rotation shaft 621 to which the pinion gear 640 is rotatably coupled, a rack coupling portion 623 to which the rack 630 is coupled to be movable forward and backward, and guide rails 625 allowing the locking portion 650 to move upward and backward.

A spring S having one side thereof supported by the support 620 and the other side thereof supported by the rack 630 is provided at an outer circumferential surface of the rack coupling portion 623, and when the rack 630 is moved backward, the spring S is compressed to store an elastic force and the stored elastic enables the rack 630 to be moved forward.

The guide rails 625 are provided corresponding to guide grooves 651 provided at both sides of the locking portion 650, to guide the locking portion 650 to move upward and downward.

The rack 630 includes a coupling hole 631 coupled to a rack coupling portion 623 of the support 620 so as to be moved forward and backward, a first rack gear 633 engaged with the pinion gear 640, and a press portion 635 provided at a front end portion of the rack 630 and exposed forward of the second door 50.

The first rack gear 633 is engaged with the pinion gear 640, and allows the pinion gear 640 to be rotated about the rotation shaft 621 when the rack 630 moves forward and backward.

The press portion 635 is exposed forward of the second door 50 so as to be pressed by a user.

When a user presses the press portion 635, the rack 630 is moved backward while compressing the spring S, so that the pinion gear 640 engaged with the first rack gear 633 is rotated about the rotation shaft 621 clockwise.

When a user cancels the force pressing the press portion 635, the rack 630 is moved forward by the elastic force of the spring S, and the pinion gear 640 is rotated about the rotation shaft 621 counterclockwise.

The pinion gear 640 includes a rotation hole 621 rotatably coupled to the rotation shaft 621 provided on the support 620, and is disposed to be engaged with the first rack gear 633 of the rack 630 and a second rack gear 653 of the locking portion 650.

When the rack 630 is moved backward, the pinion gear 640 is rotated about the rotation shaft 621 clockwise to move the locking portion 650 upward, and when the rack 630 is moved forward, the pinion gear 640 is rotated about the rotation shaft 621 counterclockwise to move the locking portion 650 downward.

The locking portion 650 includes the guide grooves 651 allowing the locking portion 650 to move upward and downward while being guided by the guide rails 625 provided on the support 620, the second rack gear 653 engaged with the pinion gear 640, and the hanging hole 655 provided at the rear end of the locking portion 650 so as to be hung and released with/from the hanging protrusion 613 of the fixing unit 610.

The guide groove 651 is vertically recessed in a shape corresponding to the guide rail 621 provided on the support 620, allowing the locking portion 650 to be moved upward and downward.

The second rack gear 653 is provided to be engaged with the pinion gear 640, so that the locking portion 650 moves upward and downward along the guide rail 625 when the rack 630 moves forward and backward, the pinion gear 640 is rotated about the rotation shaft 621.

The hanging hole 655 is provided at the rear end of the locking portion 650, and when the locking portion 650 moves upward and downward, is hung and released with/from the hanging protrusion 613 of the fixing unit 610, thereby causing the second door 50 to be fixed and released to/from the first door 40.

Hereinafter, an operation of the latch device 600 will be described with reference to FIGS. 68 to 71.

Referring to FIG. 68, when both of the first door 40 and the second door 50 are maintained closed, the hanging hole 655 of the locking portion 650 is hung with the hanging protrusion 613 of the fixing unit 610, and the second door 50 is maintained fixed to the first door 40.

In this case, when a user opens the second door 50 by gripping a handle H, the first door 40 and the second door 50 are open together.

Figure 69:
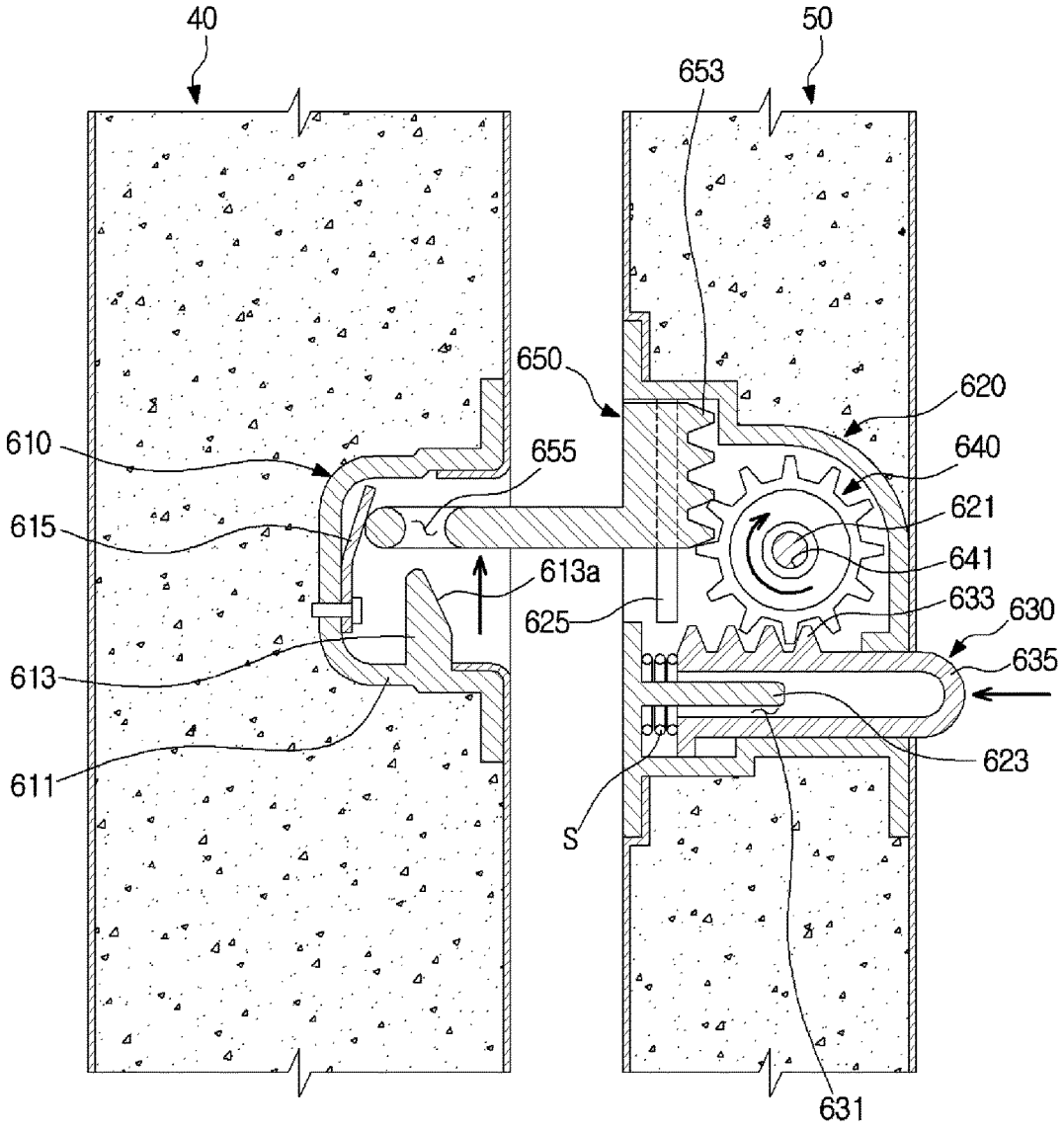
FIG. 69 is a cross-sectional view of a state in which the second door fixed to the first door is released by the latch device shown in FIG. 68.

Referring to FIG. 69, when a user pressurizes the press portion 635 protruding forward of the second door 50, the rack 630 is moved backward while compressing the spring S.

When the rack 630 is moved backward, the pinion gear 640 engaged with the first rack gear 633 is rotated about the rotation shaft 621 clockwise.

When the pinion gear 640 is rotated about the rotation shaft 621 clockwise, the locking portion 650 engaged with the pinion gear 640 is moved upward, so that the hanging hole 655 is released from the hanging protrusion 613.

The locking portion 650 released from being hung with the hanging protrusion 613 is moved upward, to compress the elastic member 615 provided on the fixing unit 610.

Figure 70:
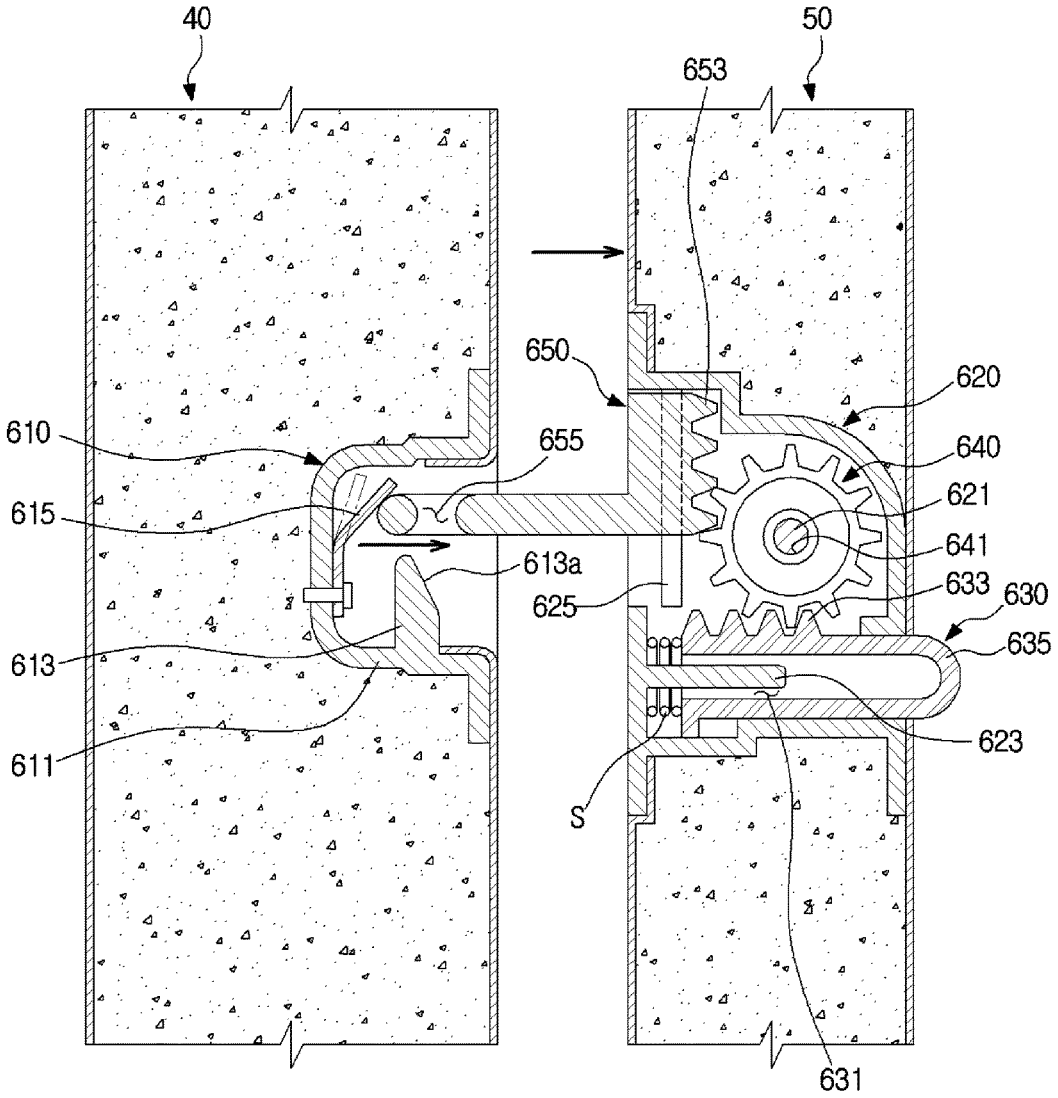
FIG. 70 is a cross-sectional view of a state in which the second door is opened by the latch device shown in FIG. 69.

Referring to FIG. 70, when a user removes the hand from the press portion 635 in a state that the elastic member 615 is compressed, the locking portion 650 is moved forward together with the second door 50 due to the compressing force of the elastic member 615, thereby opening only the second door 50.

Figure 71:
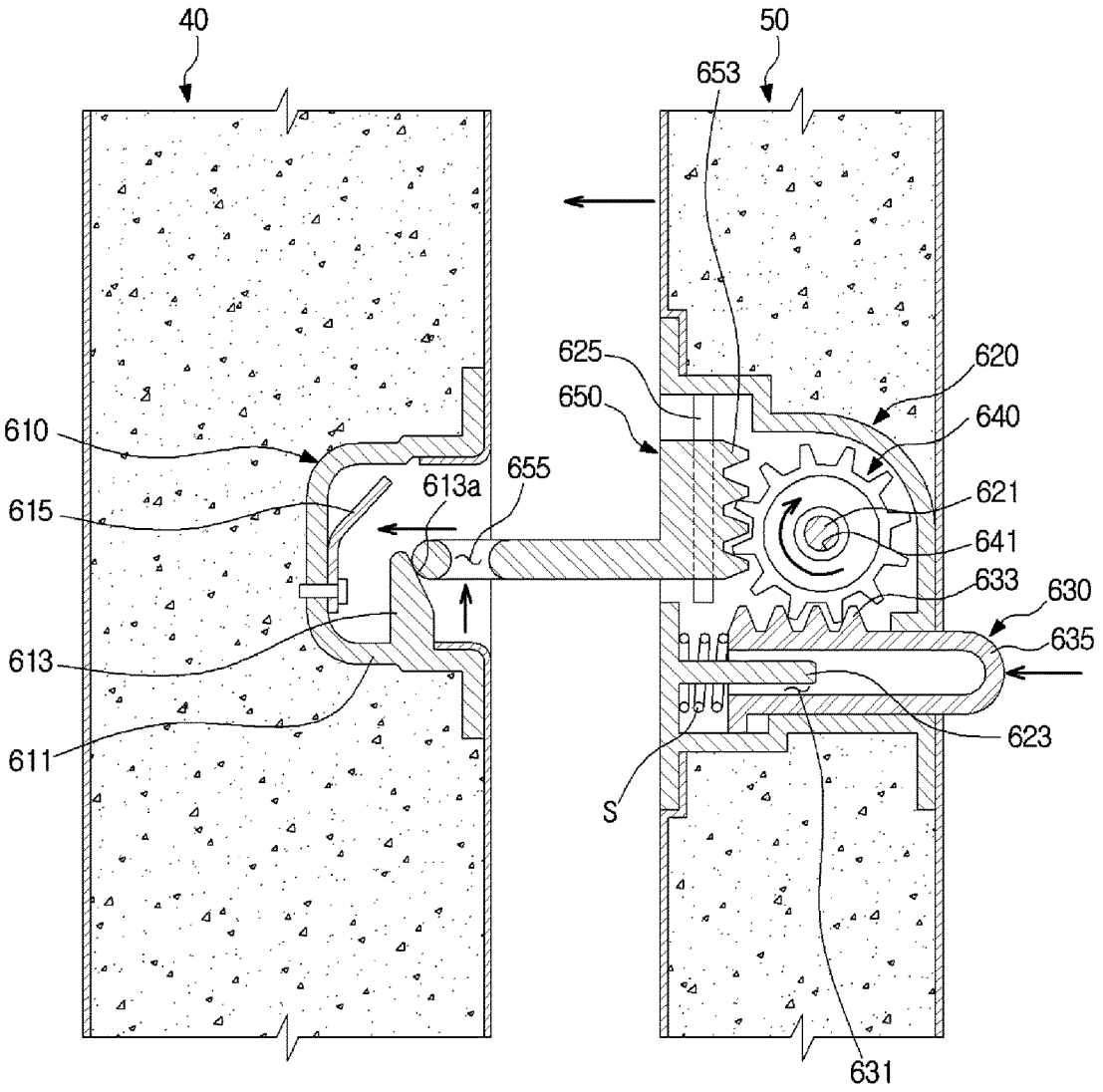
FIG. 71 is a cross-sectional view of a state in which the opened second door of 70 is closed.

Referring to FIG. 71, in the case in which a user closes the second door 50 having been open, the rear end of the locking portion 650, which has a circular shape, rises and passes over the inclination surface 613*a* provided on the hanging protrusion 613 of the fixing unit 610, so that the second door 50 is closed with the hanging protrusion 613 hung in the hanging hole 655 as shown in FIG. 68.

Although not shown in the drawings, in the case that a user closes the second door 50 having been open, the locking portion 650 is moved upward when a user pressurizes the press portion 635 to close the second door 50, and when the user removes the hand from the press portion after closing the second door 50, the rack 630 is moved forward by the elastic force of the spring S, and the locking portion 650 is moved downward, so that the hanging hole 655 is hung with the hanging protrusion 13.

Figure 72:
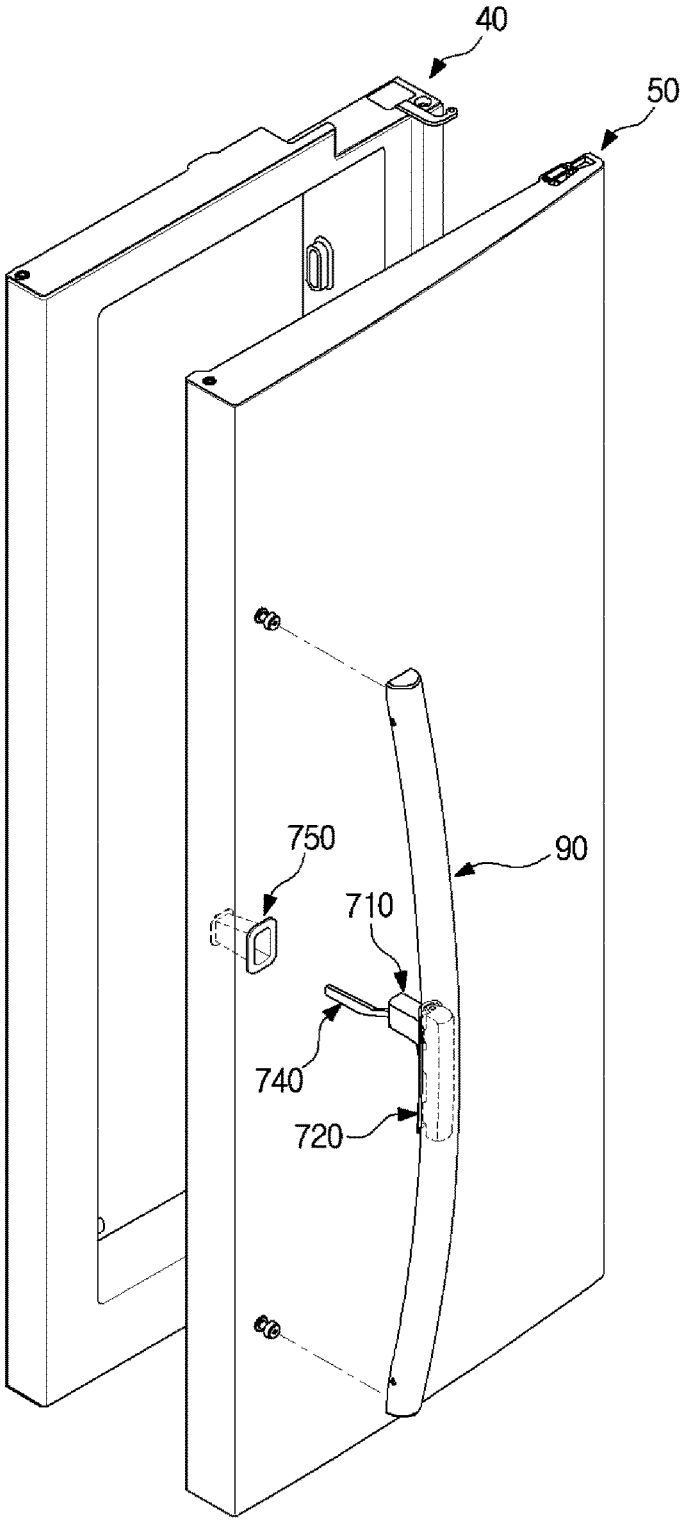
FIG. 72 is a view of the first door and the second door to which a latch device in accordance with still another embodiment of the present invention is applied.
Figure 73:
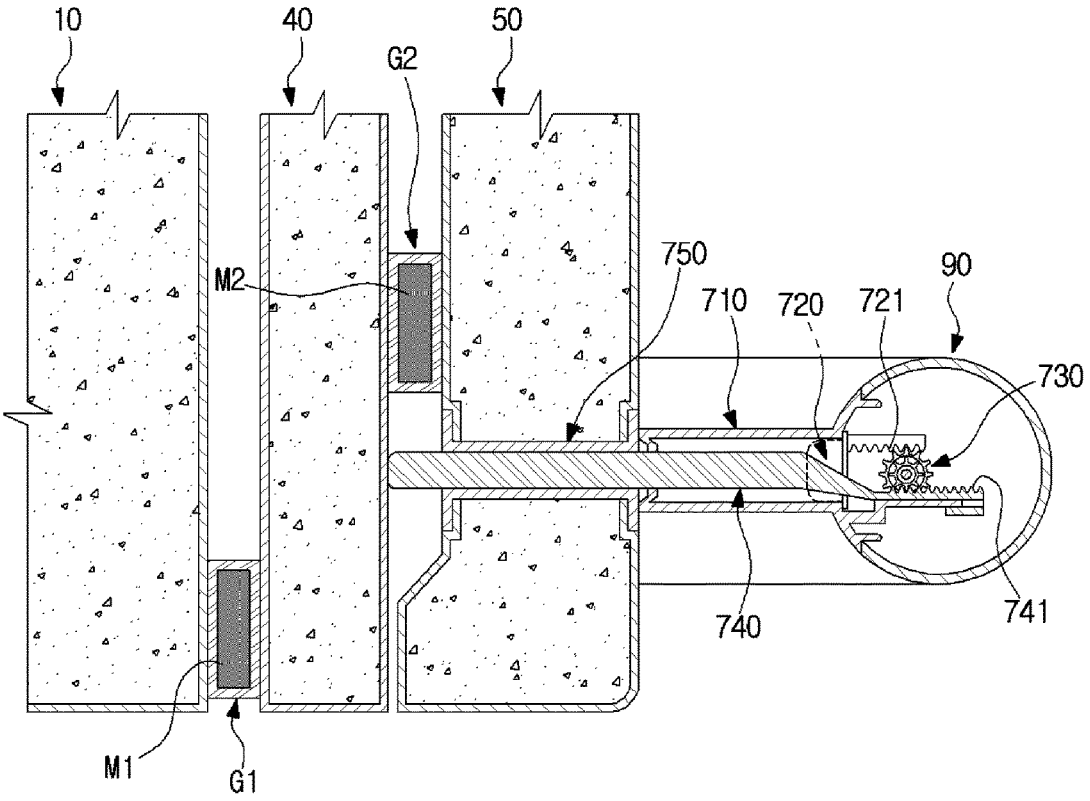
FIG. 73 is a view of a state in which both of the first door and the second door shown in FIG. 72 are closed.

Referring to FIGS. 72 and 73, the second door 50 is provided with a handle 90 to which a latch device 700 is coupled such that the second door 50 comes into close contact with the first door 40 and the close contact is released.

The first door 40 is provided at a rear side thereof with a first gasket G1 accommodating a first magnet M1 having a magnetic force allowing the first door 40 to come into close contact with the main body 10, and the second door 50 is provided at a rear side thereof with a second gasket G2 accommodating a second magnet M2 having a magnetic force allowing the second door 50 to come into close contact with the first door 40.

Each of the front side of the main body 10 and the front side of the first door 40 is formed of metal, and the first door 40 comes into close contact with the main body 10 by the first gasket G1, and the second door 50 comes into close contact with the first door 40 by the second gasket G2.

The second magnet M2 accommodated in the second gasket G2 has a magnetic force greater than that of the first magnet M1 accommodated in the first gasket G1, so that the first door 40 and the second door 50 are open together with each other when a user opens the second door 50 by gripping the handle 90.

The latch device 700 includes a support 710 coupled to the rear side of the handle 90 while being accommodated in the rear side of the handle 90, a handle lever 720 provided on the rear side of the handle 90 so as to be movable forward and backward, a pinion gear 730 engaged with the handle lever 720 so as to be rotated when the handle lever 720 moves forward and backward, and a slider 740 moved in a direction opposite to a direction of the handle lever 720 when the pinion gear 730 is rotated.

The handle lever 720 is disposed on the rear side of the handle 90 while disposed on the rear side of the support 710.

The handle lever 720 includes a first rack gear 721 provided to be movable forward and backward and engaged with the pinion gear 730.

When a user pressurizes the handle lever 720 while gripping the handle 90, the handle lever 720 is moved forward, and the pinion gear 730 engaged with the handle lever 720 is rotated clockwise.

The pinion gear 730 is disposed between the handle lever 720 and the slider 740 to be engaged with the first rack gear 721 of the handle lever 720 and a second rack gear 741 of the slider 740.

The pinion gear 730 allows the handle lever 720 and the slider 740 to linearly move in opposite directions to each other. When the handle lever 720 is moved forward, the pinion gear 730 rotates clockwise, so that the slider 740 is moved backward, and when the handle lever 720 is moved backward, the pinion gear 730 is rotated counterclockwise, so that the slider 740 is moved forward.

In contrast, when the slider 740 is moved backward, the pinion gear 730 is rotated clockwise, so that the handle lever 720 is moved forward, and when the slider 740 is moved forward, the pinion gear 730 is rotated counterclockwise, so that the handle lever 720 is moved backward.

The slider 740 includes the second rack gear 741 provided to be movable forward and backward and engaged with the pinion gear 730.

The slider 740 is guided by a guide 750 buried in the second door 50 so that a rear end portion of the slider 740 makes contact with the front side of the first door 40 by passing through the second door 50 when the second door 50 is closed. The slider 740 is moved in a direction opposite to a direction of the handle lever 720.

Hereinafter, an operation of the latch device 700 will be described with reference to FIGS. 73 to 76.

Referring to FIG. 73, the rear end portion of the slider 740 is maintained in contact with the front side of the first door 40 when the second door 50 is maintained closed.

Figure 74:
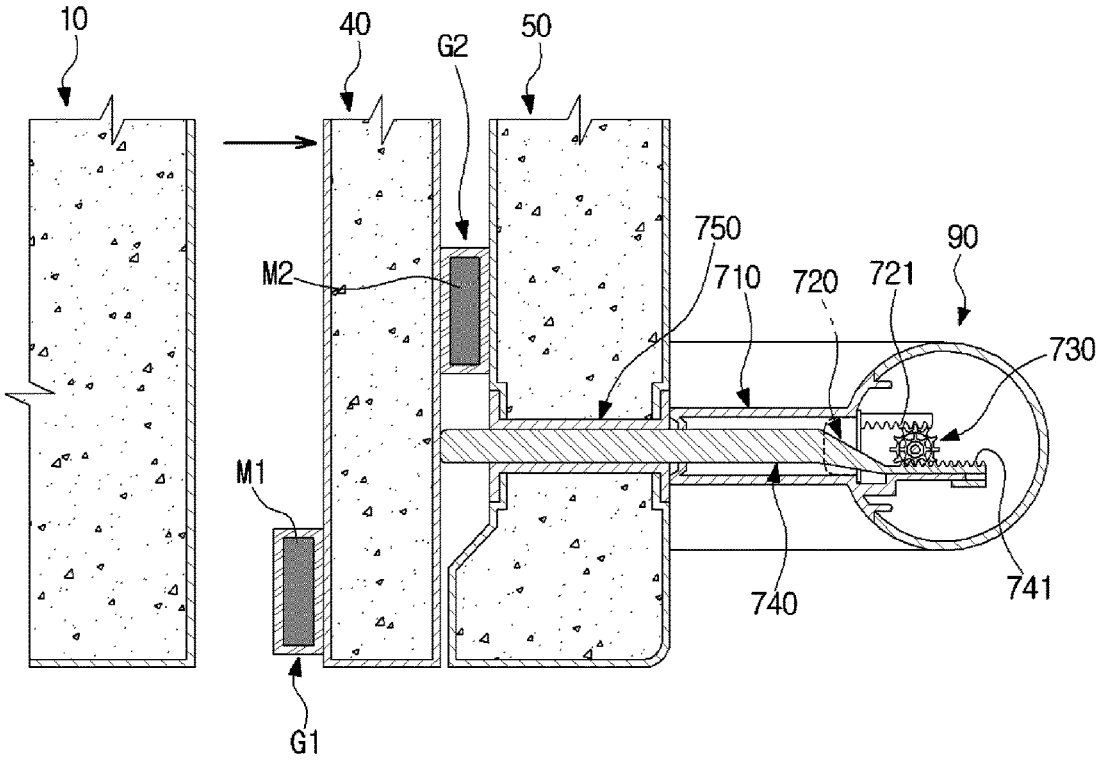
FIG. 74 is a cross-sectional view of a state in which contact of the second door with the first door is released by the latch device shown in FIG. 72.

Since the second magnet M2 accommodated in the second gasket G2 has a magnetic force greater than that of the first magnet M1 accommodated in the first gasket G1, the first door 40 and the second door 50 are open together with each other when a user opens the second door 50 as shown in FIG. 74.

Figure 75:
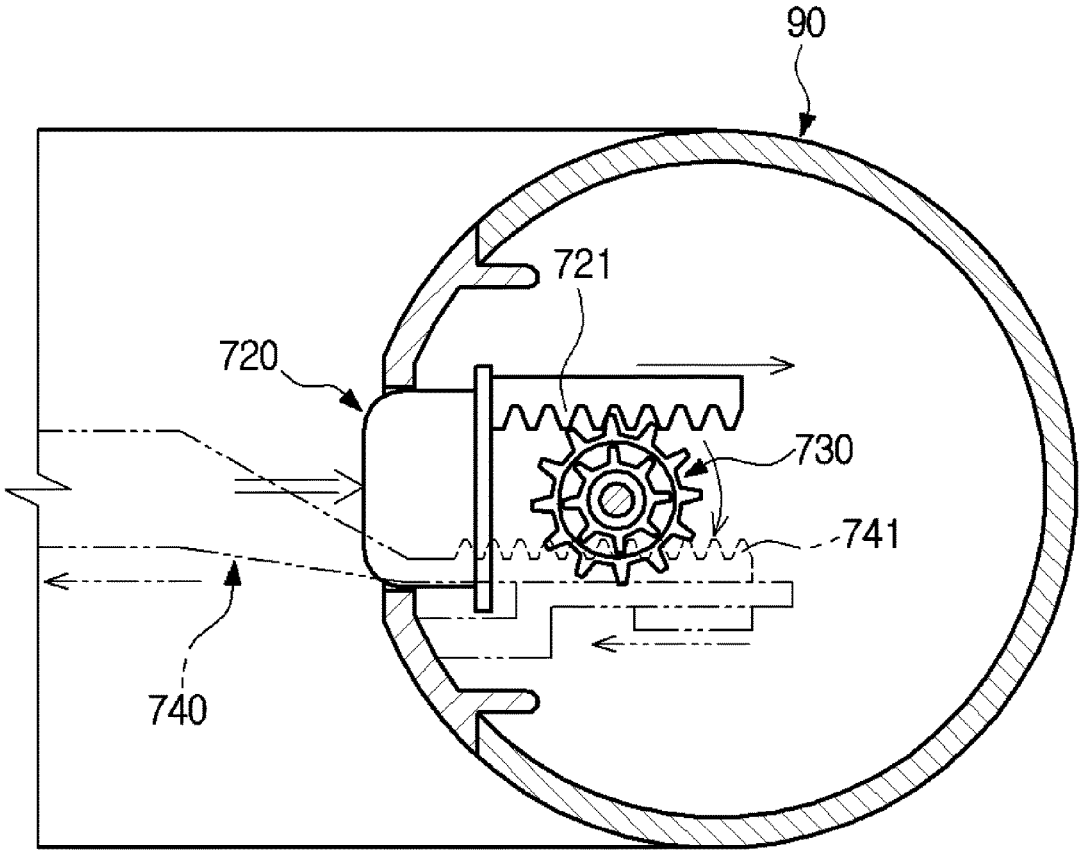
FIG. 75 is a view of an operation of the latch device shown in FIG. 74.
Figure 76:
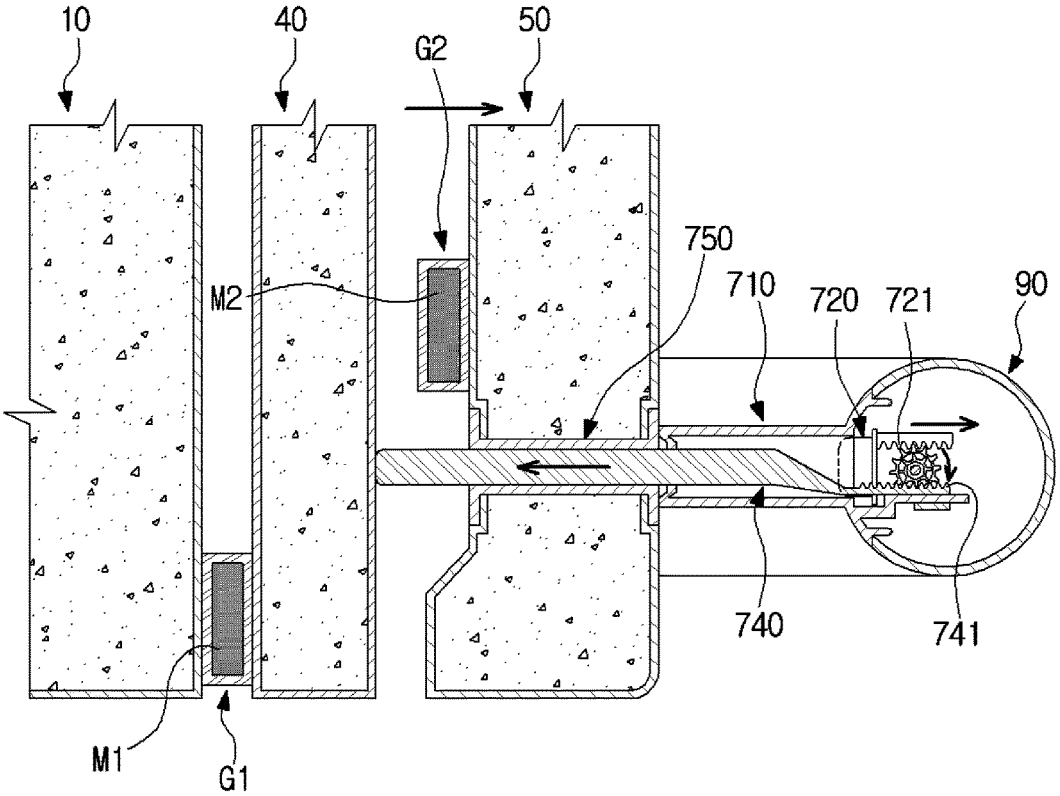
FIG. 76 is a cross-sectional view of an operation of the latch device when the second door of FIG. 74 is closed.

Referring to FIGS. 75 and 76, when a user pressurizes the handle lever 720 forward, the handle lever 720 is moved forward so that the pinion gear 730 is rotated clockwise, and the slider 740 is moved backward by the pinion gear 730.

As the slider 740 is moved backward with the rear end portion thereof making contact with the front side of the first door 40, the contact of the second door 50 with the first door 40 is released and the second door 50 is open.

Although not shown in the drawings, when the second door 50 having been open is closed, the rear end portion of the slider 740 moved backward is pushed forward while making contact with the front side of the first door 40, thereby closing the second door 50.

Accordingly, when the second door 50 is closed, the slider 740 is moved forward and the handle lever 720 is moved backward.

As is apparent from the above, the convenience of a user can be improved since the doors are selectively opened and closed by only one handle.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body having a storage compartment;

a first door for the storage compartment disposed at a front side of the main body and having an opening formed therein;

a second door disposed at a front side of the first door, and which moves to open and close the opening of the first door;

a handle coupled to the second door and having an opening;

a fixing unit provided at the first door;

a support coupled to a rear side of the handle, and including a cover that covers the opening of the handle and a guide portion extending from the cover to the second door; and a handle lever rotatably coupled to the support by a rotation shaft and including a first portion, and a second portion extending through the guide portion, and protruding from a rear surface of the second door, and configured to engage with, and disengage from, the fixing unit, wherein the handle lever is configured so that, when the first portion is pressed while the second portion is engaged with the fixing unit, the first portion rotates about the rotation shaft forward and the second portion rotates about the rotation shaft downward and thereby disengages from the fixing unit.

2. The refrigerator of claim 1, further comprising:

fastening members fastening the support to the handle, to thereby separably couple the support to the handle.

3. The refrigerator of claim 1, further comprising:

means for fastening the support to the handle, to thereby separably couple the support to the handle.

4. The refrigerator of claim 1, wherein the support of the latch device includes an opening through which the first portion of the handle lever is rotatable forward and backward, and a guide portion through which the second portion of the handle lever extends.

5. The refrigerator of claim 1, wherein the fixing unit includes a hook, the second portion of the handle lever is configured to engage with the hook when the first portion of the handle lever is released after being pressed, to thereby cause the second portion to be hung with the fixing unit and thereby allow the first door and the second door open and close together through operation of the handle, and the second portion of the handle lever is configured to disengage with the hook when the first portion of the handle lever is pressed, to thereby cause the second portion to be unhung from the fixing unit and thereby allow the second door to open and close alone through operation of the handle.

6. The refrigerator of claim 5, further comprising:

fastening members fastening the support to the handle, to thereby separably couple the support to the handle.

7. The refrigerator of claim 5, further comprising:

means for fastening the support to the handle, to thereby separably couple the support to the handle.

8. The refrigerator of claim 1, further comprising a spring elastically supporting the first portion of the handle lever such that the first portion of the handle lever rotates backward when the first portion of the handle lever is released after being pressed.

9. A refrigerator comprising:

a main body having a storage compartment;

a first door for the storage compartment disposed at a front side of the main body and having an opening formed therein;

a second door disposed at a front side of the first door, and which moves to open and close the opening of the first door;

a handle having first and second ends coupled to the second door and having an opening between the first and second ends on a rear side of the handle;

a fixing unit in the first door;

a support including a cover that covers the opening of the handle, and a guide portion extending from the cover to the second door between the first and second ends of the handle; and a handle lever rotatably coupled to the support by a rotation shaft and including a first portion, and a second portion extending through the guide portion, and protruding from a rear surface of the second door, and which is movable to be hung with, and unhung from, the fixing unit, wherein, the handle lever is configured so that, when the first portion is pressed with the second portion being hung with the fixing unit, the first portion rotates about the rotation shaft to move forward and the second portion rotates about the rotation shaft to move downward, to thereby cause the second portion to be unhung from the fixing unit and thereby allow the second door to move alone through operation of the handle.

10. The refrigerator of claim 9, further comprising:

fastening members fastening the support to the handle.

11. The refrigerator of claim 9, further comprising:

means for fastening the support to the handle.

* * * * *